US006838231B2

(12) United States Patent
Kobayashi et al.

(10) Patent No.: US 6,838,231 B2
(45) Date of Patent: Jan. 4, 2005

(54) PRODUCTION PROCESS OF SILVER HALIDE PHOTOGRAPHIC EMULSION AND SILVER HALIDE PHOTOGRAPHIC LIGHT-SENSITIVE MATERIAL

(75) Inventors: Katsumi Kobayashi, Kanagawa (JP); Takeshi Suzumoto, Kanagawa (JP); Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/270,296

(22) Filed: Oct. 15, 2002

(65) Prior Publication Data

US 2003/0180673 A1 Sep. 25, 2003

(30) Foreign Application Priority Data

Oct. 15, 2001 (JP) ..... P.2001-317104
Dec. 10, 2001 (JP) ..... P.2001-375933

(51) Int. Cl.[7] ..... G03C 5/18; G03C 5/26

(52) U.S. Cl. ..... 430/449; 430/570; 430/572; 430/574; 430/576; 430/581; 430/582; 430/583; 430/584; 430/585

(58) Field of Search ..... 430/449, 570, 430/572, 574, 576, 581–585

(56) References Cited

U.S. PATENT DOCUMENTS 6,117,629 A * 9/2000 Yamashita et al. ..... 430/570
6,387,610 B1 * 5/2002 Yamashita et al. ..... 430/574
6,521,401 B1 * 2/2003 Yamashita et al. ..... 430/570
6,537,742 B2 * 3/2003 Yamashita et al. ..... 430/574
2003/0215760 A1 * 11/2003 Yamashita et al. ..... 430/572

FOREIGN PATENT DOCUMENTS

| | | |
|---|---|---|
| EP | 0 887 700 | 12/1998 |
| JP | 64-91134 | 4/1989 |
| JP | 6-27578 | 2/1994 |

* cited by examiner

*Primary Examiner*—Geraldine Letscher
(74) *Attorney, Agent, or Firm*—Sughrue Mion, PLLC

(57) ABSTRACT

A process for producing a spectrally sensitized silver halide photographic emulsion having high sensitivity. A process for producing a silver halide photographic emulsion comprising as a sensitizing dye at least one connection dye having two or more chromophores connected through a covalent bond, the process comprising adding said connection dye to a silver halide photographic emulsion and allowing at least one chromophore out of a plurality of chromophores in the molecule of the connection dye to change in the adsorption strength to a silver halide grain; and a process for producing a silver halide photographic emulsion comprising a silver halide grain having adsorbed on the surface thereof a sensitizing dye in multiple layers, the process comprising adding one or a plural of sensitizing dye(s) to said silver halide emulsion and allowing at least one sensitizing dye out of added sensitizing dyes to change in the adsorption strength to a silver halide grain.

13 Claims, No Drawings

PRODUCTION PROCESS OF SILVER HALIDE PHOTOGRAPHIC EMULSION AND SILVER HALIDE PHOTOGRAPHIC LIGHT-SENSITIVE MATERIAL

FIELD OF THE INVENTION

The present invention relates to a process for producing a silver halide photographic emulsion, characterized in that a connection dye is added to a silver halide photographic emulsion and thereafter, allowed to change in the adsorption strength to a silver halide grain, and also relates to a silver halide photographic light-sensitive material having an emulsion produced by this process.

Furthermore, the present invention relates to a process for producing a silver halide photographic emulsion, characterized in that a dye is adsorbed in multiple layers on the surface of a silver halide grain and after the addition to a silver halide emulsion, allowed to change in the adsorption strength to a silver halide grain, and also relates to a silver halide photographic light-sensitive material having an emulsion produced by this process.

BACKGROUND OF THE INVENTION

Methine dye compounds have been conventionally used as a spectral sensitizing dye for silver halide photographic light-sensitive materials. With respect to the technology for improving the light absorptivity of a silver halide grain, the following techniques are known. In order to improve the light absorptivity per one grain, the adsorption density of the sensitizing dye to a silver halide grain must be increased, however, a normal spectral sensitizing dye adsorbs as a monomolecular layer almost in the maximum density filling state and does not adsorb any more.

For the purpose of solving this problem, several proposals have been heretofore made. P. B. Gilman, Jr. et al., *Photographic Science and Engineering*, Vol. 20, No. 3, page 97 (1976) describes a technique of allowing a cationic dye to adsorb as a first layer and an anionic dye to adsorb as a second layer using electrostatic force. U.S. Pat. No. 3,622,316 (G. B. Bird et al.) describes a technique of allowing a plurality of dyes to adsorb in multiple layers to a silver halide grain and attaining the sensitization by virtue of Forster-type excited energy transfer.

JP-A-63-138341 (the term "JP-A" as used herein means an "unexamined published Japanese patent application") and JP-A-64-84244 (both Sugimoto et al.) describe a technique of performing the spectral sensitization using the energy transfer from a light-emitting dye.

These techniques all have been proposed with an attempt to allow a dye to adsorb to a silver halide grain in excess of the saturated adsorption amount, however, the effect of elevating the sensitivity is not so high and there is a problem such as increase in the intrinsic desensitization.

On the other hand, U.S. Pat. Nos. 2,393,351, 2,425,772, 2,518,732, 2,521,944 and 2,592,196 and European Patent 565,083 describe a two components-connected dye in which two or more non-conjugated dye chromophores are connected through a covalent bond. This technique is, however, not intended to improve the light absorptivity. As for the technique of aggressively improving the light absorptivity, U.S. Pat. Nos. 3,622,317 and 3,976,493 (both G. B. Bird et al.) describe a technique of adsorbing a connection-type sensitizing dye molecule having a plurality of cyanine chromophores to increase the light absorptivity with an attempt to attain sensitization by the energy transfer, however, remarkable elevation of the sensitivity is not obtained.

JP-A-64-91134 (Ukai et al.) proposes a technique of connecting at least one substantially non-adsorptive dye containing at least two sulfo or carboxy groups to a spectral sensitizing dye capable of adsorbing onto silver halide.

Also, in the spectral sensitization, JP-A-6-27578 (Vishwakarma et al.) uses a 2 components-connected dye in which a cyanine dye adsorptive to silver halide and an oxonol not adsorptive to silver halide are connected, or EP-A-887700 (Parton et al.) uses a 2 components-connected dye in which an adsorptive cyanine dye and a non-adsorptive merocyanine dye or the like are connected using a specific linking group. In these techniques, however, the sensitivity is not sufficiently elevated by the energy transfer.

As such, sufficiently high elevation of the sensitivity is not yet achieved in any of these patents and publications and more development of techniques is being demanded.

SUMMARY OF THE INVENTION

Accordingly, one object of the present invention is to provide a high-sensitive silver halide photographic light-sensitive material.

Another object of the present invention is to provide a process for producing a high-sensitive spectrally sensitized silver halide emulsion.

These objects of the present invention can be attained by the following means.

(1) A process for producing a silver halide photographic emulsion comprising as a sensitizing dye at least one connection dye having two or more chromophores connected through a covalent bond, the process comprising adding the connection dye to a silver halide photographic emulsion and allowing at least one chromophore out of a plurality of chromophores in the molecule of the connection dye to change in the adsorption strength to a silver halide grain.

(2) The process for producing a silver halide photographic emulsion as described in (1), wherein the change in the adsorption strength to a silver halide occurred in at least one chromophore out of a plurality of chromophores in the molecule of the connection dye is a change from weak adsorption strength to strong adsorption strength occurred after the addition to an emulsion.

(3) The process for producing a silver halide photographic emulsion as described in (1) or (2), wherein the change in the adsorption strength to a silver halide occurred in all chromophores excluding at least one chromophore out of a plurality of chromophores in the molecule of the connection dye is a change from weak adsorption strength to strong adsorption strength occurred after the addition to an emulsion.

(4) The process for producing a silver halide photographic emulsion as described in (1), (2) or (3), wherein the change in the adsorption strength to a silver halide occurred in all chromophores excluding at least one chromophore out of a plurality of chromophores in the molecule of the connection dye is a change from weak adsorption strength to strong adsorption strength occurred after the addition to an emulsion and the weak adsorption strength is weaker than the adsorption strength of a chromophore undergoing no change in the adsorption strength.

(5) The production process as described in (1) or (2), wherein the change in the adsorption strength to a silver halide grain is brought about by the change of pH of the emulsion.

(6) The process for producing a silver halide photographic emulsion as described in (1) to (5), wherein the change in the adsorption strength to a silver halide grain occurred in at least one chromophore out of a plurality of chromophores in the molecule of the connection dye is brought about by the addition or dissociation of a proton.

(7) The process for producing a silver halide photographic emulsion as described in (1) to (6), which comprises a step of changing the pH of the emulsion by 0.2 to 5.0 units after the addition of the sensitizing dye.

(8) The process for producing a silver halide photographic emulsion as described in (1) to (7), wherein the change of pH after the addition of the dye at the production of the emulsion is from 1.0 to 4.0 units.

(9) The process for producing a silver halide photographic emulsion as described in (1) to (8), wherein the change of pH at the production of the emulsion is a change from a high pH to a low pH.

(10) The process for producing a silver halide photographic emulsion as described in (1) to (9), wherein the connection dye is represented by the following formula (1):

$$(D_1)_{r2}[(\text{—La—})_{qa}(D_2)_{q1}]_{r1}CI_y \quad (1)$$

wherein La represents a linking group, $D_1$ and $D_2$ each represents a chromophore, $q_1$, $r_1$ and $r_2$ each represents an integer of 1 to 100, qa represents an integer of 1 to 4, CI represents an ion for neutralizing the electric charge, and y represents a number necessary for neutralizing the electric charge, provided that at least one dissociative group or protonatable group (a group capable of protonation) is contained within the molecule.

(11) The process for producing a silver halide photographic emulsion as described in (1) to (10), wherein the at least one dissociative group or protonatable group contained within the molecule of the compound represented by formula (1) is a dissociative group.

(12) A silver halide photographic light-sensitive material comprising at least one or more silver halide photographic emulsion produced by the production process described in (1) to (11).

(13) The silver halide photographic light-sensitive material as described in (12), wherein a sensitizing dye containing a connection dye is adsorbed in multiple layers in the silver halide photographic emulsion layer produced by the production process of the present invention.

(14) The production process as described in (10) or (11) or the silver halide photographic light-sensitive material as described in (12) or (13), wherein the compound represented by formula (1) contains at least one cyanine chromophore within the molecule.

(15) The silver halide photographic light-sensitive material as described in (14), wherein the compound represented by formula (1) adsorbs to a silver halide grain through one cyanine chromophore contained within the molecule and forms a J-aggregate and other cyanine chromophore or other chromophore not adsorbing to a silver halide grain undertakes, when photo-excited, electron transfer or energy transfer to the adsorbed cyanine chromophore.

(16) The silver halide photographic light-sensitive material as described in (12) to (15), wherein in the silver halide photographic emulsion produced by the process of (1) to (11) or (14), 50% (area) or more of all silver halide grains in the emulsion are tabular grains having an aspect ratio of 2 or more.

(17) The silver halide photographic light-sensitive material as described in any one of (12) to (16), wherein the silver halide photographic emulsion produced by the process of (1) to (11) or (14) is subjected to selenium sensitization.

(18) A process for producing a silver halide photographic emulsion comprising a silver halide grain having adsorbed on the surface thereof a sensitizing dye in multiple layers, the process comprising adding one or a plurality of sensitizing dye(s) to the silver halide emulsion and allowing at least one sensitizing dye out of added sensitizing dyes to change in the adsorption strength to a silver halide grain.

(19) The process for producing a silver halide photographic emulsion as described in (18), wherein the change in the adsorption strength is performed by the change of pH.

(20) The process for producing a silver halide photographic emulsion as described in (18) or (19), wherein the adsorption amount of the sensitizing dye changes (preferably the adsorption amount increases) by the change in the adsorption strength.

(21) The process for producing a silver halide photographic emulsion as described in (18) to (20), wherein the change in the adsorption strength is brought about by the addition or dissociation of a proton.

(22) The process for producing a silver halide photographic emulsion as described in (18) to (21), which comprises a step of changing the pH of the emulsion by 0.2 to 5.0 units after the addition of the sensitizing dye.

(23) The process for producing a silver halide photographic emulsion as described in (18) to (22), wherein the change of pH of the emulsion after the addition of the dye is from 0.5 to 3.0 units.

(24) The process for producing a silver halide photographic emulsion as described in (18) to (23), wherein the change of pH at the production of the emulsion is a change from a high pH to a low pH.

(25) The process for producing a silver halide photographic emulsion as described in (18) to (24), wherein the sensitizing dye is a combination of at least two methine dyes shown later.

(26) The process for producing a silver halide photographic emulsion as described in (18) to (25), wherein the silver halide photographic emulsion comprises a silver halide grain having a spectral absorption maximum wavelength of less than 500 nm and a light absorption intensity of 60 or more or having a spectral absorption maximum wavelength of 500 nm or more and a light absorption intensity of 100 or more.

(27) A silver halide photographic light-sensitive material comprising at least one silver halide photographic emulsion produced by the process described in (18) to (26).

DETAILED DESCRIPTION OF THE INVENTION

The process for producing a silver halide emulsion of the present invention and the silver halide photographic light-sensitive material using an emulsion produced by this process are described in detail below.

In the present invention, the "adsorbed in multiple layers" means that a dye is stacked to form more than one layer on the surface of a silver halide grain.

The production process of the present invention is described below.

The first production process of the present invention is characterized in that in producing a silver halide photographic emulsion comprising as a sensitizing dye at least one connection dye having two or more chromophores connected through a covalent bond, the connection dye is added to a silver halide photographic emulsion and then at least one chromophore out of a plurality of chromophores in the molecule of the connection dye is allowed to change in the adsorption strength to a silver halide grain.

The "adsorption strength of a chromophore to a silver halide grain" as used herein means the size of difference in the free energy (ΔG: adsorption free energy) between the free state of a dye molecule or chromophore and the adsorbed state to a silver halide grain. As the adsorbed state to a silver is more stable as compared with the free state, the adsorption strength is higher. A value obtained by estimating the degree of stableness is a free energy difference (ΔG).

The "change in the adsorption strength to a silver halide emulsion" as used in the present invention means to intentionally change this ΔG value by some external factor after the addition of the dye to an emulsion.

In the first production process of the present invention, it is sufficient if at least one chromophore out of a plurality of chromophores within one molecule of the connection dye undergoes the change of ΔG, though this change results in the change of ΔG of the connected dye molecules as a whole. Of course, a part or all of a plurality of chromophores may undergo the change of ΔG. However, in a plurality of chromophores changed in ΔG, the degree of ΔG change is preferably different and not the same among all individual chromophores. This difference is more preferably larger.

The adsorption strength of a chromophore to a silver halide grain can be determined by measuring an isotherm of adsorption to a silver halide grain using a model dye where the sites corresponding to respective linking groups of a plurality of chromophores within the molecular of a connection dye are replaced by the same substituent. The change in the adsorption strength can also be relatively compared with the degree of change in the same model system.

As for the adsorption strength to a silver halide grain in the case of replacing the connected sites of respective chromophores with a hydrogen atom, ΔG or ΔH can be relatively compared by synthesizing a chromophore molecule where the connected sites are actually replaced with a hydrogen atom and measuring an isotherm of adsorption to silver halide (see, T. H. James, *The Theory of the Photographic Process*, 4th ed., Macmillan, Chap. 9 (1977)).

The means for causing the change in the adsorption free energy ΔG of such a chromophore is described below. This means may be (1) to cause a chemical change in the dye molecule itself, (2) to give a physical or chemical change not in the dye itself but in the peripheral environment thereof, or (3) to cause both of these changes. Any of these means may be used. Usually, it is rather difficult to simply attain only (1). The means (3) is realistic and also in the present invention, the means (3) is preferred.

Examples of the means (2) include the case of changing ΔG by bringing about a change in the periphery of the emulsion, such as temperature change, salt-concentration change, ion intensity change, dielectric constant change and viscosity change. In this case, no chemical change takes place in the dye molecule itself. In the case of the means (2), it is considered difficult to make a large difference in the degree of ΔG change among respective chromophores.

Examples of the means (3) include the followings.

For example, a method of changing the pH to bring about protonation or dissociation of a proton and thereby causing the change in the adsorption free energy ΔG of each chromophore, and a method of inducing a chemical reaction in the dye molecule itself by elevating the temperature, changing the pH or adding a reactive reagent and thereby causing the change in the adsorption free energy ΔG may be used. Among these, preferred is a method of changing the pH to bring about protonation or dissociation of a proton and thereby causing the change in the adsorption free energy ΔG of each chromophore.

The method of changing the pH to bring about protonation or dissociation of a proton and thereby causing the change in the adsorption free energy ΔG of each chromophore is described below.

There is usually great difference in the adsorption strength between a protonated form and a non-protonated form and according to the dye partial structure, two cases are known, that is, (A) a case where the protonated form has stronger adsorption strength than the non-protonated form and (B) a case where the non-protonated form has stronger adsorption strength than the protonated form. These cases both are described below, however, the case (A) is preferred in the present invention.

The chromophore showing the property of (A) may be any substance, however, preferred are those which have, in the proton-dissociated form, a negative charge and are increased in water solubility as compared with the non-dissociated form (proton-added form) and reduced in the adsorption and/or association property to silver halide as compared with the proton-added form are preferred.

Preferred examples of the dye partial structure necessary for bringing out the property of (A) include a proton-dissociative group (or simply a dissociative group) having a pKa of 3 to 10 and giving a dissociated form which is negatively charged. The proton-dissociative group as a preferred example may be any substance insofar as it has a pKa of 3 to 12, however, in order to hold the stability of the dye, the dissociated form must be sufficiently low in the nucleophilicity. Examples thereof include a carboxyl group, a sulfonylcarbamoyl group, a sulfonylsulfamoyl group, a carbonylcarbamoyl group, a carbonylsulfamoyl group and a phenolic hydroxyl group. Among these proton-dissociative groups, preferred are a sulfonylcarbamoyl group, a sulfonylsulfamoyl group, a carbonylcarbamoyl group and a carbonylsulfamoyl group. The dye may have such a group in any portion thereof.

The chromophore showing the property of (B) may be any substance, however, preferred are those which have, in the proton-added form, a positive charge or due to collapse of the planarity of the structure, are reduced in the adsorption and/or association property to silver halide than the proton non-added form.

Preferred examples of the dye partial structure necessary for bringing out the property of (B) include a basic nitrogen-containing heterocyclic ring (e.g., 2-, 3- or 4-pyridino, 2-oxazolyl, 2-thiazolyl, 2-imidazolyl), an amino group (e.g., dimethylamino, diethylamino, guanidino) and a structure of which protonated form to the polymethine main chain itself has a pKa of 2 to 10, more preferably from 2 to 7, still more preferably from 3 to 6. In particular, dyes having, for example, an imidatrimethinecyanine structure are preferred.

The pH of the emulsion may be changed by any method, but in the case of a connection dye containing a chromophore showing the property of (A), the pH is preferably changed from a high pH side to a low pH side.

In the case of a connection dye containing a chromophore showing the property of (B), the pH is preferably changed from a low pH side to a high pH side.

The variation of pH changed is preferably from 0.2 to 5.0 units, more preferably from 0.2 to 4.0 units, still more preferably from 1.0 to 4.0 units, particularly preferably from 1.0 to 3.0 units.

The pH before the addition of the dye may be any value but is preferably from 1 to 12, more preferably from 2 to 10, still more preferably from 4 to 9.

As for the addition timing and addition method of the dye, the dye may be added at any time but this is described in detail later.

The change of pH may be caused by using any means but is preferably caused by further adding an inorganic or organic acid or an inorganic or organic base to the emulsion after the addition of the dye.

The inorganic or organic acid which can be used for causing the change of pH may be a Brφnsted acid or a Lewis acid but is preferably a Brφnsted acid. The acid may have any pKa value but preferably has a pKa value smaller than the pH before the addition of the dye.

Preferred examples of the acid which can be used in the present invention include inorganic acids such as hydrochloric acid, hydrobromic acid, hydrofluoric acid, hydroiodic acid, sulfuric acid, phosphoric acid, phosphorous acid, nitric acid, boric acid, boron trifluoride and zinc chloride, low molecular aliphatic or aromatic carboxylic acids having from 1 to 50 carbon atoms (e.g., acetic acid, propionic acid, butyric acid, valeric acid, glycolic acid, oxalic acid, citric acid, glutamic acid, ascorbic acid, benzoic acid, phthalic acid, trimellitic acid) or carboxylic acids attached to a polymer chain (e.g., polyacrylic acid), low molecular aliphatic or aromatic sulfonic acids having from 1 to 50 carbon atoms (e.g., methanesulfonic acid, 2-hydroxyethanesulfonic acid, taurine, p-toluenesulfonic acid, sulfanilic acid) or sulfonic acids attached to a polymer chain (e.g., polyvinylsulfonic acid), low molecular aliphatic or aromatic sulfinic acids having from 1 to 50 carbon atoms or sulfinic acids attached to a polymer chain, and low molecular aliphatic or aromatic phosphonic acids having from 1 to 50 carbon atoms or phosphonic acids attached to a polymer chain.

Among these acids, more preferred are inorganic acids such as hydrochloric acid, hydrobromic acid, hydrofluoric acid, hydroiodic acid, sulfuric acid, phosphorus acid, nitric acid, boric acid and zinc chloride, low molecular aliphatic or aromatic carboxylic acids having from 1 to 50 carbon atoms (e.g., acetic acid, propionic acid, butyric acid, valeric acid, glycolic acid, oxalic acid, citric acid, glutamic acid, ascorbic acid, phthalic acid, trimellitic acid) or carboxylic acids attached to a polymer chain (e.g., polyacrylic acid), and low molecular aliphatic or aromatic sulfonic acids having from 1 to 50 carbon atoms (e.g., methanesulfonic acid, 2-hydroxyethanesulfonic acid, taurine, p-toluenesulfonic acid, sulfanilic acid) or sulfonic acids attached to a polymer chain (e.g., polyvinylsulfonic acid), still more preferred are a hydrochloric aid, a hydrobromic acid, a hydroiodic acid, a sulfuric acid and a phosphoric acid.

The inorganic or organic base which can be used for causing the change of pH may be a Brφnsted base or a Lewis base but is preferably a Brφnsted base. The conjugate acid may have any pKa value but preferably has a pKa value larger than the pH before the addition of the dye.

Preferred examples of the base which can be used in the present invention include inorganic bases such as sodium hydroxide, potassium hydroxide, zinc hydroxide, aluminum hydroxide, lithium hydroxide, magnesium hydroxide, calcium hydroxide, sodium carbonate, potassium carbonate and aqueous ammonia, aliphatic or aromatic metal alkoxides having from 1 to 50 carbon atoms (e.g., sodium methoxide, potassium methoxide, sodium ethoxide, sodium isopropoxide, sodium tert-butoxide), low molecular aliphatic or aromatic amines having from 1 to 50 carbon atoms (e.g., methylamine, triethylamine, ethanolamine, aniline) or polyamines attached to a polymer chain (e.g., polyvinylamine), and low molecular aliphatic or aromatic nitrogen-containing heterocyclic rings having from 1 to 50 carbon atoms (e.g., pyridine, piperidine, morpholine, imidazole).

Among these bases, more preferred are inorganic bases such as sodium hydroxide, potassium hydroxide, zinc hydroxide, aluminum hydroxide, lithium hydroxide, magnesium hydroxide, calcium hydroxide, sodium carbonate and potassium carbonate, aliphatic or aromatic metal alkoxides having from 1 to 10 carbon atoms (e.g., sodium methoxide, potassium methoxide, sodium ethoxide, sodium isopropoxide, sodium tert-butoxide), and low molecular aliphatic or aromatic amines having from 1 to 50 carbon atoms (e.g., methylamine, triethylamine, ethanolamine, aniline).

Still more preferred are sodium hydroxide, potassium hydroxide, zinc hydroxide, lithium hydroxide, magnesium hydroxide, calcium hydroxide, sodium carbonate and potassium carbonate.

Also, a salt of weak base and strong acid or a salt of weak acid and strong base may be added to cause the change of pH. Preferred examples of the salt for use in this case include ammonium chloride, ammonium sulfate, sodium acetate, ammonium acetate and potassium acetate, which also apply as examples of the above-described acid or base.

The acid or base may be added slowly by the dropwise addition or may be added all at once but since the reaction is accompanied by the generation of heat, the acid or base is preferably added slowly while confirming the temperature.

After the completion of the step for causing the change of pH following the addition of the dye, the pH may be any value but is preferably from 3 to 10, more preferably from 4 to 8, still more preferably from 5 to 7, particularly preferably from 5 to 6.

The sensitizing dye which can be used for the production process of the present invention is described in detail below. The sensitizing dye which can be used in the production process of the present invention may be any sensitizing dye if it is a compound confirmed to have spectral sensitization activity when used in a silver halide photographic light-sensitive material, but preferred examples thereof include cyanine dyes, merocyanine dyes, rhodacyanine dyes, trinuclear merocyanine dyes, tetranuclear merocyanine dyes, allopolar dyes, hemicyanine dyes and styryl dyes. Among these, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds*, John Wiley & Sons, New York, London (1964), and D. M. Sturmer, *Heterocyclic Compounds— Special topics in heterocyclic chemistry*, Chap. 18, Section 14, pp. 482–515, John Wiley & Sons, New York, London (1977).

Preferred examples of the dye include the sensitizing dyes represented by the formulae or described as specific examples in U.S. Pat. No. 5,994,051, pp. 32–44, and U.S. Pat. No. 5,747,236, pp. 30–39.

Also, preferred examples of the cyanine dye, the merocyanine dye and the rhodacyanine dye include those represented by formulae (XI), (XII) and (XIII) of U.S. Pat. No. 5,340,694, columns 21 to 22 (on the condition that the numbers in n12, n15, n17 and n18 are not limited and each is an integer of 0 or more (preferably 4 or less)).

Among the dyes which can be used in the production process and silver halide photographic light-sensitive material of the present invention, preferred are dyes having a structure capable of causing the change in ΔG of a chromophore by the method (3) described above. It is particularly preferred to contain a chromophore having the above-described property (A) or (B) within the molecule.

In the present invention, a compound having two or more dye chromophores (hereinafter called a connection dye) is used.

The compound containing two or more dye chromophores for use in the present invention is described below. This compound can be preferably used as a sensitizing dye. Preferred examples of these dye chromophores include those described later for $D_1$ and $D_2$. These dye chromophores may be the same or different but are preferably different. The number of dye chromophores contained in the compound may be any number insofar as it is 2 or more but is preferably from 2 to 10,000, more preferably from 2 to 1,000, still more preferably from 2 to 100, yet more preferably from 2 to 10, yet still more preferably from 2 to 5, particularly preferably 2 or 3, and most preferably 2.

In the compound, the covalent bond may be previously formed or may be formed in the process of producing a silver halide light-sensitive material (for example, during the preparation of a silver halide emulsion). In the latter case, the method described, for example, in JP-A-2000-81678 can be used. Preferred is the case where the covalent bond is previously formed.

The particularly preferred dye is a compound having a structure represented by formula (1).

The compound represented by formula (1) of the present invention is described in detail below.

When the compound of the present invention has an alkyl group, an alkylene group, an alkenyl group or an alkenylene group, unless otherwise indicated, these groups each may be linear or branched or may be substituted or unsubstituted.

When the compound of the present invention has a cycloalkyl group, an aryl group, a heterocyclic group, a cycloalkenylene group, an arylene group or a heterylene group, unless otherwise indicated, these groups each may be a monocyclic ring or a condensed ring or may be substituted or unsubstituted.

In the present invention, when a specific site is called "a group", the site itself may not be substituted or may be substituted by one or more (to a possible maximum number) substituents.

For example, "an alkyl group" means a substituted or unsubstituted alkyl group. Furthermore, the substituents which can be used in the compound for use in the present invention include, irrespective of the presence or absence of substitution, any substituent. For example, the following substituents W may be used.

The substituent represented by W may be any substituent and is not particularly limited, however, examples thereof include a halogen atom, an alkyl group [including cycloalkyl group, bicycloalkyl group and tricycloalkyl group, and also including an alkenyl group (including cycloalkenyl group and bicycloalkenyl group) and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phospho group, a silyl group, a hydrazino group, a ureido group and other known substituents.

More specifically, W represents a halogen atom (e.g., fluorine, chlorine, bromine, iodine), an alkyl group [which means a linear, branched or cyclic substituted or unsubstituted alkyl group and which includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resultant from removing one hydrogen atom of a bicycloalkane having from 5 to 30 carbon atoms, e.g., bicyclo[1,2,2]heptan-2-yl, bicyclo[2,2,2]octan-3-yl), and a tricyclo-structure having many cyclic structures; the alkyl group in the substituents described below (for example, an alkyl group in an alkylthio group) means an alkyl group having such a concept and further includes an alkenyl group and an alkynyl group], an alkenyl group [which means a linear, branched or cyclic substituted or unsubstituted alkenyl group and which includes an alkenyl group (preferably a substituted or unsubstituted alkenyl group having from 2 to 30 carbon atoms, e.g., vinyl, allyl, prenyl, geranyl, oreyl), a cycloalkenyl group (preferably a substituted or unsubstituted cycloalkenyl group having from 3 to 30 carbon atoms, namely, a monovalent group resultant from removing one hydrogen atom of a cycloalkane having from 3 to 30 carbon atoms, e.g., 2-cyclopenten-1-yl, 2-cyclohexen-1-yl), and a bicycloalkenyl group (a substituted or unsubstituted bicycloalkenyl group, preferably a substituted or unsubstituted bicycloalkenyl group having from 5 to 30 carbon atoms, namely, a monovalent group resultant from removing one hydrogen atom of a bicycloalkane having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resultant from removing one hydrogen atom of a 5- or 6-membered substituted or unsubstituted aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms or a substituted or unsubstituted anilino group having from 6 to 30 carbon atoms, e.g., amino, methylamino, dimethylamino, anilino, N-methyl-anilino, diphenylamino), an ammonio group (preferably an ammonio group or an ammonio group substituted by a substituted or unsubstituted alkyl, aryl or heterocyclic group having from 1 to 30 carbon atoms, e.g., trimethylammonio, triethylammonio, diphenylmethylammonio), an acylamino group (preferably a formylamino group, a substituted or unsubstituted alkylcarbonylamino group having from 1 to 30 carbon atoms or a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methylmethoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or aryl-sulfonylamino group (preferably a substituted or unsubstituted alkylsulfonylamino group having from 1 to 30 carbon atoms or a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or aryl-sulfinyl group (preferably a substituted or unsubstituted alkylsulfinyl group having from 1 to 30 carbon atoms or a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or aryl-sulfonyl group (preferably a substituted or unsubstituted alkylsulfonyl group having from 1 to 30 carbon atoms or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms or a substituted or unsubstituted heterocyclic carbonyl group having from 4 to 30 carbon atoms and being bonded to a carbonyl group through a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)-carbamoyl), an aryl- or heterocyclic-azo group (preferably a substituted or unsubstituted arylazo group having from 6 to 30 carbon atoms or a substituted or unsubstituted heterocyclic-azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino) or a ureido group (preferably a substituted or unsubstituted ureido group having from 0 to 30 carbon atoms, e.g., N,N-dimethylureido).

The substituent represented by W may also have a structure condensed with a ring (an aromatic or non-aromatic hydrocarbon ring, a heterocyclic ring or a polycyclic condensed ring formed by the combination of these rings, e.g., benzene ring, naphthalene ring, anthracene ring, quinoline ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolizine ring, quinoline ring, phthalazine ring, naphthyridine ring, quinoxaline ring, quinoxazoline ring, quinoline ring, carbazole ring, phenanthridine ring, acridine ring, phenanthroline ring, thianthrene ring, chromene ring, xanthene ring, phenoxathiine ring, phenothiazine ring, phenazine ring).

Among these substituents W, those having a hydrogen atom may be deprived of the hydrogen atom and substituted by the above-described substituent. Examples of this functional group include an alkylcarbonylaminosulfonyl group, an arylcarbonylaminosulfonyl group, an alkylsulfonylaminocarbonyl group and an arylsulfonylaminocarbonyl group. Specific examples thereof include methylsulfonylaminocarbonyl, p-methylphenylsulfonylaminocarbonyl, acetylaminosulfonyl and benzoylaminosulfonyl.

$D_1$ and $D_2$ in formula (1) of the present invention may be the same but are preferably different. $D_1$ and $D_2$ are preferably different because these adsorb in multiple layers as described below.

$D_1$ and $D_2$, which may be the same or different, each represents a chromophore (having the same meaning as a dye chromophore).

The chromophore represented by $D_1$ and $D_2$ may be any chromophore and examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squalium dyes, croconium dyes, azomethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophyll dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, and polymethine chromophores such as azamethine dye and oxonol dye.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515, John Wiley & Sons, New York, London (1977). Examples of the formulae of preferred dyes include formulae described at pages 32 to 36 of U.S. Pat. No. 5,994,051 and formulae described at pages 30 to 34 of U.S. Pat. No. 5,747,236. For cyanine dyes, merocyanine dyes and rhodacyanine dyes, formulae (XI), (XII) and (XIII) described in columns 21 to 22 of U.S. Pat. No. 5,340,694 are preferred (on the condition that the numbers in n12, n15, n17 and n18 are not limited and each is an integer of 0 or more (preferably 4 or less)).

As such, $D_1$ is preferably a sensitizing dye moiety having adsorptivity to a silver halide grain and may be adsorbed by either physical adsorption or chemical adsorption.

$D_2$ is preferably weak in the adsorptivity to a silver halide grain and also preferably a light-emitting dye. As for the kind of the light-emitting dye, those having a skeleton structure of dyes used for dye laser are preferred. These dyes are described, for example, in Mitsuo Maeda, *Laser Kenkyu* (*Study of Laser*), Vol. 8, page 694, page 803 and page 958 (1980), ibid., Vol. 9, page 85 (1981), and F. Shaefer, *Dye Lasers*, Springer (1973).

$D_2$ is more preferably a chromophore showing the above-described property (A) or (B).

The absorption maximum wavelength of $D_1$ in a silver halide photographic light-sensitive material is preferably longer than the absorption maximum wavelength of $D_2$. Also the light emission of $D_2$ preferably overlaps the absorption of $D_1$. $D_1$ preferably forms a J-aggregate. Furthermore, $D_2$ also preferably forms a J-aggregate so that the connection dye represented by formula (1) can have absorption and spectral sensitivity in a desired wavelength range.

$D_1$ and $D_2$ may have any reduction potential and any oxidation potential but the reduction potential of $D_1$ is preferably more positive than the value obtained by subtracting 0.2 V from the reduction potential of $D_2$.

$q_1$, $r_1$ and $r_2$ each represents an integer of 1 to 100, preferably from 1 to 5, more preferably 1 or 2, still more preferably 1. When $q_1$, $r_1$ and $r_2$ each is 2 or more, a plurality of linking groups or chromophores represented by La, $D_2$ or $D_1$ may be different from each other. La may be bonded to any site of $D_1$ and $D_2$ but is preferably bonded to a site which is not the methine chain part.

qa represents an integer of 1 to 4. When qa is 2 or more, this means that $D_1$ and $D_2$, or $D_2$ and $D_2$ are connected through a plurality of linking groups. In other words, $D_1$ and $D_2$, or $D_2$ and $D_2$ may be connected at one portion or at a plurality of portions (from 2 to 4 portions, preferably 2 portions). When qa is 2 or more, a plurality of linking groups represented by La may be the same or different and are preferably the same.

qa is preferably 1 or 2, more preferably 1.

Incidentally, Formula (1) shows that dye chromophores can be connected with each other in any connection form.

The cyanine chromophore is preferably a chromophore represented by the following formula (2):

(2)

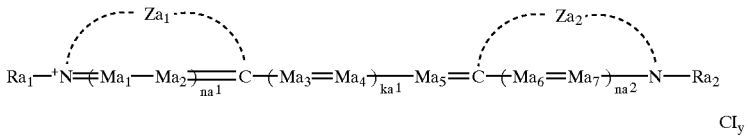

wherein $Za_1$ and $Za_2$ each represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring, $Ra_1$ and $Ra_2$ each represents a hydrogen atom, an alkyl group, an alkenyl group, an aryl group or a heterocyclic group, preferably a hydrogen atom, an alkyl group or a sulfoalkyl group, more preferably an alkyl group or a sulfoalkyl group, $Ma_1$ to $Ma_7$ each represents a methine group, $na^1$ and $na^2$ each is 0 or 1, preferably 0, $ka^1$ represents an integer of 0 to 3, preferably from 0 to 2, more preferably 0 or 1 and when $ka^1$ is 2 or more, the methine groups $Ma_3$ may be the same or different and the methine groups $Ma_4$ may also be the same or different, CI represents an ion for neutralizing the electric charge, and y represents a number necessary for neutralizing the electric charge. This cyanine chromophore may be connected to the linking group La at any position.

The merocyanine chromophore is preferably a chromophore represented by the following formula (3):

(3)

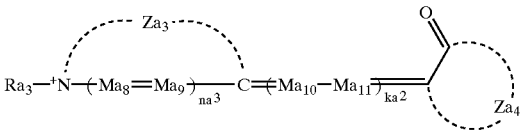

wherein $Za_3$ represents an atomic group for forming a 5- or 6-membered nitrogen-containing heterocyclic ring and this ring may further be condensed with a benzene ring, a benzofuran ring, a pyridine ring, a pyrrole ring, an indole ring or a thiophene ring, $Za_4$ represents an atomic group for forming an acidic nucleus, $Ra_3$ represents a hydrogen atom, an alkyl group, an alkenyl group, an aryl group or a heterocyclic group, $Ma_8$ to $Ma_{11}$ each represents a methine group, $na^3$ is 0 or 1, $ka^2$ represents an integer of 0 to 3, preferably from 0 to 2, more preferably 1 or 2, and when $ka^2$ is 2 or more, the methine groups $Ma_{10}$ may be the same or different and the methine groups $Ma_{11}$ may also be the same or different, CI represents an ion for neutralizing the electric charge, and y represents a number necessary for neutralizing the electric charge. This merocyanine chromophore may be connected to the linking group La at any position.

The oxonol chromophore is preferably a chromophore represented by the following formula (4):

(4)

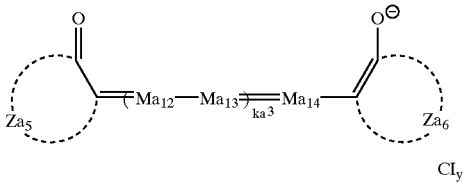

wherein $Za_5$ and $Za_6$ each represents an atomic group for forming an acidic nucleus, $Ma_{12}$ to $Ma_{14}$ each represents a methine group, $ka^3$ represents an integer of 0 to 3, preferably from 0 to 2 and when $ka^3$ is 2 or more, the methine groups $Ma_{12}$ may be the same or different and the methine groups $Ma_{13}$ may also be the same or different, CI represents an ion for neutralizing the electric charge, and y represents a number necessary for neutralizing the electric charge. This oxonol chromophore may be connected to the linking group La at any position.

Examples of $Za_1$, $Za_2$ and $Za_3$ include oxazole nuclei having from 3 to 25 carbon atoms (e.g., 2-3-methyloxazolyl, 2-3-ethyloxazolyl, 2-3,4-diethyloxazolyl, 2-3-methylbenzoxazolyl, 2-3-ethylbenzoxazolyl, 2-3-sulfoethylbenzoxazolyl, 2-3-sulfopropylbenzoxazolyl, 2-3-methylthioethylbenzoxazolyl, 2-3-methoxyethylbenzoxazolyl, 2-3-sulfobutylbenzoxazolyl, 2-3-methyl-β-naphthoxazolyl, 2-3-methyl-α-naphthoxazolyl, 2-3-sulfopropyl-β-naphthoxazolyl, 2-3-sulfopropyl-γ-naphthoxazolyl, 2-3-(3-naphthoxyethyl) benzoxazolyl, 2-3,5-dimethylbenzoxazolyl, 2-6-chloro-3-methylbenzoxazolyl, 2-5-bromo-3-methylbenzoxazolyl, 2-3-ethyl-5-methoxybenzoxazolyl, 2-5-phenyl-3-sulfopropylbenzoxazolyl, 2-5-(4-bromophenyl)-3-sulfobutylbenzoxazolyl, 2-3-dimethyl-5,6-dimethylthiobenzoxazolyl), thiazole nuclei having from 3 to 25 carbon atoms (e.g., 2-3-methylthiazolyl, 2-3-ethylthiazolyl, 2-3-sulfopropylthiazolyl, 2-3-sulfobutylthiazolyl, 2-3,4-dimethylthiazolyl, 2-3,4,4-trimethylthiazolyl, 2-3-carboxyethylthiazolyl, 2-3-methylbenzothiazolyl, 2-3-ethylbenzothiazolyl, 2-3-butylbenzothiazolyl, 2-3-sulfopropylbenzothiazolyl, 2-3-sulfobutylbenzothiazolyl, 2-3-methyl-β-naphthothiazolyl, 2-3-sulfopropyl-γ-naphthothiazolyl, 2-3-(1-naphthoxyethyl) benzothiazolyl, 2-3,5-dimethylbenzothiazolyl, 2-6-chloro-3-methylbenzothiazolyl, 2-6-iodo-3-methylbenzothiazolyl, 2-5-bromo-3-methylbenzothiazolyl, 2-3-ethyl-5-methoxybenzothiazolyl, 2-5-phenyl-3-sulfopropylbenzothiazolyl, 2-5-(4-bromophenyl)-3-sulfobutylbenzothiazolyl, 2-3-dimethyl-5,6-dimethylthiobenzothiazolyl), imidazole nuclei having from 3 to 25 carbon atoms (e.g., 2-1,3-diethylimidazolyl, 2-1,3-dimethylimidazolyl, 2-1-methylbenzimidazolyl, 2-1,3,4-triethylimidazolyl, 2-1,3-diethylbenzimidazolyl, 2-1,3,5-trimethylbenzimidazolyl, 2-6-chloro-1,3-dimethylbenzimidazolyl, 2-5,6-dichloro-1,3-diethylbenzimidazolyl, 2-1,3-disulfopropyl-5-cyano-6-chlorobenzimidazolyl), indolenine nuclei having from 10 to 30 carbon atoms (e.g., 3,3-dimethylindolenine), quinoline nuclei having from 9 to 25 carbon atoms (e.g., 2-1-methylquinolyl, 2-1-ethylquinolyl, 2-1-methyl-6-chloroquinolyl, 2-1,3-diethylquinolyl, 2-1-methyl-6-methylthioquinolyl, 2-1-sulfopropylquinolyl, 4-1-methylquinolyl, 4-1-sulfoethylquinolyl, 4-1-methyl-7-chloroquinolyl, 4-1,8-diethylquinolyl, 4-1-methyl-6-methylthioquinolyl, 4-1-sulfopropylquinolyl), selenazole nuclei having from 3 to 25 carbon atoms (e.g., 2-3-methylbenzoselenazolyl), pyridine nuclei having from 5 to 25 carbon atoms (e.g., 2-pyridyl), thiazoline nuclei, oxazoline nuclei, selenazoline nuclei, tetrazoline nuclei, tetrazole nuclei, benzotellurazole nuclei, imidazoline nuclei, imidazo [4,5-quinoxaline] nuclei, oxadiazole nuclei, thiadiazole nuclei, tetrazole nuclei and pyrimidine nuclei.

These nuclei each may be substituted and examples of the substituent include the above-described substituents W. Among those substituents, preferred are an alkyl group (e.g., methyl, ethyl, propyl), a halogen atom (e.g., chlorine, bromine, iodine, fluorine), a nitro group, an alkoxy group (e.g., methoxy, ethoxy), an aryl group (e.g., phenyl), a heterocyclic group (e.g., 2-pyridyl, 3-pyridyl, 1-pyrrolyl, 2-thienyl), an aryloxy group (e.g., phenoxy), an acylamino group (e.g., acetylamino, benzoylamino), a carbamoyl group (e.g., N,N-dimethylcarbamoyl), a sulfo group, a sulfonamido group (e.g., methanesulfonamido), a sulfamoyl group (e.g., N-methylsulfamoyl), a hydroxy group, a carboxy group, an alkylthio group (e.g., methyl thio) and a cyano group.

$Za_1$, $Za_2$ and $Za_3$ each is preferably an oxazole nucleus, an imidazole nucleus or a thiazole nucleus. These heterocyclic rings each may further be condensed with a ring such as benzene ring, benzofuran ring, pyridine ring, pyrrole ring, indole ring or thiophene ring.

$Za_4$, $Za_5$ and $Za_6$ each represents an atomic group necessary for forming an acidic nucleus and the acidic nucleus is defined in James (compiler), *The Theory of the Photographic Process*, 4th ed., Macmillan, page 198 (1977). Specific examples thereof include nuclei such as 2-pyrazolon-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isorhodanine, rhodanine, indane-1,3-dione, thiophen-3-one, thiophen-3-one-1,1-dioxide, indolin-2-one, indolin-3-one, 2-oxoindazolium, 5,7-dioxo-6,7-dihydrothiazolo[3,2-a] pyrimidine, 3,4-dihydroisoquinolin-4-one, 1,3-dioxane-4,6-dione, barbituric acid, 2-thiobarbituric acid, coumarin-2,4-dione, indazolin-2-one, pyrido[1,2-a]pyrimidine-1,3-dione, pyrazolo[1,5-b]quinazolone and pyrazolopyridone.

Among these, preferred are hydantoin, rhodanine, barbituric acid and 2-oxazolin-5-one. $Za_4$ is preferably a barbituric acid.

Specific examples of the cyanine chromophore, merocyanine chromophore and oxonol chromophore include those described in F. M. Harmer, *Heterocyclic Compounds—Cyanine Dyes and Related Compounds*, John Wiley & Sons, New York, London (1964).

The formulae of cyanine dyes and merocyanine dyes are preferably formulae (XI) and (XII) of U.S. Pat. No. 5,340,694, pages 21 and 22.

$Ra_1$, $Ra_2$ and $Ra_3$ each independently represents a hydrogen atom, an alkyl group [an unsubstituted alkyl group preferably having from 1 to 18, more preferably from 1 to 7, still more preferably from 1 to 4, carbon atoms (hereinafter referred to as "a C number") (e.g., methyl, ethyl, propyl, isopropyl, butyl, isobutyl, hexyl, octyl, 2-ethylhexyl, dodecyl, octadecyl) or a substituted alkyl group having a C number of 1 to 18, preferably from 1 to 7, more preferably from 1 to 4 {for example, an alkyl group substituted by W described above as a substituent; preferably an aralkyl group (e.g., benzyl, 2-phenylethyl), a hydroxyalkyl group (e.g., 2-hydroxyethyl, 3-hydroxypropyl, 6-hydroxyhexyl), a carboxyalkyl group (e.g., 2-carboxyethyl, 3-carboxypropyl, 4-carboxybutyl, carboxymethyl, 5-carboxypentyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfobenzyl, 3-sulfo-3-phenylpropyl, 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (e.g., 2-sulfatoethyl, 3-sulfatopropyl, 4-sulfatobutyl), a heterocyclic ring-substituted alkyl group (e.g., 2-(pyrrolidin-2-on-1-yl)ethyl, tetrahydrofurfuryl), an alkylsulfonylcarbamoylalkyl group (e.g., methansulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl) or a halogen-substituted alkyl group (e.g., 2-chloroethyl, 2,2,2-trifluoroethyl)}], an alkenyl group (preferably an alkenyl group having a C number of 2 to 20 (e.g., vinyl, allyl, 3-butenyl, oleyl) or an alkenyl group substituted by W, such as sulfoalkenyl group (e.g., 3-sulfo-2-propenyl)), an aryl group (an unsubstituted or substituted aryl group having a C number of 6 to 20, preferably from 6 to 10, more preferably from 6 to 8 (examples of the substituent include the above-described W) (e.g., phenyl, 1-naphthyl, 2-naphthyl, p-methoxyphenyl, p-methylphenyl, p-chlorophenyl)), a heterocyclic group (an unsubstituted heterocyclic group having a C number of 1 to 20, preferably from 3 to 10, more preferably from 4 to 8 (examples of the substituent include the above-described W) (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyridyl)).

$Ra_1$, $Ra_2$ and $Ra_3$ each is preferably a hydrogen atom, an alkyl group, a sulfoalkyl group or an aryl group, more preferably an alkyl group or a sulfoalkyl group.

$Ma_1$ to $Ma_{14}$ each independently represents a methine group and may have a substituent. The substituent may be any of the above-described substituents W but among these, preferred are an alkyl group having a C number of 1 to 20 (e.g., methyl, ethyl, i-propyl), a halogen atom (e.g., chlorine, bromine, iodine, fluorine), a nitro group, an alkoxy group having a C number of 1 to 20 (e.g., methoxy, ethoxy), an aryl group having a C number of 6 to 26 (e.g., phenyl, 2-naphthyl), a heterocyclic group having a C number of 0 to 20 (e.g., 2-pyridyl, 3-pyridyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a hydroxy group, a carboxy group, an alkylthio group having a C number of 1 to 20 (e.g., methylthio) and a cyano group. The methine group may form a ring together with another methine group or with an auxochrome. $Ma_1$ to $Ma_{14}$ each is preferably an unsubstituted methine group, an ethyl group-substituted methine group or a methyl group-substituted methine group.

La represents a linking group (including a single bond) and may be any linking group but is preferably a linking group having from 0 to 100, preferably from 1 to 20, carbon atoms, constituted by one or a combination of two or more of a single bond, an alkylene group (preferably having from 1 to 20 carbon atoms (hereinafter referred to as "a C number"), e.g., methylene, ethylene, propylene, butylene, pentylene, hexylene, octylene), an arylene group (preferably having a C number of 6 to 26, e.g., phenylene, naphthylene), an alkenylene group (preferably having a C number of 2 to 20, e.g., ethenylene, propenylene), an alkynylene group (preferably having a C number of 2 to 20, e.g., ethynylene, propynylene), an amido group, an ester group, a sulfoamido group, a sulfonic acid ester group, a ureido group, a sulfonyl group, a sulfinyl group, a thioether group, an ether group, a carbonyl group, —$NR_{51}$— (wherein $R_{51}$ is a hydrogen atom or a monovalent group and preferred examples of the substituent include W) and a heterylene group (preferably having a C number of 1 to 26, e.g., 6-chloro-1,3,5-triazyl-2,4-diyl, pyrimidine-2,4-diyl, quinoxalin-2,3-diyl).

La is preferably represented by $-G_1-(A_1-G_2-)_{t1}-$.

$A_1$ represents, irrespective of the direction, —O—, —S—, —$SO_2$—, —$NR_3$—, —COO—, —$CONR_4$— or —$SO_2NR_5$—, wherein $R_3$ to $R_5$ each independently represents a hydrogen atom, an alkyl group, an alkenyl group, an aryl group or a heterocyclic group (preferred examples of respective groups are the same as those described for $Ra_1$ to $Ra_3$).

$R_3$ is preferably a hydrogen atom or an alkyl group, more preferably an alkyl group, and $R_4$ and $R_5$ each is preferably a hydrogen atom or an alkyl group, more preferably a hydrogen atom.

$A_1$ preferably represents —O—, —$SO_2$—, —COO— or —$CONR_4$—, more preferably —O— or —$CONR_4$—.

$G_1$ and $G_2$ each independently represents an alkylene group (preferably having from 1 to 20 carbon atoms (hereinafter referred to as "a C number", e.g., methylene, ethylene, propylene, butylene, hexylene, octylene, 2-methylbutylene, 3-phenylpentylene), an alkenylene group (preferably having a C number of 2 to 20, e.g., ethenylene, propenylene, 2-butenylene) or an arylene group (preferably having a C number of 6 to 26, e.g., 1,4-phenylene, 1,4-naphthylene), and these groups each may be substituted by the above-described substituent W. $G_1$ and $G_2$ each preferably represents an alkylene group, more preferably a linear unsubstituted alkylene group having a C number of 1 to 8.

t1 represents an integer of 1 to 10, preferably 1 or 2, more preferably 1. When t1 is 2 or more, a plurality of $A_1$'s may be the same or different and a plurality of $G_2$'s may also be the same or different.

When t1 is 1, $A_1$ is preferably —COO—, —$CONR_4$— or —$SO_2NR_5$—, more preferably —COO— or —$CONR_4$—, still more preferably —$CONR_4$—.

When t1 is 2 or more, at least one $A_1$ is preferably —COO—, —$CONR_4$— or —$SO_2NR_5$—, more preferably —COO— or —$CONR_4$—, still more preferably —$CONR_4$—.

The remaining $A_1$ is preferably —COO—, —$CONR_4$—, —$SO_2NR_5$—, —O— or —$SO_2$—, more preferably —O— or —$CONR_4$—.

CI represents an ion for neutralizing the electric charge. Whether a certain compound is a cation or an anion or has a net ion charge depends on the substituent thereof. The cation is typically an ammonium ion or an alkali metal ion. On the other than, the anion may be either an inorganic ion or an organic ion.

Examples of the cation include sodium ion, potassium ion, triethylammonium ion, diethyl(i-propyl)ammonium ion, pyridinium ion and 1-ethylpyridinium ion. Examples of the anion include halide anion (e.g., chloride ion, bromide ion, fluoride ion, iodide ion), substituted arylsulfonate ion (e.g., paratoluenesulfonate ion), alkylsulfate ion (e.g., methylsulfate ion), sulfate ion, perchlorate ion, tetrafluoroborate ion and acetate ion.

y represents a number necessary for neutralizing the electric charge.

In the dye represented by formula (1), some of $D_1$ and $D_2$ preferably have a partial structure necessary for bringing out the above-described property (A) or (B), more preferably the property (A).

Preferred examples of the dye which is used as a sensitizing dye in the present invention are set forth below, however, the present invention is not limited thereto. The following structural formulae of the dye which is used as a sensitizing dye of the present invention are only one limiting structure out of many possible resonance structures and the dyes each may have other structure which can be formed by resonance.

No. 1

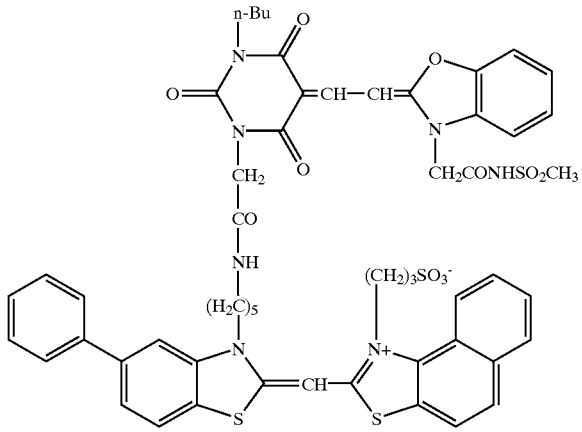

No.2

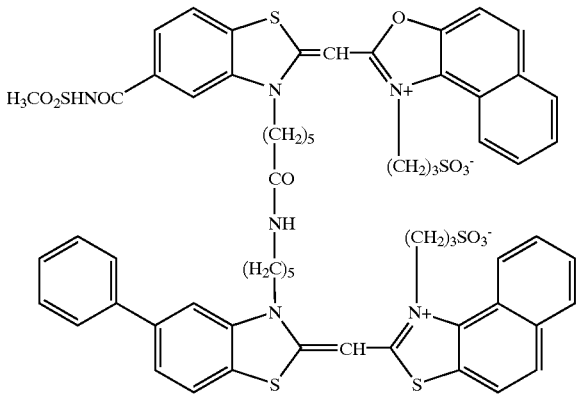

No.3

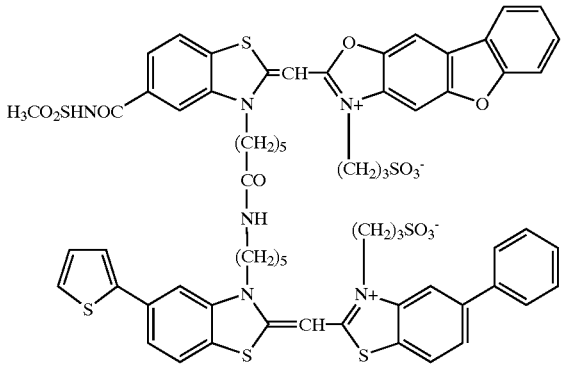

-continued

No.4

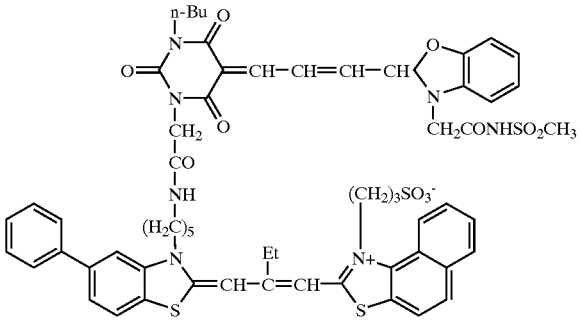

No.5

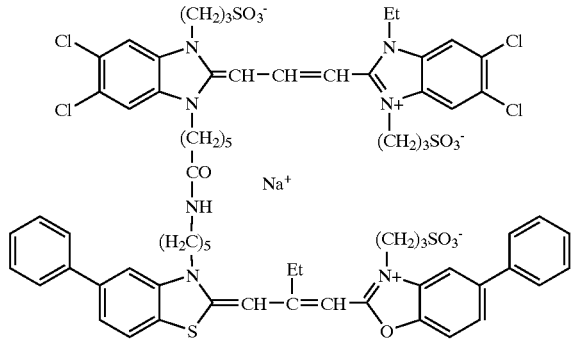

No.6

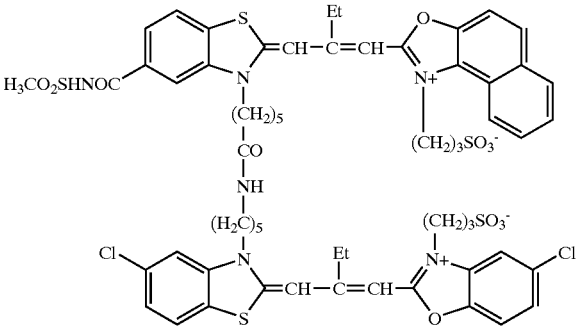

No.7

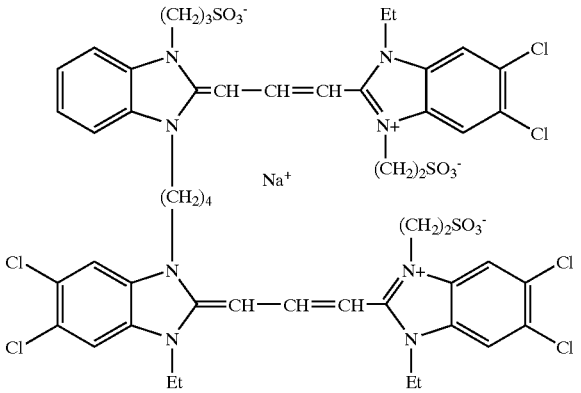

The compounds of the present invention can be synthesized according to the methods described, for example, in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515, John Wiley & Sons, New York, London (1977), and EP-A-887700.

Out of $D_1$ and $D_2$ in the compound represented by formula (1), the degree of change in the adsorption strength after the addition to an emulsion is preferably smaller in $D_2$ than in $D_1$. More preferably, on comparison of the adsorption strength between $D_2$ and $D_1$ in the state of weak adsorption strength, the adsorption strength of $D_1$ is stronger than that of $D_2$. Whichever $D_1$ or $D_2$ may be stronger in the adsorption strength to a silver halide grain after the change but preferably $D_1>D_2$. In this respect, it may be preferred in some cases that $D_2$ contains at least one or more of —$SO_3M$, —$OSO_3M$, —$OPO_3M_2$, —$PO_3M_2$ and —COOM, more preferably at least one or more —$SO_3M$, however, the present invention is not limited thereto. M represents a proton or a cation.

In the state of weak adsorption strength, the rank of the adsorption strength to a silver halide grain is most preferably $D_1>La>D_2$.

The adsorption strength of $D_1$ or $D_2$ to silver halide can be presumed from the amount of the compound corresponding to $D_1$ or $D_2$ adsorbed to a silver halide grain. Examples of the compound corresponding to $D_1$ or $D_2$ include a compound resulting from changing the linking group La in the compound represented by formula (1) to an alkylsulfonic acid group. The amount adsorbed of the compound corresponding to $D_2$ is preferably less than 30%, more preferably less than 10%, still more preferably less than 5%, of the amount adsorbed of the compound corresponding to $D_1$.

When $D_2$ in the compound represented by formula (1) is photo-excited, $D_2$ preferably undertakes electron transfer or energy transfer to $D_1$.

Furthermore, in a silver halide photographic emulsion or a silver halide photographic material, it is preferred that the compound represented by formula (1) is adsorbed to a silver halide grain through $D_1$ and the $D_2$ not adsorbed to the silver halide grain undertakes, when photo-exited, electron transfer or energy transfer to $D_1$.

Also, in a silver halide photographic emulsion or a silver halide photographic material, the compound represented by formula (1) preferably adsorbs to a silver halide grain through $D_1$ and forms a J-aggregate.

The second production process of the present invention is characterized in that in producing a silver halide photographic emulsion comprising a silver halide grain having adsorbed thereon a sensitizing dye in multiple layers, one or a plurality of sensitizing dye(s) is added to a silver halide photographic emulsion and then at least one sensitizing dye out of sensitizing dyes added is allowed to change in the adsorption strength to a silver halide grain.

In the second production process of the present invention, it is sufficient if at least one chromophore out of a plurality of sensitizing dyes added undergoes the change of ΔG. Of course, a part or all of a plurality of sensitizing dyes may undergo the change of ΔG. However, in a plurality of chromophores changed in ΔG, the degree of ΔG change is preferably different and not the same among all individual chromophores. This difference is more preferably larger.

The adsorption energy (ΔG) of a dye may be determined by any method.

Examples of the method for determining the adsorption energy (ΔG) of a dye include a method of thermodynamically determining the adsorption energy by using a dye desorbing agent which is described later (the method of using a dye desorbing agent is described in Asanuma et al., *Journal of Physical Chemistry B*, Vol. 101, pp. 2149–2153 (1997)), a method of determining the adsorption energy from an adsorption isotherm by measuring the amount of dye adsorbed, which is described later (the method of measuring the amount of dye adsorbed is described, for example, in W. West et al., *Journal of Physical Chemistry*, Vol. 56, page 1054 (1952), E. Gunther and E. Moisar, *J. Photogr. Sci.*, 13, 280 (1965), T. Tani and S. Kikuchi, *Bull. Soc. Sci. Photogr. Japan*, No. 17, 1 (1967), ibid., 18, 1 (1968), and *J. Photogr. Sci.*, 17, 22 (1969), however, as described later, a method of measuring the amount of dye adsorbed by dissolving precipitated silver halide grains is useful) and a method of determining the adsorption energy using a calorimeter (a method described, for example, in W. Gardner and A. Herz, 49*th National Colloid Symposium, Am. Chem. Soc., June,* 1975. *Submitted to Photogr. Sci. Eng.*, and Asanuma et al., *Journal of Physical Chemistry B*, Vol. 101, pp. 2149–2153 (1997)). Also, computational chemistry such as calculation by molecular orbital method and calculation of molecular force field can be used.

The interaction stabilization energy as a basis of the adsorption energy (ΔG) of dye can also be determined using the above-described methods.

For example, in the case of two-layer adsorption, the adsorption energy (ΔG) of the second layer dye is determined by the method described above. Furthermore, the stabilization energy of interaction between dyes of the second layer is determined. This can be experimentally determined by using, for example, a method of Matsubara, Tanaka et al. (see, *Nippon Shashin Gakkai Shi* (*Journal of Japan Photographic Society*), Vol. 52, page 395 (1989)). More specifically, the stabilization energy can be obtained from the change in the absorption ascribable to the association of dyes in the second layer with each other occurred when the concentration of the second layer dye is variously changed at various temperatures in a gelatin solution where only silver halide grains are removed from the emulsion used. Also, computational chemistry such as calculation by molecular orbital method and calculation of molecular force field can be used.

At this time, the (stabilization energy of interaction between dyes in first layer dye and second layer dye) can be obtained from the formula: (adsorption energy (ΔG) of second layer dye)=(stabilization energy of interaction between first layer dye and second layer dye)+(stabilization energy of interaction between dyes in second layer).

In the case of three-layer adsorption, the adsorption energy (ΔG) of the third layer dye and the interaction stabilization energy as a basis thereof can be determined in the same manner as above for those of the second layer. At this time, a formula: (adsorption energy (ΔG) of second layer dye)=(stabilization energy of interaction between first layer dye and second layer dye)+(stabilization energy of interaction between dyes in second layer)+(stabilization energy of interaction between second layer dye and third layer dye) is established and since the (stabilization energy of interaction between second layer dye and third layer dye) is the same as (stabilization energy of interaction between third layer dye and second layer dye), all can be obtained.

In the case of adsorption in four or more layers, all can also be obtained in the same manner.

As the means for causing the change in the adsorption free energy ΔG of such a sensitizing dye, the method explained in the first production process of the present invention is exemplified. Also, the preferable means is the same as in the first production process.

The pH of the emulsion may be changed by any method, but in the case of a sensitizing dye showing the property of (A), the pH is preferably changed from a high pH side to a low pH side.

In the case of a sensitizing dye showing the property of (B), the pH is preferably changed from a low pH side to a high pH side.

In the present invention, at least one sensitizing dye showing the property of (A) or (B) is preferably used but this sensitizing dye may be used in combination with a dye not showing such a property. The sensitizing dye showing the property (A) or (B) is more preferably used as a dye of the second or upper layer.

The variation of pH changed is preferably from 0.2 to 5.0 units, more preferably from 0.2 to 4.0 units, still more preferably from 0.5 to 3.0 units.

The pH before the addition of the dye may be any value but is preferably from 1 to 12, more preferably from 2 to 10, still more preferably from 4 to 9.

As for the addition timing and addition method of the dye, the dye may be added at any time but this is described in detail later.

The change of pH may be caused by using any means but is preferably caused by further adding an inorganic or organic acid or an inorganic or organic base to the emulsion after the addition of the dye.

As the inorganic or organic acid and base which can be used for causing the change of pH, those which are the same as used in the first production process can be used. Also, the addition method thereof is the same as in the first production process.

Among the dyes which can be used in the production process and silver halide photographic light-sensitive material of the present invention, preferred are dyes having a structure capable of causing the change in ΔG of the sensitizing dye by the method (3) described above. It is particularly preferred to contain a chromophore having the above-described property (A) or (B) within the molecule.

In the present invention, the sensitizing dye of the second or upper layer preferably undergoes an arbitrary change in the adsorption energy (ΔG) in the range of 10 kJ/mol or more.

The adsorption energy (ΔG) of the sensitizing dye as the second or upper layer is preferably 15 kJ/mol or more, more preferably 20 kJ/mol or more, still more preferably 25 kJ/mol or more, still more preferably 30 kJ/mol or more, still more preferably 35 kJ/mol or more, still more preferably 40 kJ/mol or more, still more preferably 42 kJ/mol or more, still more preferably 45 kJ/mol or more, still more preferably 50 kJ/mol or more, still more preferably 55 kJ/mol or more, still more preferably 60 kJ/mol or more, still more preferably 65 kJ/mol or more, still more preferably 70 kJ/mol or more, still more preferably 75 kJ/mol or more, still more preferably 80 kJ/mol or more.

Among these ranges, when the adsorption energy is 20 kJ/mol or more, 40 kJ/mol or more and 42 kJ/mol or more, the performance is remarkably improved. The upper limit is not particularly present but is preferably 5,000 kJ/mol or less, more preferably 1,000 kJ/mol or less.

The variation of ΔG is preferably 15 kJ/mol or more, more preferably 20 kJ/mol or more, still more preferably 25 kJ/mol or more, still more preferably 30 kJ/mol or more, still more preferably 35 kJ/mol or more, still more preferably 40 kJ/mol or more, still more preferably 42 kJ/mol or more, still more preferably 45 kJ/mol or more, still more preferably 50 kJ/mol or more, still more preferably 55 kJ/mol or more, still more preferably 60 kJ/mol or more, still more preferably 65 kJ/mol or more, still more preferably 70 kJ/mol or more, still more preferably 75 kJ/mol or more, still more preferably 80 kJ/mol or more.

In the present invention, the adsorption energy of the sensitizing dye as the second or upper layer, excluding the covalent bond strength, is preferably 10 kJ/mol or more.

The sensitizing dye of the second or upper layer is preferably present in the layer state. The term "the sensitizing dye of the second or upper layer is present in the layer state" means that at least a part of the sensitizing dyes of the second or upper layers is present in the layer state. In this case, preferably 10% or more, more preferably 30% or more, still more preferably 50% or more, yet still more preferably 70% or more, particularly preferably 90% or more and most preferably 100% of the sensitizing dyes in the second or upper layers are present in the layer state.

The condition that a sensitizing dye is present in the layer state is described below.

Generally, when a thin film grows on a substrate surface, namely, when a sensitizing dye adsorbs in multiple layers in the present invention, the following three modes are considered.

1. Layer growth (layer-by-layer growth, Frank-van der Merwe type growth)
2. Island growth or growth by three-dimensional nucleation (nucleation and growth, Volmer-Weber type growth)
3. Mixture growth (nucleation and layer growth, Stranski-Krastanov type growth)

These growths are described in P. Bennema and G. H. Gilmer, *Crystal Growth: An Introduction*, edited by P. Hartman, North-Holland Publishing Company, Amsterdam, London, pp. 282–310 (1973), Yoshihiko Goto, *Kotai Butsuri* (*Solid Physics*), Vol. 18, No. 7, page 380 (1983), Yoshihiko Goto and Shozo Ino, *Kotai Butsuri* (*Solid Physics*), Vol. 18, No. 3, page 121 (1983), Akio Ito (compiler), *Usumaku Zairyo Nyumon* (*Introduction of Thin Film Materials*), Shokabo (1998), Mitsumasa Iwamoto, *Yuki Cho-Usumaku Electronics* (*Organic Ultrathin Electronics*), Baifukan (1993), Akira Yabe et al., *Yuki Cho-Usumaku Nyumon* (*Introduction of Organic Ultrathin Film*), Baifukan (1989), *Nippon Hyomen Kagakukai Shusai Dai* 1-*Kai Usumaku Kiso Koza Yoshi Shu* (*Summary Collection of* 1*st Elemental Lecture on Thin Film at Meeting by Japan Surface Science Society*), November 12/13, Tokyo (1998) and the like.

The layer growth means that out of the sensitizing dyes forming the multilayer adsorption, the sensitizing dyes of the second or upper layers grow while piling one on another in the layer form on the sensitizing dye of the first layer on a silver halide grain. This occurs when the binding force from the sensitizing dye of the lower layer is strong.

The island growth means that a cluster (aggregate) of sensitizing dyes in the second or upper layers forms a nucleus on the sensitizing dye of the first layer and the nuclei grow like islands. This occurs when the interaction (bonding force) between sensitizing dyes of the second or upper layers is stronger than the binding force from the sensitizing dye of the lower layer.

The mixture growth means that a few layers of second or upper layers at the initial stage undertake the layer growth but thereafter, the growth changes to the island growth. This may be caused by the distortion energy accumulated in the film due to mismatching between the sensitizing dye of the second or upper layer and the sensitizing dye of the lower layer.

In the case where the dye of the second or upper layer forms a secondary aggregate, the secondary aggregate itself has a liability to grow in the layer form, therefore, even if the interaction energy with the lower dye layer adjacent thereto is relatively small, layer adsorption is easily achieved and this is preferred. The secondary aggregate may have any aggregation form, however, formation of J-aggregate which is described later is preferred.

In the present invention, for allowing the sensitizing dye of the second or upper layer to be present in the layer state, the sensitizing dye preferably grows by the layer growth or mixture growth, more preferably by the layer growth, out of the above-described growth modes.

In the multilayer adsorption according to conventional techniques, the sensitizing dye of the second or upper layer is present in the island form and both the effect of improving the light absorption factor and the effect of increasing the sensitivity are not completely satisfied.

The state how the sensitizing dye of the second or upper layer is present may be observed by using any method, but microscopic spectrometry, STM method, AFM method, proximate site optical microscopic method, cathode luminescence method, fluorescent microscopic method, imaging SIMS method, SEM method, TEM method and the like are preferably used.

Whether or not the dye adsorbed in multiple layers is adsorbed in the layer form can be determined by the presence or absence of the fluctuation depending on the place (site) in the number of adsorbed dye layers formed on the surface of a silver halide grain or in the dye amount. In the present invention, when the fluctuation depending on the place (site) in the number of adsorbed dye layers or in the dye amount is within 5 times the fluctuation in the case of single layer adsorption, the adsorption is regarded as the layer adsorption. Of course, the smaller fluctuation reveals better layer adsorption. The fluctuation can be expressed by the standard deviation or variation coefficient (standard deviation/average) in the number of adsorbed dye layers or the dye amount every each place (site) on the silver halide grain. When the state how the sensitizing dye is present is observed using the above-described measuring method, the number of adsorbed dye layers or the dye amount can be determined every each place (site) on the grain surface, therefore, by examining the fluctuation thereof, layer adsorption can be judged.

The sensitizing dye of the first layer is also preferably present in the layer state. Generally, the interaction between a silver halide grain and the sensitizing dye of the first layer is strong and therefore, the first layer grows in the layer form and is present in the layer state in many cases.

The interaction as a basis of the adsorption energy of the sensitizing dye may be any bonding force but examples thereof include van der Waals force (more particularly, this is classified into orientation force acting between permanent dipole and permanent dipole, induction force acting between permanent dipole and induced dipole, and dispersion force acting between temporary dipole and induced dipole), charge transfer (CT) force, Coulomb force (electrostatic force), hydrophobic bonding force, hydrogen bonding force, covalent bonding force (chemical bonding force) and coordinate bonding force. Only one of these bonding forces may be used or a plurality of bonding forces freely selected therefrom may be used in combination. (Such a common bonding force is excluded on referring to the feature that the adsorption energy of the sensitizing dye of the second or upper layer is 10 kJ/mol or more, which is one of the characteristic features of the present invention.)

Among those, preferred are van der Waals force, charge transfer force, Coulomb force, hydrophobic bonding force, hydrogen bonding force and coordinate bonding force, more preferred are van der Waals force, charge transfer force (CT), Coulomb force, hydrophobic bonding force and hydrogen bonding force, more preferred are van der Waals force, charge transfer force (CT) and Coulomb force, particularly preferred are van der Waals force and Coulomb force, and most preferred is van der Waals force.

With which dye and to which degree of stabilization energy the interaction as a basis of the adsorption energy ($\Delta G$) of the sensitizing dye of the second or upper layer preferably works are described below.

The case of R-layer adsorption in the second or upper layer is described below.

In this case, the stabilization energy of the interaction as a basis of the adsorption force of the i-th layer dye can be divided into a stabilization energy of the interaction between the i-th layer dye and the (i−1)-th layer dye ($\Delta Gi(i-1)$), a stabilization energy of the interaction between the i-th layer dye and the i-th layer dye ($\Delta Gii$), and a stabilization energy of the interaction between the i-th layer dye and the (i+1)-th layer dye ($\Delta Gi(i+1)$) (wherein i is 2 or more).

At this time, the following 1, 2 and 3 are preferred in this order. In the case of i=R (namely, the uppermost layer), the interaction $\Delta Gi(i+1)$ is not present.

1. $\Delta Gi(i-1)>(Xi(i-1))$ kJ/mol and/or $\Delta Gii>(Xii)$ kJ/mol and/or $\Delta Gi(i+1)>(Xi(i+1))$ kJ/mol.

2. $\Delta Gi(i-1)>(Xi(i-1))$ kJ/mol and $\Delta Gii>(Xii)$ kJ/mol and $\Delta Gi(i+1)>(Xi(i+1))$ kJ/mol.

3. In 1 and 2, further $\Delta Gi(i-1)>\Delta Gii$, $\Delta Gi(i+1)>\Delta Gii$.

The values of Xi(i−1), Xii and Xi(i+1) each is preferably 5, 10, 15, 20, 25, 30, 35, 40, 45, 50, 55, 60, 65, 70, 75 and 80 in this order.

An interaction is present also between the i-th layer dye and the (i−2)-th layer dye, between the i-th layer dye and the (i+2)-th layer dye, between the i-th layer dye and a silver halide grain, and the like, however, these are a long-distance interaction and can be neglected.

The preferred conditions of interaction between sensitizing dyes are described below by another expression.

Assuming that the surface energy density of the sensitizing dye as the first layer is $\sigma 1$ and the surface energy density of the sensitizing dye as the second layer grown on the first layer is $\sigma 2$, the interface energy density $\sigma 21$ on their adhesion is defined as $\sigma 21=\sigma 2+\sigma 1-\gamma$. $\gamma$ is an adhesion energy density of the sensitizing dye of the second layer to the sensitizing dye of the first layer.

If $\gamma<0$, the sensitizing dye of the second layer does not adsorb to the sensitizing dye of the first layer in many cases, failing in forming multilayer adsorption. When $\gamma>0$, the interference energy decreases due to the adsorption and therefore, the sensitizing dye of the second layer grows on the sensitizing dye of the first layer. When $\sigma 21 \leqq \sigma 1-\sigma 2$ is satisfied, layer growth is advantageous and when $\sigma 1-\sigma 2<\sigma 21<\sigma 2+\sigma 1$ is satisfied, island growth is advantageous. Accordingly, in the present invention, $\sigma 21 \leqq \sigma 1-\sigma 2$ is preferably satisfied.

In the present invention, the interaction as a basis of the adsorption energy ($\Delta G$) of the sensitizing dye of second or upper layer may be any bonding force as described above. Some interactions are described below.

The hydrogen bonding may be any hydrogen bonding but a method of using hydrogen boding at multiple points more than one point is preferred in some cases, such as a melamine and a cyanuric acid, a melamine and a barbituric acid, or a 2-benzimidazolone. This multipoint hydrogen bonding is described, for example, in G. M. Whitesides, E. E. Silmanek, J. P. Mathias, C. T. Seto, N. Chin, M. Mammen and D. M. Gordon, *Chem. Res.*, 28, 37 (1995), G. M. Whitesides, J. P. Mathias and C. T. Seto, *Science*, 254, 1312 (1991), K. E. Schwiebert, D. N. Chin, J. C. Macdonald and G. M. Whitesides, *J. Am. Chem. Soc.*, 118, 4018 (1996), and N. Kimizuka et al., *J. Am. Chem. Soc.*, 115, 4387 (1993). Specifically, a sensitizing dye containing a functional group having this multipoint hydrogen bonding function is preferably used.

In another case, a plurality of weak interactions are used to provide a strong interaction as a whole. Examples thereof include a host-guest interaction. Specifically, crown ethers, cryptands, spherands, calixarenes, cyclophans, cyclodextrins, catenanes and rotaxanes are used. These are described, for example, in F. Vogtle, *Supramolecular Chemistry*, John Wiley and Sons, Ltd. (1989), and M. Gubelmann, A. Harriman, J. J. Lehn and J. L. Sessler, *J. Phys. Chem.*, 94, 308 (1990). Specifically, a sensitizing dye having thus functional group is preferably used.

Also, LB film method and bimolecular film are known. These are described, for example, in T. L. Penner and D. Mobius, *J. Am. Chem. Soc.*, 104, 7407 (1982), M. Shimomura and T. Kunitake, *J. Am. Chem. Soc.*, 109, 5175 (1987), Masatsugu Shimomura, *Koteika 2 Bunshi Maku=Hikari Kino Zairyo to shite no Kanosei* (*Immobilized Bimolecular Film— Possibility as Photofunctional Material*), Bunshin Shuppan (1990), and F. Vogtle, *Supramolecular Chemistry*, John Wiley and Sons, Ltd. (1989). Specifically, a sensitizing dye having this functional group is preferably used.

As an example of forming a kind of a covalent bond in a silver halide emulsion, a case of forming a silicon layer is known. For example, an organic silicon layer can be formed by mixing a dye having a hydroxy group and a tetraalkoxysilane. Also, a case of forming a layer having a phosphorus acid-Zr salt as a fundamental unit is known. These are a so-called sol-gel method by organic-inorganic hybridization. This method is described, for example, in *Chemical Reviews*, 95, 399–438 (1995) (particularly, page 433), Li Dequan, M. A. Ratner and T. J. Marks, *J. Am. Chem. Soc.*, 112, 7389 (1990), and Satoshi Matsuoka, *Shikiso no Kagaku to Oyo* (*Chemistry and Application of Dye*), Dainippon Tosho (1994). Specifically, a sensitizing dye having this functional group is preferably used.

In the present invention, the light absorption intensity is an integrated intensity of light absorption by a sensitizing dye per the unit grain surface area and defined as a value obtained, assuming that the quantity of light incident on the unit surface area of a grain is $I_0$ and the quantity of light absorbed into a sensitizing dye on the surface is I, by integrating the optical density $\mathrm{Log}(I_0/(I_0-I))$ with respect to the wave number ($cm^{-1}$) The integration range is from 5,000 $cm^{-1}$ to 35,000 $cm^{-1}$.

The silver halide photographic emulsion of the present invention preferably contains a silver halide grain having a light absorption intensity of 100 or more in the case of a grain having a spectral absorption maximum wavelength in excess of 500 nm, or having a light absorption intensity of 60 or more in the case of a grain having a spectral absorption maximum wavelength of 500 nm or less, in a proportion of a half or more of the entire projected area of all silver halide grains. In the case of a grain having a spectral absorption maximum wavelength in excess of 500 nm, the light absorption intensity is preferably 150 or more, more preferably 170 or more, still more preferably 200 or more. In the case of a grain having a spectral absorption maximum wavelength of 500 nm or less, the light absorption intensity is preferably 90 or more, more preferably 100 or more, still more preferably 120 or more. The upper bound is not particularly limited but it is preferably 2,000 or less, more preferably 1,000 or less, still more preferably 500 or less.

The spectral absorption maximum wavelength of a grain having a spectral absorption maximum wavelength of 500 nm or less is preferably 350 nm or more.

One example of the method for measuring the light absorption intensity is a method using a microspectrophotometer. The microspectrophotometer is a device capable of measuring the absorption spectrum of a microscopic area and can measure the transmission spectrum of one grain.

The measurement of absorption spectrum of one grain by the microspectrometry is described in the report by Yamashita et al. (Nippon Shashin Gakkai, 1996 *Nendo Nenji Taikai Ko'en Yoshi Shu* (*Lecture Summary at Annual Meeting of Japan Photographic Association in* 1996), page 15). From this absorption spectrum, an absorption intensity per one grain can be obtained, however, the light transmitting the grain is absorbed on two surfaces of upper surface and lower surface, therefore, the absorption intensity per unit area on the grain surface can be determined as a half (½) of the absorption intensity per one grain obtained by the above-described method. At this time, the segment for the integration of absorption spectrum is from 5,000 to 35,000 $cm^{-1}$ in the definition, however, in experiments, the segment for the integration may contain the region of 500 $cm^{-1}$ shorter or longer than the segment having absorption by the sensitizing dye.

The light absorption intensity is a value indiscriminately determined by the oscillator strength of sensitizing dye and the number of molecules adsorbed per unit area and therefore, it is possible to obtain the oscillator strength of sensitizing dye, the amount of dye adsorbed and the surface area of grain and convert these into the light absorption intensity.

The oscillator strength of sensitizing dye can be experimentally obtained as a value in proportion to the absorption integrated intensity (optical density×$cm^{-1}$) of a sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag), the light absorption intensity can be obtained according to the following formula within an error range of about 10%:

$$0.156 \times A \times B/C$$

The light absorption intensity calculated by this formula is substantially the same as the light absorption intensity measured based on the above-described definition (a value obtained by the integration of $\mathrm{Log}(I_0/(I_0-I))$ with respect to the wave number ($cm^{-1}$)).

For increasing the light absorption intensity, a method of allowing a sensitizing dye to adsorb in multiple layers on the surface of a silver halide grain, namely, to stack in more than one layer on the surface of a silver halide grain, may be used.

Here, the state where a sensitizing dye is stacked in more than one layer on the surface of a silver halide grain means that the dye restrained to the vicinity of a silver halide grain is present in more than one layer. Dyes present in the dispersion medium is not included. Also, even in the case where a dye chromophore is linked with a substance adsorbed to the grain surface through a covalent bond, if the linking group is very long and the dye chromophore is present in the dispersion medium, the effect of increasing the light absorption intensity is small and this is not preferred. Also, spectral sensitization need be generated by the dye not directly adsorbed to the grain surface and for this purpose, an excitation energy must be transmitted from the dye not directly adsorbed to silver halide to the dye directly adsorbing to a grain. Therefore, excitation energy transmission which is necessary to pass through over 10 stages is not preferred because the transmission efficiency of excitation energy finally decreases. One example of such a case is a polymer dye described in JP-A-2-113239 where a majority of dye chromophores are present in a dispersion medium and the excitation energy must be transmitted through 10 or more stages.

In the present invention, the number of dye chromophores per one molecule is preferably from 1 to 3, more preferably from 1 to 2, and most preferably 1.

The "chromophore" as used herein means an atomic group as a main cause for the absorption band of a molecule, which is described in *Rikagaku Jiten* (*Physicochemical Dictionary*), 4th ed., pp. 985–986, Iwanami Shoten (1987). Any atomic group, for example, an atomic group having an unsaturated bond such as C═C or N═N, may be used.

Examples thereof include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, azamethine dyes, coumarin dyes, arylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophyll dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes and polymethine chromophores such as azamethine dyes, more preferred are cyanine dyes, merocyanine dyes, trinuclear merocyanine dyes, tetranuclear merocyanine dyes and rhodacyanine dyes, still more preferred are cyanine dyes, merocyanine dyes and rhodacyanine dyes, and most preferred are cyanine dyes.

More specifically, those described in *RD*17643, pp. 23–24, *RD*18716, page 648, right column to page 649, right column, *RD*308119, page 996, right column to page 998, right column, and EP-A-0565096 can be preferably used. Examples of the formulae of preferred dyes include formulae described U.S. Pat. No. 5,747,236 (particularly pages 30 to 39) and formulae described in U.S. Pat. No. 5,340,694 (particularly pages 21 to 60, however, in the sensitizing dyes represented by formulae (XI), (XII) and (XIII), the numbers in $n_{12}$, $n_{15}$, $n_{17}$ and $n_{18}$ are not limited and each is an integer of 0 or more (preferably 4 or less)).

The dye chromophore is preferably adsorbed to a silver halide grain in 1.5 or more layers, more preferably in 1.7 or more layers, still more preferably in 2 or more layers. The upper bound is not particularly limited but is preferably 10 or less layers, more preferably 5 or less layers.

In the present invention, the state where a chromophore is adsorbed in more than one layer on the surface of a silver halide grain means a state where, when the saturation adsorption amount per unit surface area achieved by a dye having a smallest dye occupation area on the surface of a silver halide grain out of sensitizing dyes added to an emulsion is defined as a single layer saturation coverage, the adsorption amount of a dye chromophore per unit area is larger than the single layer saturation coverage. The number of adsorbed layers means an adsorption amount based on the single layer saturation coverage. In the case of a dye where dye chromophores are linked through a covalent bond, the number of adsorbed layers may be based on the dye occupation area of individual dyes in their unlinked state.

The dye occupation area can be obtained from an adsorption isotherm showing the relationship between the free dye concentration and the dye adsorption amount, and a grain surface area. The adsorption isotherm may be obtained by referring, for example, to A. Herz et al., *Adsorption from*

*Aqueous Solution, Advances in Chemistry Series*), No. 17, page 173 (1968).

For determining the amount of a sensitizing dye adsorbed to an emulsion grain, two methods may be used, namely, one is a method of centrifuging an emulsion having adsorbed thereto a dye, separating the emulsion grains from the supernatant aqueous gelatin solution, measuring the spectral absorption of the supernatant to obtain a non-adsorbed dye concentration, and subtracting the obtained concentration from the amount of dye added, thereby determining the dye adsorption amount, and another is a method of drying the emulsion grains precipitated, dissolving a predetermined weight of the precipitate in a 1:1 mixed solution of aqueous sodium thiosulfate solution and methanol, and measuring the spectral absorption, thereby determining the dye adsorption amount. In the case where a plurality of dyes are used, the adsorption amount of individual dyes may also be determined using means such as high-performance liquid chromatography. The method of determining the dye adsorption amount by quantitating the amount of dye in the supernatant is described, for example, in W. West et al., *Journal of Physical Chemistry*, Vol. 56, page 1054 (1952). However, under the conditions that the amount of dye added is large, even non-adsorbed dyes may precipitate and exact determination of the adsorption amount may not be attained by the method of quantitating the dye concentration in the supernatant. On the other hand, according to the method of dissolving silver halide grains precipitated and measuring the dye adsorption amount, the amount of only the dye adsorbed to grains can be exactly determined because the emulsion grain is by far higher in the precipitation rate and the grains can be easily separated from the precipitated dye. This method is most reliable for determining the dye adsorption amount.

The amount of a photographically useful compound adsorbed to a grain can also be measured in the same manner as the sensitizing dye, however, since the absorption in the visible region is small, a quantitative method using high performance liquid chromatography is more preferred than the quantitative method by spectral absorption.

As one example of the method for measuring the surface area of a silver halide grain, a method of taking a transmission electron microscopic photograph by a replica process and calculating the shape and size of individual grains may be used. In this case, the thickness of a tabular grain is calculated from the length of a shadow of the replica. The transmission electron microscopic photograph may be taken by a method described, for example, in *Denshi Kenbikyo Shiryo Gijutsu Shu* (*Electron Microscopic Sample Technologies*), Nippon Denshi Kenbikyo Gakkai Kanto Shibu (compiler), Seibundo Shinko Sha (1970), and P. B. Hirsch et al., *Electron Microscopy of Thin Crystals*, Butterworths, London (1965).

The dye occupation area of individual grains may be experimentally determined by the above-described methods, however, the molecular occupation area of sensitizing dyes used is usually present almost in the vicinity of 80 $Å^2$, therefore, the number of adsorbed layers can be roughly estimated by a simple method of counting the dye occupation area of all dyes as 80 $Å^2$.

In the present invention, when a dye chromophore is adsorbed in multiple layers on a silver halide grain, the dye chromophore directly adsorbing to the silver halide grain, namely, the dye chromophore as the first layer, and the dye chromophore as the second or upper layer may have any reduction potential and any oxidation potential, however, the reduction potential of the dye chromophore as the first layer is preferably more positive than the value obtained by subtracting 0.2 V from the reduction potential of the dye chromophore as the second or upper layer.

The reduction potential and the oxidation potential can be measured by various methods, however, these are preferably measured by phase discrimination-type second harmonic a.c. polarography for obtaining exact values. The method for measuring the potential by phase discrimination-type second harmonic a.c. polarography is described in *Journal of Imaging Science*, Vol. 30, page 27 (1986).

The dye chromophore as the second or upper layer is preferably a light-emitting dye. The light-emitting dye preferably has a skeleton structure of dyes used for dye laser. These are described, for example, in Mitsuo Maeda, *Laser Kenkyu* (*Study of Laser*), Vol. 8, page 694, page 803 and page 958 (1980), ibid., Vol. 9, page 85 (1981), and F. Schaefer, *Dye Lasers*, Springer (1973).

In a silver halide photographic light-sensitive material, the absorption maximum wavelength of the dye chromophore as the first layer is preferably longer than the absorption maximum wavelength of the dye chromophore as the second or upper layer. Furthermore, the light emission of the dye chromophore as the second or upper layer preferably overlaps the absorption of the dye chromophore as the first layer. In addition, the dye chromophore of the first layer preferably forms a J-aggregate. In order to have absorption and spectral sensitivity in a desired wavelength range, the dye chromophore of the second or upper layer also preferably forms a J-aggregate.

The excitation energy of the second layer dye preferably has an energy transfer efficiency to the first layer dye of 30% or more, more preferably 60% or more, still more preferably 90% or more. The term "excitation energy of the second layer dye" as used herein means the energy of a dye in the excited state produced as a result of the second layer dye absorbing light energy. When excitation energy of a certain molecule transfers to another molecule, the excitation energy is considered to transfer through excitation electron transfer mechanism, Forster model energy transfer mechanism, Dextor model energy transfer mechanism or the like. Therefore, it is also preferred for the multilayer adsorption system of the present invention to satisfy the conditions for causing an efficient excitation energy transfer achievable by these mechanisms, more preferably to satisfy the conditions for causing Forster model energy transfer mechanism. In order to elevate the efficiency of the Forster model energy transfer, reduction in the refractive index in the vicinity of the surface of an emulsion grain is effective.

The efficiency of the energy transfer from the second layer dye to the first layer dye can be determined by spectral sensitization efficiency at the excitation of the second layer dye/spectral sensitization efficiency at the excitation of the first layer dye.

The meanings of the terms used in the present invention are described below.

Dye Occupation Area:

An occupation area per one dye molecule. This can be experimentally determined from the adsorption isotherm. In the case of a dye where dye chromophores are linked through a covalent bond, the dye occupation area of unlinked individual dyes is used as a base. This is simply 80 $Å^2$.

Single Layer Saturation Coverage:

A dye adsorption amount per unit grain surface area at the time of single layer saturation covering. A reciprocal of the minimum dye occupation area among dyes added.

Multilayer Adsorption (Adsorption in Multiple Layers):

A state where the amount of a dye chromophore adsorbed per unit grain surface area is larger than the single layer saturation coverage.

Number of Adsorbed Layers:

An amount of a dye chromophore adsorbed per unit grain surface area based on the single layer saturation coverage.

In the present invention, the distribution of the light absorption intensity among grains is preferably narrow. The distribution of the light absorption intensity among grains can be expressed as a coefficient of variation in the light absorption intensity of 100 or more grains randomly measured by the microspectrometry. The coefficient of variation can be obtained as 100×standard deviation/average (%). The light absorption intensity is a value in proportional to the dye adsorption amount, therefore, the distribution of the light absorption intensity among grains can be said in other words as the distribution of the dye adsorption amount among grains. The coefficient of variation in the distribution of the light absorption intensity among grains is preferably 60% or less, more preferably 30% or less, still more preferably 10% or less.

The coefficient of variation in the distribution among grains of the distance between the shortest wavelength showing 50% of the maximum absorption (Amax) of a sensitizing dye and the longest wavelength showing 50% of Amax is preferably 30% or less, more preferably 10% or less, still more preferably 5% or less.

With respect to the absorption maximum wavelength of the sensitizing dye every each grain, grains in a proportion of preferably 70% or more, more preferably 90% or more of the projected area have an absorption maximum in the wavelength range within 10 nm. In a more preferred embodiment of the absorption maximum wavelength of the sensitizing dye every each grain, grains in a proportion of preferably 50% or more, more preferably 70% or more, still more preferably 90% or more have an absorption maximum in the wavelength range within 5 nm.

The distribution among grains of the light absorption intensity (namely, dye adsorption amount) is known to become uniform as the dye adsorption amount increases in the case where the adsorption site is fixed to the surface of a silver halide grain. However, in the case of multilayer adsorption of the present invention, the adsorption site is not limited insofar as not only two-layer adsorption but also adsorption in several layers can be attained, and it has been found that a distribution is very readily generated among grains, for example, single-layer adsorption for a certain grain and three-layer adsorption for another grain. As a result of analysis, it has been clarified that as the ratio of the interaction energy between dyes of the second layer increases based on the entire adsorption energy of the second layer dye (in other words, the ratio of the interaction energy between the first layer dye molecule and the second layer dye molecule relatively decreases), the multilayer adsorption system is liable to have non-uniformity in the dye adsorption amount among grains. The interaction energy between the first layer dye molecule and the second layer dye molecule is preferably 20% or more, more preferably 40% or more, based on the entire adsorption energy of the second layer dye.

In order to intensify the interaction between the first layer dye and the second layer dye, it is preferred to use electrostatic interaction, van der Waals interaction, hydrogen bonding or coordinate bonding between the first layer dye molecule and the second layer dye molecule or a composite interaction force thereof. Although the main interaction between second layer dyes is preferably van der Waals interaction between dye chromophores, it is also preferred to use electrostatic interaction, van der Waals interaction, hydrogen bonding, coordinate bonding or a composite interaction thereof as long as the above-described preferred relationship is satisfied.

The ratio of the interaction energy between the first layer dye molecule and the second layer molecule to the entire adsorption energy of the second layer dye can be measured in the same manner by the method described above.

The distribution of the dye adsorption amount among grains and the state of sensitizing dyes of second or upper layers are affected also by the adding conditions of dye. A method of adding the dye at a relatively low temperature and thereafter elevating the temperature is preferred.

In some cases, addition of a dye at a high temperature of 80° C. or more is not preferred.

In the emulsion containing a silver halide photographic emulsion grain having a light absorption intensity of 60 or more or 100 or more, the distance between the shortest wavelength showing 50% of a maximum value Amax of the spectral absorption factor by a sensitizing dye or showing 50% of a maximum value Smax of the spectral sensitivity and the longest wavelength showing 50% of Amax or 50% of Smax is preferably 120 nm or less, more preferably 100 nm or less.

The distance between the shortest wavelength showing 80% of Amax or 80% of Smax and the longest wavelength showing 80% of Amax or 80% of Smax is preferably 20 nm or more, more preferably 100 nm or less, still more preferably 80 nm or less, particularly preferably 50 nm or less.

The distance between the shortest wavelength showing 20% of Amax or 20% of Smax and the longest wavelength showing 20% of Amax or 20% of Smax is preferably 180 nm or less, more preferably 150 nm or less, still more preferably 120 nm or less, most preferably 100 nm or less.

The longest wavelength showing a spectral absorption factor of 50% of Amax or 50% of Smax is preferably from 460 to 510 nm, from 560 nm to 610 nm, or from 640 to 730 nm.

For realizing a silver halide grain having a spectral absorption maximum wavelength of less than 500 nm and a light absorption intensity of 60 or more or having a spectral absorption maximum wavelength of 500 nm or more and a light absorption intensity of 100 or more, a first preferred method is a method of using a specific dye described below. From these methods, a method which can be applied to the present invention can be selected.

For example, a method of using a dye having an aromatic group or using a cationic dye having an aromatic group and an anionic dye in combination described in JP-A-10-239789, JP-A-8-269009, JP-A-10-123650 and JP-A-8-328189, a method of using a dye having a polyvalent electric charge described in JP-A-10-171058, a method of using a dye having a pyridinium group described in JP-A-10-104774, a method of using a dye having a hydrophobic group described in JP-A-10-186559, a method of using a dye having a coordinate bond group described in JP-A-10-197980, and a method of using a specific dye described in JP-A-2000-256573 (Japanese Patent Application No. 11-63588), JP-A-2000-275776 (Japanese Patent Application No. 11-80141), JP-A-2000-345061 (Japanese Patent Application No. 11-159731), JP-A-2000-345060 (Japanese Patent Application No. 11-159730), JP-A-2001-005132 (Japanese Patent Application No. 11-171324), JP-A-2001-075220 (Japanese Patent Application No. 11-221479), JP-A-2001-092068 (Japanese Patent Application No. 11-265769), JP-A-

2001-081341 (Japanese Patent Application No. 11-260643), JP-A-2001-152038 (Japanese Patent Application No. 11-331571), JP-A-2001-152044 (Japanese Patent Application No. 1-331570), JP-A-2001-075221 (Japanese Patent Application No. 11-311039), JP-A-2001-152037 (Japanese Patent Application No. 11-331567), JP-A-2001-166413 (Japanese Patent Application No. 11-347781) and JP-A-2001-209143 (Japanese Patent Application No. 2000-18966) are preferred.

Among these, preferred is a method of using a dye having at least one aromatic group, and more preferred is a method of using only a positively charged dye, a dye cancelled in the electric charge within the molecule or a dye having no electric charge, or a method of using a positively charged dye and a negative charged dye in combination where at least one of the positively charged dye and the negatively charged dye is a dye having at least one aromatic group as a substituent.

The aromatic group is described in detail below. The aromatic group includes a hydrocarbon aromatic group and a heterocyclic aromatic group. The group may be a polycyclic condensed ring resulting from the condensation of hydrocarbon aromatic rings or heteroaromatic rings to each other, or a group having a polycyclic condensed structure resulting from the combining of an aromahydrocarbon ring and an aromatic heterocyclic ring, and may be substituted by a substituent V which will be described later. Preferred examples of the aromatic ring contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiine, phenothiazine and phenazine.

Among these, more preferred are the hydrocarbon aromatic rings, still more preferred are benzene and naphthalene, and most preferred is benzene.

Examples of the dye include the dyes described above as examples of the dye chromophore. Among these, preferred are dyes described above as examples of the polymethine dye chromophore.

More preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes and azamethine dyes, still more preferred are cyanine dyes, merocyanine dyes, trinuclear merocyanine dyes, tetranuclear merocyanine dyes and rhodacyanine dyes, particularly preferred are cyanine dyes, merocyanine dyes and rhodacyanine dyes, and most preferred are cyanine dyes.

Particularly preferred methods are described in detail below by referring to structural formulae.

The following methods (1) and (2) are preferred. Of the methods (1) and (2), the method (2) is more preferred.

(1) A method of using at least one cationic, betaine or nonionic methine dye represented by the following formula (I); and (2) A method of simultaneously using at least one cationic methine dye represented by the following formula (I) and at least one anionic methine dye represented by the following formula (II):

(I)

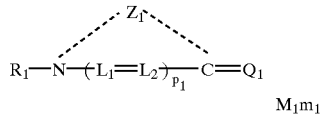

wherein $Z_1$ represents an atomic group necessary for forming a nitrogen-containing heterocyclic ring, provided that a ring may be condensed thereto, $R_1$ represents an alkyl group, an aryl group or a heterocyclic group, $Q_1$ represents a group necessary for allowing the compound represented by formula (I) to form a methine dye, $L_1$ and $L_2$ each represents a methine group, $p_1$ represents 0 or 1, provided that $Z_1$, $R_1$, $Q_1$, $L_1$ and $L_2$ each has a substituent which allows the methine dye represented by formula (I) as a whole to form a cationic dye, a betaine dye or a nonionic dye and in the case where formula (I) is a cyanine dye or a rhodacyanine dye, $Z_1$, $R_1$, $Q_1$, $L_1$ and $L_2$ each preferably has a substituent which allows the methine dye represented by formula (I) as a whole to form a cationic dye, $M_1$ represents a counter ion for balancing the electric charge, and $m_1$ represents an integer of 0 or more necessary for neutralizing the electric charge of the molecule;

(II)

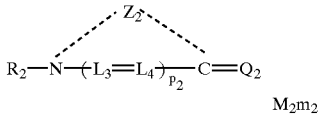

wherein $Z_2$ represents an atomic group necessary for forming a nitrogen-containing heterocyclic ring, provided that a ring may be condensed thereto, $R_2$ represents an alkyl group, an aryl group or a heterocyclic group, $Q_2$ represents a group necessary for allowing the compound represented by formula (II) to form a methine dye, $L_3$ and $L_4$ each represents a methine group, $p_2$ represents 0 or 1, provided that $Z_2$, $R_2$, $Q_2$, $L_3$ and $L_4$ each has a substituent which allows the methine dye represented by formula (II) as a whole to form an anionic dye, $M_2$ represents a counter ion for balancing the electric charge, and $m_2$ represents a number of 0 or more necessary for neutralizing the electric charge of the molecule.

In the case of using the compound represented by formula (I) alone, $R_1$ is preferably a group having an aromatic ring.

In the case of using the compound represented by formula (I) and the compound represented by formula (II) in combination, preferably, at least one of $R_1$ and $R_2$ is a group having an aromatic ring, and more preferably, $R_1$ and $R_2$ both are a group having an aromatic ring.

The cationic dye for use in the present invention may be any as long as the electric charge of the dye exclusive of the counter ion is cationic, but a dye having no anionic substituent is preferred. The anionic dye for use in the present invention may be any as long as the electric charge of the dye exclusive of the counter ion is anionic, but a dye having one or more anionic substituent is preferred. The betaine dye for use in the present invention is a dye having an electric charge within the molecule, where, however, an inner salt is formed and the molecule as a whole has no electric charge. The nonionic dye for use in the present invention is a dye not having an electric charge at all within the molecule.

The term "anionic substituent" as used herein means a substituent having a negative charge. Examples thereof include a proton-dissociative acidic group having a dissociation ratio of 90% or more at a pH of 5 to 8. Specific examples thereof include a sulfo group, a carboxyl group, a sulfato group, a phosphoric acid group, a boric acid group and a group from which a proton dissociates depending on the pKa thereof and the pH in the environment, such as —$CONHSO_2$ group (e.g., sulfonylcarbamoyl group, carbamoylsulfamoyl group), —CONHCO— group (e.g., carbonylcarbamoyl group), —$SO_2NHSO_2$— group (e.g., sulfonylsulfamoyl group) and phenolic hydroxyl group. Among these, preferred are a sulfo group, a carboxyl group, —$CONHSO_2$— group, —CONHCO— group and —$SO_2NHSO_2$— group.

From the —$CONHSO_2$— group, —CONHCO— group and —$SO_2NHSO_2$— group, a proton may not dissociates depending on the pKa thereof and the pH in the environment. In such a case, these groups are not included in the anionic substituent referred to herein. In other words, in the case where a proton does not dissociates, even if two of such groups are substituted, for example, to a dye represented by formula (I-1) which is described later, the dye can be regarded as a cationic dye.

In the present invention, a sensitizing dye having at least one —$CONHSO_2$— group, —CONHCO— group or —$SO_2NHSO_2$— group from which a proton is not dissociated is preferably contained. More preferably, an aromatic group is substituted to such a group through a single bond or a linking group having from 1 to 4 carbon atoms. This dye is described in JP-A-2001-152038 (Japanese Patent Application No. 11-331571).

Examples of the cationic substituent include a substituted or unsubstituted ammonium group and a substituted or unsubstituted pyridium group.

The dye represented by formula (I) is more preferably represented by the following formula (I-1), (I-2) or (I-3):

(I-1)

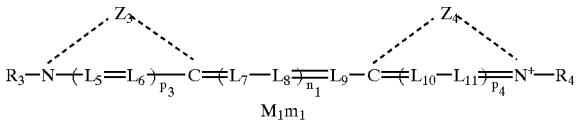

wherein $L_5$, $L_6$, $L_7$, $L_8$, $L_9$, $L_{10}$ and $L_{11}$ each represents a methine group, $p_3$ and $p_4$ each represents 0 or 1, $n_1$ represents 0, 1, 2, 3 or 4, $Z_3$ and $Z_4$ each represents an atomic group necessary for forming a nitrogen-containing heterocyclic ring, provided that a ring may be condensed thereto, $R_3$ and $R_4$ each represents an alkyl group, an aryl group or a heterocyclic group, and $M_1$ and $m_1$ have the same meanings as in formula (I), provided that $R_3$, $R_4$, $Z_3$, $Z_4$ and $L_5$ to $L_{11}$ each has no anionic substituent when the dye (I-1) is a cationic dye, and has one anionic substituent when the dye (I-1) is a betaine dye;

(I-2)

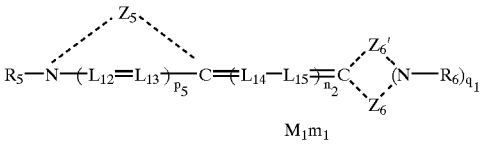

wherein $L_{12}$, $L_{13}$, $L_{14}$ and $L_{15}$ each represents a methine group, $p_5$ represents 0 or 1, $q_1$ represents 0 or 1, $n_2$ represents 0, 1, 2, 3 or 4, $Z_5$ represents an atomic group necessary for forming a nitrogen-containing heterocyclic ring, $Z_6$ and $Z_6'$ each represents an atomic group necessary for forming a heterocyclic ring or acyclic acidic terminal group together with $(N—R_6)_{q1}$, provided that a ring may be condensed to $Z_5$, $Z_6$ and $Z_6'$, $R_5$ and $R_6$ each represents an alkyl group, an aryl group or a heterocyclic group, and $M_1$ and $m_1$ have the same meanings as in formula (I), provided that $R_5$, $R_6$, $Z_5$, $Z_6$, $Z_6'$ and $L_{12}$ to $L_{15}$ each has a cationic substituent when the dye (I-2) is a cationic dye, has one cationic substituent and one anionic substituent when the dye (I-2) is a betaine dye, and has neither cationic substituent nor anionic substituent when the dye (I-2) is a nonionic dye;

(I-3)

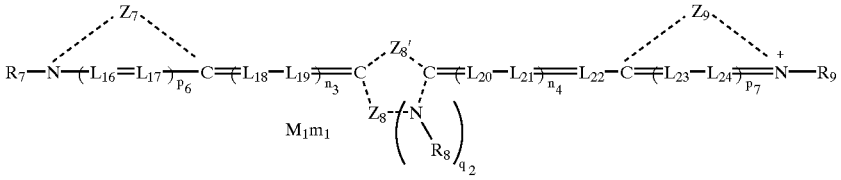

wherein $L_{16}$, $L_{17}$, $L_{18}$, $L_{19}$, $L_{20}$, $L_{21}$, $L_{22}$, $L_{23}$ and $L_{24}$ each represents a methine group, $p_6$ and $p_7$ each represents 0 or 1, $q_2$ represents 0 or 1, $n_3$ and $n_4$ each represents 0, 1, 2, 3 or 4, $Z_7$ and $Z_9$ each represents an atomic group necessary for forming a nitrogen-containing heterocyclic ring, $Z_8$ and $Z_8'$ each represents an atomic group necessary for forming a heterocyclic ring together with $(N—R_8)_{q2}$, provided that a ring may be condensed to $Z_7$, $Z_8$, $Z_8'$ and $Z_9$, $R_7$, $R_8$ and $R_9$ each represents an alkyl group, an aryl group or a heterocyclic group, and $M_1$ and $m_1$ have the same meanings as in formula (I), provided that $R_7$, $R_8$, $R_9$, $Z_7$, $Z_8$, $Z_8'$, $Z_9$ and $L_{16}$ to $L_{24}$ each has no anionic substituent when the dye (I-3) is a cationic dye, and has one anionic substituent when the dye (I-3) is a betaine dye.

The anionic dye represented by formula (II) is more preferably represented by the following formula (II-1), (II-2) or (II-3):

(II-1)

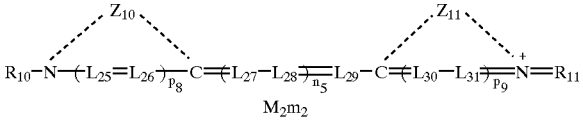

wherein $L_{25}$, $L_{26}$, $L_{27}$, $L_{28}$, $L_{29}$, $L_{30}$ and $L_{31}$ each represents a methine group, $p_8$ and $p_9$ each represents 0 or 1, $n_5$ represents 0, 1, 2, 3 or 4, $Z_{10}$ and $Z_{11}$ each represents an atomic group necessary for forming a nitrogen-containing heterocyclic ring, provided that a ring may be condensed thereto, $R_{10}$ and $R_{11}$ each represents an alkyl group, an aryl group or a heterocyclic group, and $M_2$ and $m_2$ have the same meanings as in formula (II), provided that $R_{10}$ and $R_{11}$ each has an anionic substituent;

(II-2)

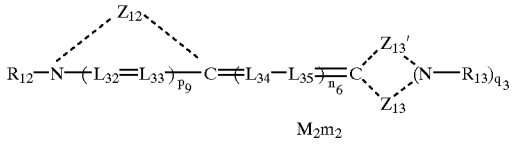

wherein $L_{32}$, $L_{33}$, $L_{34}$ and $L_{35}$ each represents a methine group, $p_{10}$ represents 0 or 1, $q_3$ represents 0 or 1, $n_6$ represents 0, 1, 2, 3 or 4, $Z_{12}$ represents an atomic group necessary for forming a nitrogen-containing heterocyclic ring, $Z_{13}$ and $Z_{13}'$ each represents an atomic group necessary for forming a heterocyclic ring or acyclic acidic terminal group together with $(N—R_{13})_{q3}$, provided that a ring may be condensed to $Z_{12}$, $Z_{13}$ and $Z_{13}'$, $R_{12}$ and $R_{13}$ each represents an alkyl group, an aryl group or a heterocyclic group, and $M_2$ and $m_2$ have the same meanings as in formula (II), provided that at least one of $R_{12}$ and $R_{13}$ has an anionic substituent;

(II-3)

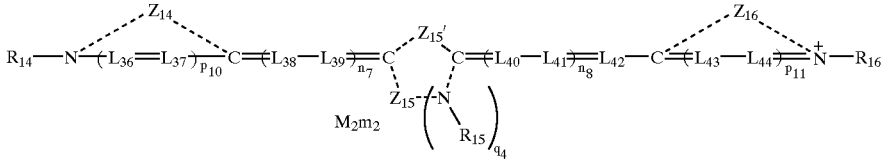

wherein $L_{36}$, $L_{37}$, $L_{38}$, $L_{39}$, $L_{40}$, $L_{41}$, $L_{42}$, $L_{43}$ and $L_{44}$ each represents a methine group, $p_{10}$ and $p_{11}$ each represents 0 or 1, $q_4$ represents 0 or 1, $n_7$ and $n_8$ each represents 0, 1, 2, 3 or 4, $Z_{14}$ and $Z_{16}$ each represents an atomic group necessary for forming a nitrogen-containing heterocyclic ring, $Z_{15}$ and $Z_{15}'$ each represents an atomic group necessary for forming a heterocyclic ring together with $(N—R_{15})_{q4}$, provided that a ring may be condensed to $Z_{14}$, $Z_{15}$, $Z_{15}'$ and $Z_{16}$, $R_{14}$, $R_{15}$ and $R_{16}$ each represents an alkyl group, an aryl group or a heterocyclic group, and $M_2$ and $m_2$ have the same meanings as in formula (II), provided that at least two of $R_{14}$, $R_{15}$ and $R_{16}$ have an anionic substituent.

In the case where the compound represented by formula (I-1), (I-2) or (I-3) is used alone, at least one and preferably both of $R_3$ and $R_4$ is(are) a group having an aromatic ring, at least one and preferably both of $R_5$ and $R_6$ is(are) a group having an aromatic ring, and at least one, preferably two and more preferably all three of $R_7$, $R_8$ and $R_9$ is(are) a group having an aromatic ring.

In the case where the compound represented by formula (I-1), (I-2) or (I-3) and the compound represented by formula (II-1), (II-2) or (II-3) are used in combination, at least one, preferably two, more preferably three and still more preferably four or more of $R_3$ to $R_9$ and $R_{10}$ to $R_{16}$ of the dyes combined is(are) a group having an aromatic group.

By the above-described preferred methods, a silver halide grain having a spectral absorption maximum wavelength of less than 500 nm and a light absorption intensity of 60 or more or having a spectral absorption maximum wavelength of 500 nm or more and a light absorption intensity of 100 or more can be obtained. However, the dye of the second layer is usually adsorbed in the monomer state and the absorption width and the spectral sensitivity width thereof are broader than respective desired ranges in most cases. For realizing high sensitivity in the desired wavelength region, the dye adsorbed as the second layer must form a J-aggregate. The J-aggregate is high in the fluorescence yield and small in the Stokes' shift and therefore, is advantageous in transferring the light energy absorbed by the dye of the second layer to the dye of the first layer, which are approximated in the light absorption wavelength, utilizing the Forster-type energy transfer.

In the present invention, the dye of the second or upper layer means a dye which is adsorbed to a silver halide grain but not adsorbed directly to the silver halide.

In the present invention, the J-aggregate of the dye of the second or upper layer is defined as an aggregate such that the absorption width in the longer wavelength side of absorption shown by a dye adsorbed as the second or upper layer is 2 times or less the absorption width in the longer wavelength side of absorption shown by the dye solution in the monomer state having no interaction between dye chromophores. The absorption width in the longer wavelength side as used herein means an energy width between the absorption maximum wavelength and a wavelength being longer than the absorption maximum wavelength and showing absorption as small as ½ of the absorption maximum. It is well-known that when a J-aggregate is formed, the absorption width in the longer wavelength side is generally reduced as compared with the monomer state. When a dye is adsorbed as the second layer in the monomer state, the absorption width increases as large as 2 times or more the absorption width in the longer wavelength side of absorption shown by the dye solution in the monomer state, because the adsorption site and the adsorption state are not uniform. Accordingly, the J-aggregate of the dye of the second or upper layer can be defined as above.

The spectral absorption of a dye adsorbed as the second or upper layer can be determined by subtracting the spectral absorption attributable to the first layer dye from the entire spectral absorption of the emulsion.

The spectral absorption attributable to the first layer dye can be determined by measuring the absorption spectrum when only the first layer dye is added. The spectral absorption spectrum attributable to the first layer dye may also be measured by adding a dye desorbing agent to the emulsion having adsorbed thereto a sensitizing dye in multiple layers and thereby desorbing the dyes in the second or upper layers.

In the experiment of desorbing dyes from the grain surface using a dye desorbing agent, the first layer dye is usually desorbed after the dyes in the second or upper layers are desorbed. Therefore, by selecting appropriate desorption conditions, the spectral absorption attributable to the first layer dye can be determined and thereby the spectral absorption of the dyes in the second or upper layers can be determined. The method of using a dye desorbing agent is described in Asanuma et al., *Journal of Physical Chemistry B*, Vol. 101, pp. 2149–2153 (1997).

In order to form a J-aggregate of the second layer dye using the cationic dye, betaine dye or nonionic dye represented by formula (I) and the anionic dye represented by formula (II), the dye adsorbed to form the first layer and the dye adsorbed to form the second or upper layer are preferably added separately and it is more preferred that the dye used for the first layer and the dye used for the second or upper layer have different structures. For the dye of the second or upper layer, a cationic dye, a betaine dye or a nonionic dye alone or a combination of a cationic dye and an anionic dye is preferably added.

For the first layer dye, any dye may be used but the dye represented by formula (I) or (II) is preferred and the dye represented by formula (I) is more preferred.

For the second layer dye, the cationic dye, betaine dye or nonionic dye represented by formula (I) is preferably used alone. In the case of using a cationic dye and an anionic dye in combination which is another preferred embodiment of the second layer dye, either one of the dyes used is preferably the cationic dye represented by formula (I) or the anionic dye represented by formula (II), and it is more preferred that the cationic dye represented by formula (I) and the anionic dye represented by formula (II) both are contained. The ratio of cationic dye/anionic dye as the second layer dye is preferably from 0.5 to 2, more preferably from 0.75 to 1.33, most preferably from 0.9 to 1.11.

In the present invention, a dye other than the dyes represented by formulae (I) and (II) may be added, however, the dye represented by formula (I) or (II) preferably occupies 50% or more, more preferably 70% or more, most preferably 90% or more, of the total amount of dyes added.

By adding the second layer dye as such, the interaction between second layer dyes can be increased while promoting the rearrangement of second layer dyes and thereby, the J-aggregate can be formed.

In the case of using the dye represented by formula (I) or (II) as the first layer dye, $Z_1$ and $Z_2$ each is preferably a basic nucleus substituted by an aromatic group or a basic nucleus resulting from the condensation of three or more rings. In the case of using the dye represented by formula (I) or (II) as the dye of the second or upper layer, $Z_1$ and $Z_2$ each is preferably a basic nucleus resulting from the condensation of three or more rings.

The number of rings condensed in the basic nucleus is, for example, 2 in the benzoxazole nucleus and 3 in the naphthoxazole nucleus. Even if the benzoxazole nucleus is substituted by a phenyl group, the number of rings condensed is 2. The basic nucleus resulting from the condensation of three or more rings may be any as long as it is a polycyclic condensation-type heterocyclic basic nucleus obtained by the condensation of three or more rings, however, a tricyclic condensation-type heterocyclic ring and a tetracyclic condensation-type heterocyclic ring are preferred. Preferred examples of the tricyclic condensation-type heterocyclic ring include naphtho[2,3-d]-oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]imidazole, naphtho[2,1-d]imidazole, naphtho[2,3-d]selenazole, naphtho[1,2-d]selenazole, naphtho[2,1-d]selenazole, indolo[5,6-d]oxazole, indolo[6,5-d]oxazole, indolo[2,3-d]oxazole, indolo[5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole and benzothieno[2,3-d]oxazole. Preferred examples of the tetracyclic condensation-type heterocyclic ring include anthra[2,3-d]oxazole, anthra[1,2-d]oxazole, anthra-[2,1-d]oxazole, anthra[2,3-d]thiazole, anthra[1,2-d]thiazole, phenanthro[2,1-d]thiazole, phenanthro[2,3-d]imidazole, anthra[1,2-d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo[7,6-d]oxazole, dibenzothieno[3,2-d]thiazole, dibenzothieno[3,2-d]thiazole and tetrahydrocarbazolo[6,7-d]thiazole. More preferred examples of the basic nucleus resulting from the condensation of three or more rings include naphtho[2,3-d]oxazole, naphtho[1,2-d]oxazole, naphtho[2,1-d]oxazole, naphtho[2,3-d]thiazole, naphtho[1,2-d]thiazole, naphtho-[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole. Among these, still more preferred are naphtho[2, 3-d]oxazole, naphtho[1,2-d]oxazole, naphtho[2,3-d]thiazole, indolo[5,6-d]oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

In formulae (I) and (II), $Q_1$ and $Q_2$ each represents a group necessary for forming a methine dye. By the groups $Q_1$ and $Q_2$, any methine dye can be formed but examples thereof include methine dyes described above as examples of the dye chromophore.

Among those, preferred are cyanine dyes, merocyanine dyes, rhodacyanine dyes, trinuclear merocyanine dyes, tetranuclear merocyanine dyes, allopolar dyes, hemicyanine dyes and styryl dyes, more preferred are cyanine dyes, merocyanine dyes and rhodacyanine dyes, still more preferred are cyanine dyes. These dyes are described in detail, for example, in F. M. Harmer, *Heterocyclic Compounds—Cyanine Dyes and Related Compounds*, John Wiley & Sons, New York, London (1964), and D. M. Sturmer, *Heterocyclic Compounds—Special topics in heterocyclic chemistry*, Chap. 18, Section 14, pp. 482–515.

Examples of the formulae of preferred dyes include formulae described in U.S. Pat. No. 5,994,051, pages 32 to 36, and formulae described in U.S. Pat. No. 5,747,236, pages 30 to 34. For cyanine dyes, merocyanine dyes and rhodacyanine dyes, formulae (XI), (XII) and (XIII) described in U.S. Pat. No. 5,340,694, columns 21 to 22, are preferred (on the condition that the numbers in n12, n15, n17 and n18 are not limited and each is an integer of 0 or more (preferably 4 or less)).

In the case where a cyanine dye or a rhodacyanine dye is formed by $Q_1$ or $Q_2$, formulae (I) and (II) may be expressed by the following resonance formulae:

(I)

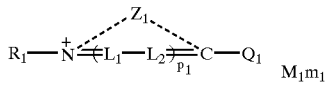

$M_1m_1$ (II)

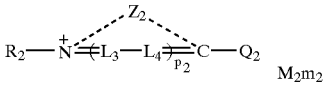

$M_2m_2$

In formulae (I), (II), (I-1), (I-2), (I-3), (II-1), (II-2) and (II-3), $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ each represents an atomic group necessary for forming a nitrogen-containing heterocyclic ring, preferably a 5- or 6-membered nitrogen-containing heterocyclic ring. However, a ring may be condensed thereto. The ring may be either an aromatic ring or a non-aromatic ring, but an aromatic ring is preferred and examples thereof include hydrocarbon aromatic rings such as benzene ring and naphthalene ring, and heteroaromatic rings such as pyrazine ring and thiophene ring.

Examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus; more preferred are benzothiazole nucleus, benzoxazole nucleus, 3,3-dialkylindolenine nucleus (e.g., 3,3-dimethylindolenine) and benzimidazole nucleus; still more preferred are benzoxazole nucleus, benzothiazole nucleus and benzimidazole nucleus; and most preferred are benzoxazole nucleus and benzothiazole nucleus.

The substituent W described above may be present on the nitrogen-containing heterocyclic ring.

Among the above-described substituents, preferred are an alkyl group, an aryl group, an alkoxy group, a halogen atom, an aromatic ring condensation, a sulfo group, a carboxy group and a hydroxy group.

The substituent V on $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ is more preferably an aromatic group or an aromatic ring condensation.

The triplet $Z_6$, $Z_6'$ and $(N—R_6)_{q1}$ and the triplet $Z_{13}$, $Z_{13}'$ and $(N—R_{13})_{q3}$ each together represents an atomic group necessary for forming a heterocyclic or acyclic acidic terminal group. Any heterocyclic ring (preferably a 5- or 6-membered heterocyclic ring) may be formed but an acidic nucleus is preferred. The acidic nucleus and the acyclic acidic terminal group are described below. The acidic nucleus and the acyclic acidic terminal group each may have any acidic nucleus or acyclic acidic terminal group form of general merocyanine dyes. In preferred forms, $Z_6$ and $Z_{13}$ each is a thiocarbonyl group, a carbonyl group, an ester group, an acyl group, a carbamoyl group, a cyano group or a sulfonyl group, more preferably a thiocarbonyl group or a carbonyl group. $Z_6'$ and $Z_{13}'$ each represents a remaining atomic group necessary for forming an acidic nucleus or an acyclic acidic terminal group. In the case of forming an acyclic acidic terminal group, $Z_6'$ and $Z_{13}'$ each is preferably a thiocarbonyl group, a carbonyl group, an ester group, an acyl group, a carbamoyl group, a cyano group or a sulfonyl group.

$q_1$ and $q_3$ each is 0 or 1, preferably 1.

The "acidic nucleus and acyclic acidic terminal group" as used herein are described, for example, in James (compiler), *The Theory of the Photographic Process*, 4th ed., pp. 198–200, Macmillan (1977). The acyclic acidic terminal group as used herein means an acidic, namely, electron-accepting terminal group which does not form a ring.

Specific examples of the acidic nucleus and acyclic acidic terminal group include those described in U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acidic nucleus preferably forms a heterocyclic ring (preferably a 5- or 6-membered nitrogen-containing heterocyclic ring) comprising carbon, nitrogen and/or chalcogen (typically oxygen, sulfur, selenium and tellurium) atoms, more preferably a 5- or 6-membered nitrogen-containing heterocyclic ring comprising carbon, nitrogen and/or chalcogen (typically oxygen, sulfur, selenium and tellurium) atoms. Specific examples thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide;

nuclei having an exomethylene structure in which the carbonyl or thiocarbonyl group constituting the above-described nuclei is substituted at the active methylene position of the acidic nucleus; and nuclei having an exomethylene structure in which the carbonyl or thiocarbonyl group constituting the above-described nuclei is substituted at the active methylene position of an active methylene compound having a structure such as ketomethylene or cyanomethylene as a starting material of the acyclic acidic terminal group.

These acidic nuclei and acyclic acidic terminal groups each may be substituted by or condensed with the substituent or ring described above for the substituent V.

The triplet $Z_6$, $Z_6'$ and $(N—R_6)_{q1}$ and the triplet $Z_{13}$, $Z_{13}'$ and $(N—R_{13})_{q3}$ each preferably forms hydantoin, 2- or 4-thiohydantoin, 2-oxazolin-5-one, 2-thiooxazolin-2,4-dione, thiazolidine-2,4-dione, rhodanine, thiazolidine-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid, still more preferably 2- or 4-thiohydantoin, 2-oxazolin-5-one, rhodanine or barbituric acid.

Examples of the heterocyclic ring formed by the triplet $Z_8$, $Z_8'$ and $(N—R_8)_{q2}$ and by the triplet $Z_{15}$, $Z_{15}'$ and $(N—R_{15})_{q4}$ are the same as those described for the heterocyclic ring formed by the triplet $Z_6$, $Z_6'$ and $(N—R_6)_{q1}$ and by the triplet $Z_{13}$, $Z_{13}'$ and $(N—R_{13})_{q3}$. Among these, preferred are the acidic nuclei described above for the heterocyclic ring formed by the triplet $Z_6$, $Z_6'$ and $(N—R_6)_{q1}$ and by the triplet $Z_{13}$, $Z_{13}'$ and $(N—R_{13})_{q3}$, from which an oxo group or a thioxo group is removed More preferred are the acidic nuclei described above as specific examples of the heterocyclic ring formed by the triplet $Z_6$, $Z_6'$ and $(N—R_6)_{q1}$ and by the triplet $Z_{13}$, $Z_{13}'$ and $(N—R_{13})_{q3}$, from which an oxo group or a thioxo group is removed.

Still more preferred are hydantoin, 2- or 4-thiohydantoin, 2-oxazolin-5-one, 2-thiooxazolin-2,4-dione, thiazolidine-2,4-dione, rhodanine, thiazolidine-2,4-dione, barbituric acid and 2-thiobarbituric acid, from which an oxo group or a thioxo group is removed; particularly preferred are hydantoin, 2- or 4-thiohydantoin, 2-oxazolin-5-one, rhodanine, barbituric acid and 2-thiobarbituric acid, from which an oxo group or a thioxo group is removed; and most preferred are 2- or 4-thiohydantoin, 2-oxazolin-5-one and rhodanine, from which an oxo group or a thioxo group is removed.

$q_2$ and $q_4$ each is 0 or 1, preferably 1.

$R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$ and $R_{16}$ each represents an alkyl group, an aryl group or a heterocyclic group.

Specific examples thereof include groups for $Ra_1$ to $Ra_3$ described above.

$R_1$, $R_3$, $R_4$, $R_5$, $R_6$, $R_7$, $R_8$ and $R_9$ each is preferably a group having an aromatic ring. Examples of the aromatic ring include a hydrocarbon aromatic ring and a heteroaromatic ring. These rings each may be a polycyclic condensed ring resulting from the condensation of hydrocarbon aromatic rings or heteroaromatic rings to each other, or a polycyclic condensed ring resulting from the combining of an aromahydrocarbon ring and an aromatic heterocyclic ring, and may be substituted by the above-described substituent V or the like. Preferred examples of the aromatic ring include those described above as examples of the aromatic ring for the aromatic group.

The group having an aromatic ring can be represented by -Lb-$A_1$, wherein Lb represents a single bond or a linking group, and $A_1$ represents an aromatic group. Preferred examples of the linking group represented by Lb include the linking groups described in JP-A-2001-152038. Preferred examples of the aromatic group represented by $A_1$ include those described above as examples of the aromatic group.

Preferred examples of the alkyl group having a hydrocarbon aromatic ring include an aralkyl group (e.g., benzyl, 2-phenylethyl, naphthylmethyl, 2-(4-biphenyl)ethyl), an aryloxyalkyl group (e.g., 2-phenoxyethyl, 2-(1-naphthoxy)ethyl, 2-(4-biphenyloxy)ethyl, 2-(o-, m- or p-halophenoxy)ethyl, 2-(o-, m- or p-methoxyphenoxy)ethyl) and an aryloxycarbonylalkyl group (e.g., 3-phenoxycarbonylpropyl, 2-(1-naphthoxycarbonyl)ethyl). Preferred examples of the alkyl group having a heteroaromatic ring include 2-(2-pyridyl)ethyl, 2-(4-pyridyl)ethyl, 2-(2-furyl)ethyl, 2-(2-thienyl)ethyl and 2-(2-pyridylmethoxy)ethyl. Examples of the hydrocarbon aromatic group include 4-methoxyphenyl, phenyl, naphthyl and biphenyl, and examples of the heteroaromatic group include 2-thienyl, 4-chloro-2-thienyl, 2-pyridyl and 3-pyrazolyl.

Among those, more preferred is the substituted or unsubstituted alkyl group having a hydrocarbon aromatic ring or heteroaromatic ring, still more preferred is the substituted or unsubstituted alkyl group having a hydrocarbon aromatic ring.

$R_2$, $R_{10}$, $R_{11}$, $R_{12}$, $R_{13}$, $R_{14}$, $R_{15}$ and $R_{16}$ each is preferably a group having an aromatic ring. Both of $R_{10}$ and $R_{11}$, at least one of $R_{12}$ and $R_{13}$, and at least two of $R_{14}$, $R_{15}$ and $R_{16}$ have an anionic substituent. $R_2$ preferably has an anionic substituent. Examples of the aromatic ring include a hydrocarbon aromatic ring and a heteroaromatic ring. These rings each may be a polycyclic condensed ring resulting from the condensation of hydrocarbon aromatic rings or heteroaromatic rings to each other, or a polycyclic condensed ring resulting from the combining of an aromahydrocarbon ring and an aromatic heterocyclic ring, and may be substituted by the above-described substituent V or the like. Preferred examples of the aromatic ring include those described above as examples of the aromatic ring for the aromatic group.

The group having an aromatic ring can be represented by -Lc-$A_2$, wherein Lc represents a single bond or a linking group, and $A_2$ represents an aromatic group. Preferred examples of the linking group represented by Lc include the linking groups described in JP-A-2001-152038. Preferred examples of the aromatic group represented by $A_2$ include those described above as examples of the aromatic group. Lc or $A_2$ is preferably substituted by at least one anionic substituent.

Preferred examples of the alkyl group having a hydrocarbon aromatic ring include an aralkyl group substituted by a sulfo group, a phosphoric acid group or a carboxyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), an aryloxycarbonylalkyl group substituted by a sulfo group, a phosphoric acid group or a carboxyl group (e.g., 3-sulfophenoxycarbonylpropyl) and an aryloxyalkyl group substituted by a sulfo group, a phosphoric acid group or a carboxyl group (e.g., 2-(4-sulfophenoxy)ethyl, 2-(2-phosphophenoxy)ethyl, 4,4-diphenoxy-3-sulfobutyl).

Preferred examples of the alkyl group having a heteroaromatic ring include 3-(2-pyridyl)-3-sulfopropyl, 3-(2-furyl)-3-sulfopropyl and 2-(2-thienyl)-2-sulfopropyl.

Examples of the hydrocarbon aromatic group include an aryl group substituted by a sulfo group, a phosphoric acid group or a carboxyl group (e.g., 4-sulfophenyl, 4-sulfonaphthyl). Examples of the heteroaromatic group include a heterocyclic group substituted by a sulfo group, a phosphoric acid group or a carboxyl group (e.g., 4-sulfo-2-thienyl, 4-sulfo-2-pyridyl).

Among those, more preferred is the alkyl group having a hydrocarbon aromatic ring or heteroaromatic ring substituted by a sulfo group, a phosphoric acid group or a carboxyl group, still more preferred is the alkyl group having a hydrocarbon aromatic ring substituted by a sulfo group, a phosphoric acid group or a carboxyl group, and most preferred are 2-sulfobenzyl, 4-sulfobenzyl, 4-sulfophenethyl, 3-phenyl-3-sulfopropyl and 4-phenyl-4-sulfobutyl.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$ and $L_{44}$ each independently represents a methine group. The methine group represented by $L_1$ to $L_{44}$ may have a substituent. Examples of the substituent include V described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). A ring may be formed with another methine group or a ring may be formed together with $Z_1$ to $Z_{16}$ or $R_1$ to $R_{16}$.

$L_1$, $L_2$, $L_3$, $L_4$, $L_5$, $L_6$, $L_{10}$, $L_{11}$, $L_{12}$, $L_{13}$, $L_{16}$, $L_{17}$, $L_{23}$, $L_{24}$, $L_{25}$, $L_{26}$, $L_{30}$, $L_{31}$, $L_{32}$, $L_{33}$, $L_{36}$, $L_{37}$, $L_{43}$ and $L_{44}$ each is preferably an unsubstituted methine group.

$n_1$, $n_2$, $n_3$, $n_4$, $n_5$, $n_6$, $n_7$ and $n_8$ each independently represents 0, 1, 2, 3 or 4, preferably 0, 1, 2 or 3, more preferably 0, 1 or 2, still more preferably 0 or 1. When $n_1$, $n_2$, $n_3$, $n_4$, $n_5$, $n_6$, $n_7$ and $n_8$ each is 2 or more, the methine group is repeated but these methine groups need not be the same.

$p_1$, $p_2$, $p_3$, $p_4$, $p_5$, $p_6$, $p_7$, $p_8$, $p_9$, $p_{10}$, $p_{11}$ and $p_{12}$ each independently represents 0 or 1, preferably 0.

$M_1$ and $M_2$ each is included in the formulae so as to show the presence of a cation or an anion when required for neutralizing the ion charge of the dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite to the dye may be used. When the counter ion is hydrogen ion, $CO_2^-$ and $SO_3^-$ may be denoted as $CO_2H$ and $SO_3H$, respectively.

$m_1$ and $m_2$ each represents a number of 0 or more necessary for balancing the electric charge, preferably a number of 0 to 4, more preferably from 0 to 1, and when an inner salt is formed, $m_1$ and $m_2$ each is 0.

Specific examples only of the dyes used in preferred techniques described in the Detailed Description of the Invention are set forth below, however, needless to say, the present invention is not limited thereto.

Specific examples of the dye capable of greatly changing in the adsorption strength by the change of pH, which is most preferred, are described below, however, the present invention is of course not limited thereto.

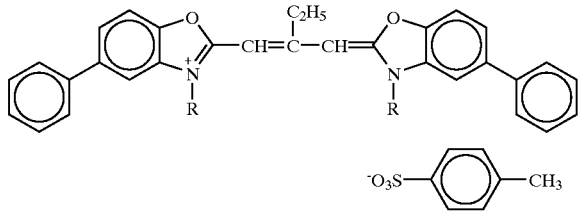

No. 1

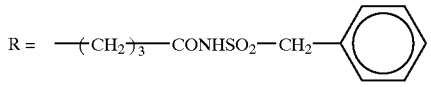

No. 2

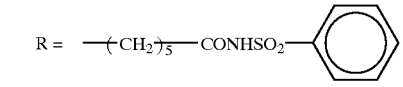

No. 3

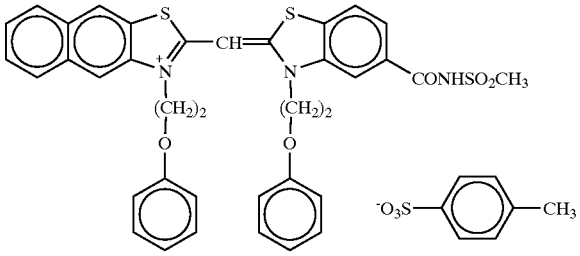

No.4

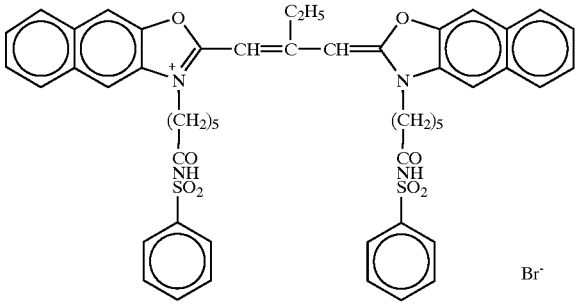

No. 5

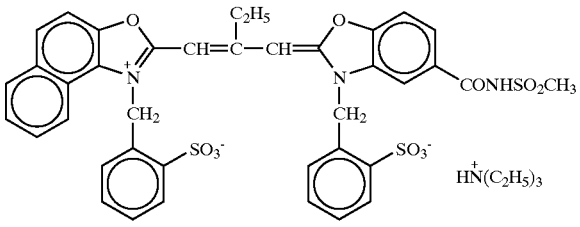

No. 6

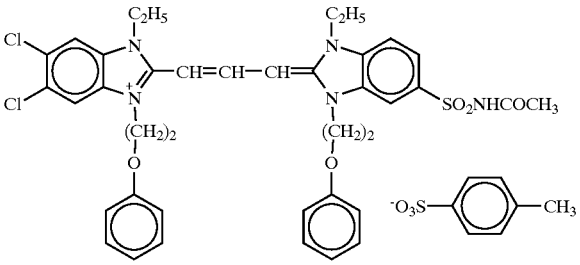

-continued
No. 7
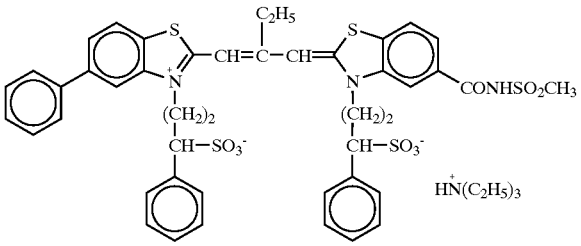
No. 8
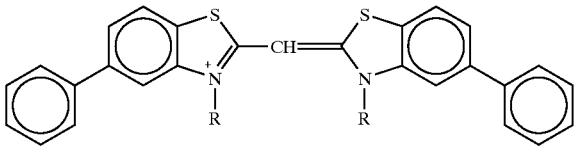
No. 9
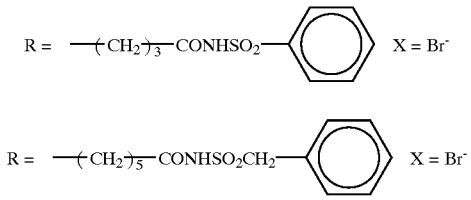
Specific examples of the dye which is preferably used simultaneously with the above-described dye are set forth below, however, the present invention is of course not limited thereto.
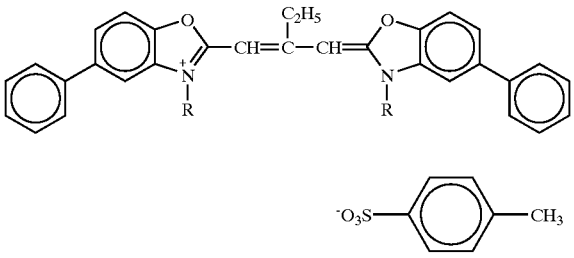
No. 11
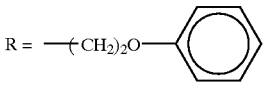
No. 12
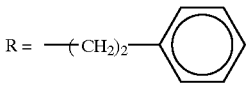
No. 13
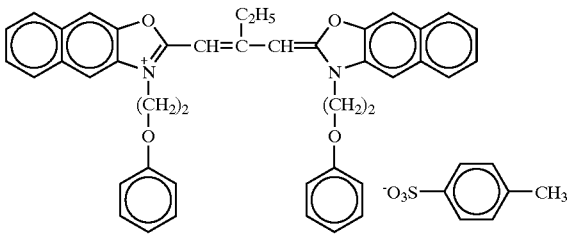
-continued
No. 14
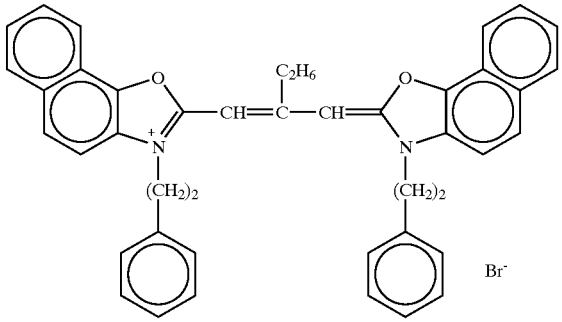
No. 15
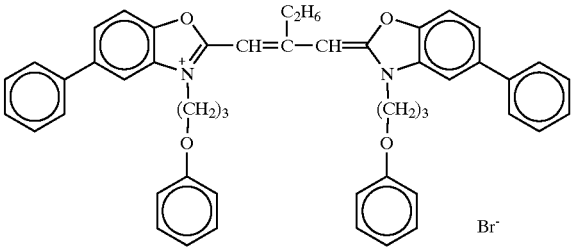
No. 16
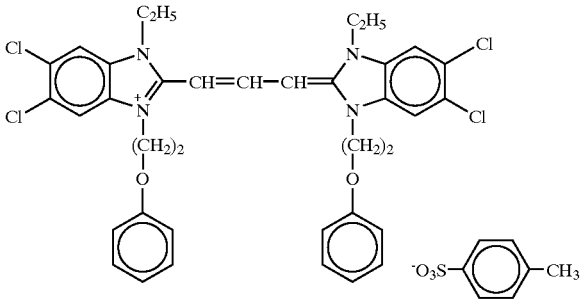
No. 17
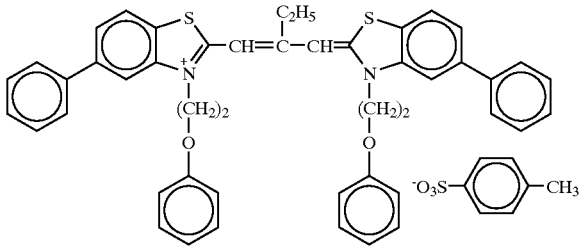
No. 18
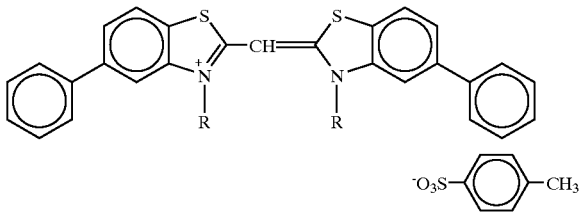
No. 19
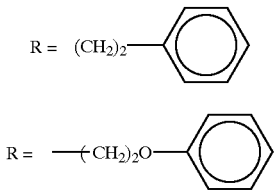

-continued
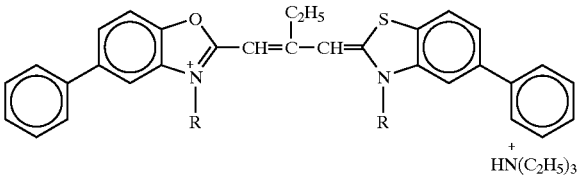
No. 21
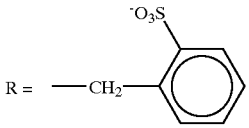
No. 22
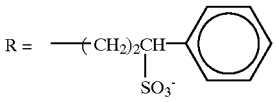
No. 23
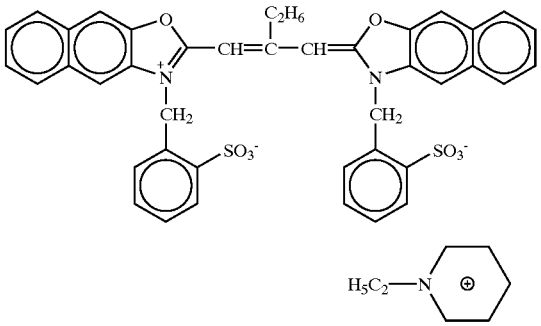
No. 24
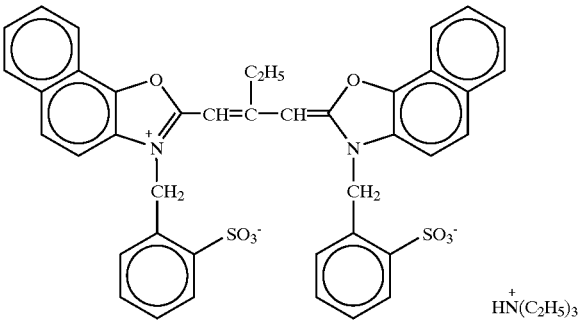
No. 25
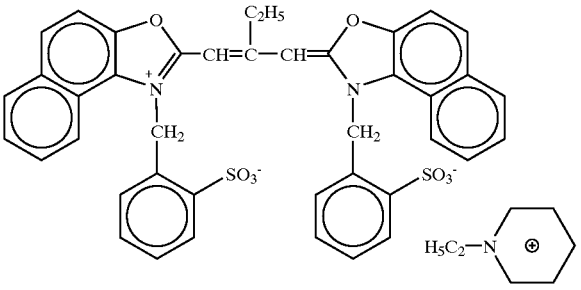
-continued
No. 26
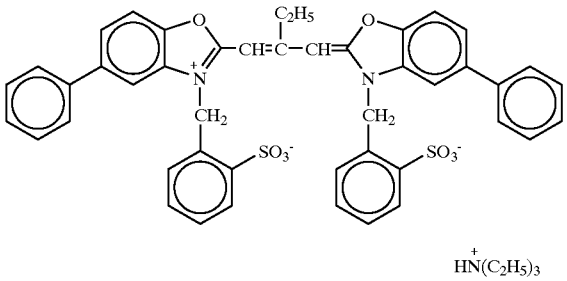
No. 27
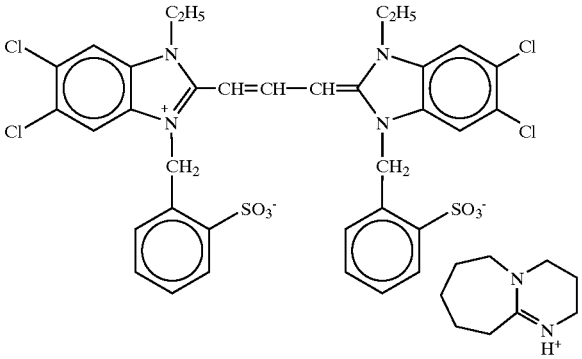
No. 28
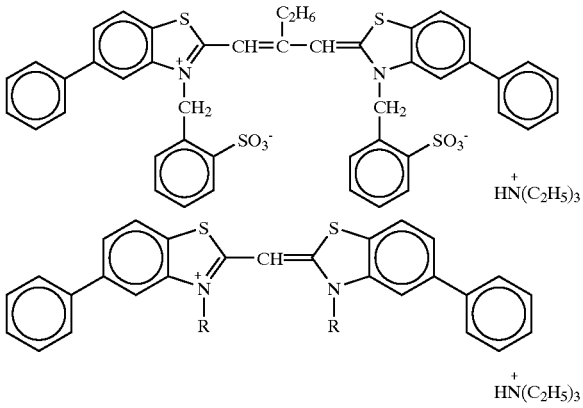
No. 29
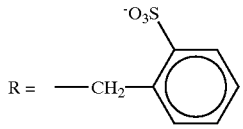
No. 30
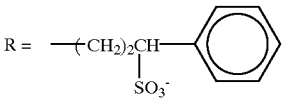
The dyes of the present invention can be synthesized by the methods described in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic*

*chemistry*, Chap. 18, Sec. 14, pp. 482–515, John Wiley & Sons, New York, London (1977), *Rodd's Chemistry of Carbon Compounds,* 2nd ed., Vol. IV, Part B, Chap. 15, pp. 369–422, Elsevier Science Publishing Company Inc., New York (1977), and patents and publications described above (cited for describing specific examples).

The dyes for use as a sensitizing dye of the present invention may be used individually or in combination.

The present invention is not limited only to the use of sensitizing dyes of the present invention but a sensitizing dye other than those of the present invention may also be used in combination. Preferred examples of the dye which can be used in combination include cyanine dyes, merocyanine dyes, rhodacyanine dyes, trinuclear merocyanine dyes, tetranuclear merocyanine dyes, allopolar dyes, hemicyanine dyes and styryl dyes. Among these, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds*, John Wiley & Sons, New York, London (1964), and D. M. Sturmer, *Heterocyclic Compounds—Special topics in heterocyclic chemistry*, Chap. 18, Section 14, pp. 482–515.

Examples of preferred dyes include the sensitizing dyes represented by the formulae or described as specific examples in U.S. Pat. No. 5,994,051, pp. 32–44, and U.S. Pat. No. 5,747,236, pp. 30–39.

For cyanine dyes, merocyanine dyes and rhodacyanine dyes, formulae (XI), (XII) and (XIII) described in U.S. Pat. No. 5,340,694, columns 21 to 22, are preferred (on the condition that the numbers in n12, n15, n17 and n18 are not limited and each is an integer of 0 or more (preferably 4 or less)).

These sensitizing dyes may be used either individually or in combination of two or more thereof. The combination of sensitizing dyes is often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patent 1,344,281 and 1,507,803, JP-B-43-49336 (the term "JP-B" as used herein means an "examined Japanese patent publication"), JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

The supersensitizing agent (for example, pyrimidylamino compounds, triazinylamino compounds, azolium compounds, aminostyryl compounds, aromatic organic acid formaldehyde condensate, azaindene compounds, cadmium salts) which is usefully used simultaneously with the dye for use as the sensitizing dye of the present invention, and the combination of a supersensitizing agent and a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510 and 3,617,295. With respect to the use method thereof, those described in these patents are also preferred.

The dye for use as the sensitizing dye of the present invention (the same applies to other sensitizing dyes and supersensitizing agents) may be added to the silver halide emulsion of the present invention in any process during the preparation of the emulsion, which is heretofore known useful. The addition may be performed at any time or step as long as it is before the coating of the emulsion, for example, during the formation and/or before the desalting of silver halide grains, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. No. 4,225,666 and JP-A-58-7629, the same compound solely or in combination with a compound having a foreign structure may be added in parts, for example, during the grain formation and during or after the completion of chemical ripening, or before or during the chemical ripening and after the completion of chemical ripening. When added in parts, the kind of the compound or the combination of compounds may be varied.

The amount added of the dye for use as the sensitizing dye of the present invention (the same applies to other sensitizing dyes and supersensitizing dyes) varies depending on the shape and size of silver halide grain and the dye may be added in any amount, however, the sensitizing dye can be used preferably in an amount of $1\times10^{-8}$ to $8\times10^{-1}$ mol per mol of silver halide. For example, when the silver halide grain size is from 0.2 to 1.3 $\mu$m, the amount added is preferably from $2\times10^{-6}$ to $3.5\times10^{-3}$, more preferably from $7.5\times10^{-6}$ to $1.5\times10^{-3}$ mol, per mol of silver halide.

The dye for use as the sensitizing dye of the present invention (the same applies to other sensitizing dyes and supersensitizing dyes) can be dispersed directly in the emulsion or can be added to the emulsion in the form of a solution after dissolving the dye in an appropriate solvent such as methyl alcohol, ethyl alcohol, methyl cellosolve, acetone, water or pyridine or in a mixed solvent thereof. At this time, additives such as base, acid or surfactant can be added and allowed to be present together. For dissolving the dye, an ultrasonic wave may also be used. With respect to the addition method of the compound, a method of dissolving the compound in a volatile organic solvent, dispersing the solution in a hydrophilic colloid and adding the dispersion to the emulsion described in U.S. Pat. No. 3,469,987, a method of dispersing the compound in a water-soluble solvent and adding the dispersion to the emulsion described in JP-B-46-24185, a method of dissolving the compound in a surfactant and adding the solution to the emulsion described in U.S. Pat. No. 3,822,135, a method of dissolving the compound using a compound capable of red shifting and adding the solution to the emulsion described in JP-A-51-74624, and a method of dissolving the compound in an acid substantially free of water and adding the solution to the emulsion described in JP-A-50-80826 may be used. In addition, for the addition to the emulsion, the methods described in U.S. Pat. Nos. 2,912,343, 3,342,605, 2,996,287 and 3,429,835 may be used.

For the photographic emulsion undertaking the photosensitive mechanism in the present invention, any of silver bromide, silver iodobromide, silver chlorobromide, silver iodide, silver iodochloride, silver iodobromochloride and silver chloride may be used as silver halide. The halogen composition may be changed depending on the portion of a silver halide grain, but a group different in the silver halide composition between the surface and the inside is preferred. The grain size distribution may be either broad or narrow but narrow distribution is preferred.

The silver halide grain of the photographic emulsion may be a grain having a regular crystal form such as cubic, octahedral, tetradecahedral or rhombic dodecahedral form, a grain having an irregular crystal form such as spherical or tabular form, a grain having a hkl plane, or a mixture of grains having these crystal forms, however, a tabular grain is preferred. The tabular grain is described in detail later. The grain having a high-order face is described in *Journal of Imaging Science*, Vol. 30, pp. 247–254 (1986).

In the silver halide photographic emulsion for use in the present invention, the above-described silver halide grains may be contained individually or a plurality of the silver halide grains may be contained as a mixture. The silver halide grain may have different phases between the interior and the surface layer, may have a multi-phase structure, for example, with a junction structure, may have a localized phase on the grain surface, or may have a uniform phase throughout the grain. These grains may also be present in combination.

These various emulsions each may be either a surface latent image-type emulsion in which a latent image is mainly formed on the surface, or an internal latent image-type emulsion in which a latent image is formed inside the grain.

In the present invention, a silver halide tabular grain having a halogen composition of silver chloride, silver bromide, silver chlorobromide, silver iodobromide, silver chloroiodobromide or silver iodochloride is preferably used. The tabular grain preferably has a (100) main surface or a (111) main surface. The tabular grain having a (111) main surface is hereinafter referred to as a (111) tabular grain and this grain usually has a triangular or hexangular face. In general, when the distribution becomes more uniform, tabular grains having a hexangular face occupy a higher ratio. JP-B-5-61205 describes the monodisperse hexangular tabular grains.

The tabular grain having a (100) face as the main surface is hereinafter called a (100) tabular grain and this grain has a rectangular or square form. In the case of this emulsion, a grain having a ratio of adjacent sides of less than 5:1 is called a tabular grain rather than an acicular grain. When the tabular grain is a silver chloride grain or a grain having a large silver chloride content, the (100) tabular grain is higher in the stability of the main surface than the (111) tabular grain. The (111) tabular grain must be subjected to stabilization of the (111) main surface and the method therefor is described in JP-A-9-80660, JP-A-9-80656 and U.S. Pat. No. 5,298,388.

The (111) tabular grain comprising silver chloride or having a high silver chloride content for use in the present invention is disclosed in the following patents:

U.S. Pat. Nos., 4,414,306, 4,400,463, 4,713,323, 4,783,398, 4,962,491, 4,983,508, 4,804,621, 5,389,509, 5,217,858 and 5,460,934.

The (111) tabular grain having a high silver bromide content for use in the present invention is described in the following patents:

U.S. Pat. Nos. 4,425,425, 4,425,426, 4,434,26, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grain for use in the present invention is described in the following patents: U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsion for use in the present invention is preferably a tabular silver halide grain having adsorbed thereto a sensitizing dye disclosed in the present invention and having a higher surface area/volume ratio. The aspect ratio is preferably 2 or more, more preferably 5 or more, still more preferably 8 or more. The upper limit is not particularly limited but is preferably 1,000 or less, more preferably 500 or less. The thickness of the tabular grain is preferably less than 0.2 $\mu$m, more preferably less than 0.1 $\mu$m, still more preferably less than 0.07 $\mu$m.

The "aspect ratio is 2 or more" as used herein means that silver halide grains having an aspect ratio (equivalent-circle diameter of silver halide grain/thickness of grain) of 2 or more are present in a proportion of 50% or more of the projected area of all silver halide grains in the emulsion. In the emulsion, silver halide grains having an aspect ratio of 2 or more are preferably present in a proportion of 70% or more, more preferably 85% or more.

For preparing a tabular grain having such a high aspect ratio and a small thickness, the following technique is applied.

The tabular grain for use in the present invention is preferably uniform in the dislocation line amount distribution among grains. In the emulsion of the present invention, silver halide grains having 10 or more dislocation lines per one grain preferably occupy from 50 to 100% (by number), more preferably from 70 to 100%, still more preferably from 90 to 100%, of all grains. If this ratio is less than 50%, disadvantageous results come out in view of homogeneity among grains.

In the present invention, when determining the ratio of grains having a dislocation line and the number of dislocation lines, the dislocation line is preferably observed directly on at least 100 grains, more preferably 200 grains or more, still more preferably 300 grains or more.

As a protective colloid used in the preparation of the emulsion of the present invention and as a binder of other hydrophilic colloid layers, gelatin is advantageously used, however, a hydrophilic colloid other than gelatin can also be used.

Examples of other hydrophilic colloids which can be used include proteins such as gelatin derivatives, graft polymers of gelatin to other polymer, albumin and casein; sugar derivatives such as cellulose derivatives (e.g., hydroxyethyl cellulose, carboxymethyl cellulose, cellulose sulfuric acid esters), sodium arginate and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

The gelatin may be a lime-treated gelatin, an acid-treated gelatin or an enzyme-treated gelatin described in *Bull. Soc. Photo. Japan*, No. 16, p. 30 (1966), and a hydrolysate or enzymolysate of gelatin can also be used.

The emulsion of the present invention is preferably washed with water for desilvering to form a newly prepared protective colloid dispersion. The water washing temperature may be selected according to the purpose but is preferably selected in the range from 5° C. to 50° C. The pH at the water washing can also be selected according to the purpose but is preferably selected in the range from 2 to 10, more preferably from 3 to 8. The pAg at the water washing can also be selected according to the purpose but is preferably selected in the range from 5 to 10. The water washing method may be selected from noodle water washing, dialysis using a semi-permeable membrane, centrifugal separation, coagulating precipitation, and ion exchanging. In the case of coagulating precipitation, the method may be selected from a method of using a sulfate, a method of using an organic solvent, a method of using a water-soluble polymer and a method of using a gelatin derivative.

During the preparation of the emulsion of the present invention, a salt of metal ion is preferably allowed to be present according to the purpose, for example, during the grain formation, at the desalting, at the chemical sensitization or before the coating. The metal ion salt is preferably added during the grain formation when it is doped into a grain, and preferably added after the grain formation but before the completion of chemical sensitization when it is used to modify the grain surface or used as a chemical sensitizer. In doping, the metal ion salt may be doped throughout a grain or may be doped only into the core or shell part of a grain. Examples of the metal which can be used in the present invention include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals each may be added if it is in the form of a salt which can be dissolved during the grain formation, such as ammonium salt, acetate, nitrate, sulfate, phosphate, hydroxide, six-coordinate complex salt and four-coordinate complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound may be selected from halo, aco, cyano, cyanate, thiocyanate, nitrosyl, thionitrosyl, oxo and carbonyl. Only one of these metal compounds may be used or two or more of these metal compounds may be used in combination.

The metal compound is preferably added after dissolving it in water or an appropriate organic solvent such as methanol and acetone. In order to stabilize the solution, a method of adding an aqueous solution of hydrogen halide (e.g., HCl, HBr) or an alkali halide (e.g., KCl, NaCl, KBr, NaBr) may be used. If desired, an acid, an alkali or the like may also be added. The metal compound may also be charged into the reaction vessel before the grain formation or may be added during the grain formation. Also, it is possible to add the metal compound to a water-soluble silver salt (e.g., $AgNO_3$) or an aqueous solution of alkali halide (e.g., NaCl, KBr, KI) and then continuously add the solution during the formation of silver halide grains. Furthermore, a solution may be prepared independently of a water-soluble silver salt or an alkali halide and then continuously added in an appropriate timing during the formation of grains. A combination of these various addition methods is also preferred.

A method of adding a chalcogen compound during the preparation of the emulsion described in U.S. Pat. No. 3,772,031 is also useful depending on the case. Other than S, Se and Te, a cyanate, a thiocyanate, a selenocyanic acid, a carbonate, a phosphate or an acetate may also be present in the system.

The silver halide grain of the present invention may be subjected to at least one of sulfur sensitization, selenium sensitization, gold sensitization, palladium sensitization, noble metal sensitization and reduction sensitization at any step during the preparation of the silver halide emulsion. A combination of two or more sensitization methods is preferred. Various types of emulsions can be prepared by varying the step at which the chemical sensitization is performed. Examples thereof include a type where a chemical sensitization speck is embedded inside the grain, a type where a chemical sensitization speck is embedded in the shallow position from the grain surface, and a type where a chemical sensitization speck is formed on the surface. The position of the chemical sensitization speck can be selected according to the purpose. In general, at least one kind of chemical sensitization speck is preferably formed in the vicinity of the grain surface.

One of the chemical sensitization methods which can be preferably performed in the present invention is the sole use of chalcogenide sensitization method or noble metal sensitization method or a combination use thereof. The chemical sensitization may be performed using active gelatin as described in T. H. James, *The Theory of the Photographic Process*, 4th ed., pp. 67–76, Macmillan (1977), or may be performed using sulfur, selenium, tellurium, gold, platinum, palladium, iridium or a combination of two or more of these sensitizing dyes at a pAg of 5 to 10, a pH of 5 to 8 and a temperature of 30 to 80° C. as descried in *Research Disclosure*, Vol. 120, 12008 (April 1974), *Research Disclosure*, Vol. 34, 13452 (June 1975), U.S. Pat. Nos. 2,642,361, 3,297,446, 3,772,031, 3,857,711, 3,901,714, 4,266,018 and 3,904,415, and British Patent 1,315,755. In the noble metal sensitization, a salt of noble metal such as gold, platinum, palladium and iridium may be used. Among these, gold sensitization, palladium sensitization and a combination use thereof are preferred. In the gold sensitization, a known compound such as chloroauric acid, potassium chloroaurate, potassium aurithiocyanate, gold sulfide and gold selenide may be used. The palladium compound means a divalent or tetravalent palladium salt. A preferred palladium compound is represented by $R_2PdX_6$ or $R_2PdX_4$, wherein R represents a hydrogen atom, an alkali metal atom or an ammonium group, and X represents a halogen atom such as chlorine, bromine and iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound or palladium compound is preferably used in combination with a thiocyanate or a selenocyanate.

Examples of the sulfur sensitizer which can be used include hypo, thiourea compounds, rhodanine compounds and sulfur-containing compounds described in U.S. Pat. Nos. 3,857,711, 4,266,018 and 4,054,457. The chemical sensitization may also be performed in the presence of a so-called chemical sensitization aid. Compounds known to inhibit fogging during the chemical sensitization and increase the sensitivity, such as azaindene, azapyridazine and azapyrimidine, are useful as the chemical sensitization aid. Examples of the chemical sensitization aid modifier are described in U.S. Pat. Nos. 2,131,038, 3,411,914 and 3,554,757, JP-A-58-126526 and Duffin, *Chemistry of Photographic Emulsion*, pp. 138–143.

The emulsion of the present invention is preferably subjected additionally to gold sensitization. The amount of the gold sensitizer is preferably from $1\times10^{-4}$ to $1\times10^{-7}$ mol, more preferably from $1\times10^{-5}$ to $5\times10^{-7}$ mol, per mol of silver halide. The amount of the palladium compound is preferably from $1\times10^{-3}$ to $5\times10^{-7}$ mol. The amount of the thiocyan compound or selenocyan compound is preferably from $5\times10^{-2}$ to $1\times10^{-6}$.

The amount of the sulfur sensitizer used for the silver halide grain of the present invention is preferably from $1\times10^{-4}$ to $1\times10^{-7}$ mol, more preferably from $1\times10^{-5}$ to $5\times10^{-7}$ mol, per mol of silver halide.

The sensitization method preferred for the emulsion of the present invention is selenium sensitization. The selenium sensitization uses a known labile selenium compound. More specifically, selenium compounds such as colloidal metallic selenium, selenoureas (e.g., N,N-dimethylselenourea, N,N-diethylselenourea), selenoketones and selenoamides may be used. In some cases, the selenium sensitization is preferably used in combination with sulfur sensitization, noble metal sensitization or both thereof.

The silver halide emulsion of the present invention is preferably subjected to reduction sensitization during the grain formation, between after the grain formation and before or during the chemical sensitization, or after the chemical sensitization.

The reduction sensitization may be performed by any method selected from a method of adding a reduction sensitizer to a silver halide emulsion, a method called silver ripening where silver halide grains are grown or ripened in an atmosphere of a low pAg of 1 to 7, and a method called high pH ripening where silver halide grains are grown or ripened in an atmosphere of a high pH of 8 to 11. Two or more methods may also be used in combination.

The method of adding a reduction sensitizer is advantageous in that the level of reduction sensitization can be delicately controlled.

Known examples of the reduction sensitizer include stannous salts, ascorbic acid and derivatives thereof, amines, polyamines, hydrazine derivatives, formamidine-sulfinic acid, silane compounds and borane compounds. The reduction sensitizer used in the reduction sensitization of the present invention may be selected from these known reduction sensitizers. Two or more of these compounds may be also used in combination. Preferred compounds as the reduction sensitizer are stannous chloride, thiourea dioxide, dimethylamineborane, and ascorbic acid and derivatives thereof. The amount of the reduction sensitizer added varies depending on the production conditions of emulsion and therefore, needs be selected but it is suitably from $10^{-7}$ to $10^{-3}$ mol per mol of silver halide.

The reduction sensitizer is added during the growth of grains after dissolving it, for example, in water or an organic solvent such as alcohols, glycols, ketones, esters and amides. The reduction sensitizer may be previously added to the reaction vessel but a method of adding it at an appropriate time during the growth of grains is preferred. It is also possible to previously add the reduction sensitizer to an aqueous solution of a water-soluble silver salt or water-soluble alkali halide and precipitate silver halide grains by using the aqueous solution. Furthermore, a method of adding a solution of the reduction sensitizer in parts along the growth of grains or continuously over a long time is also preferred.

During the preparation of the emulsion of the present invention, an oxidizing agent for silver is preferably used. The term "oxidizing agent for silver" as used herein means a compound having a function of acting on metal silver to convert it into silver ion. In particular, a compound capable of converting very small silver grains by-produced during the formation and chemical sensitization of silver halide grains into silver ion is effective. The silver ion produced here may form a silver salt difficultly soluble in water, such as silver halide, silver sulfide and silver selenide, or may form a silver salt easily soluble in water, such as silver nitrate. The oxidizing agent for silver may be an inorganic or organic compound. Examples of the inorganic oxidizing agent include ozone, hydrogen peroxide, adducts thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), oxygen acid salts such as permanganate (e.g., $KMnO_4$) and chromate (e.g., $K_2Cr_2O_7$), halogen elements such as iodine and bromine, perhalogenates (e.g., potassium periodate), salts of metal having a high valency (e.g., potassium hexacyanoferrate), and thiosulfonates.

Examples of the organic oxidizing agent include quinones such as p-quinone, organic peroxides such as peracetic acid and perbenzoic acid, and compounds which release active halogen, such as N-bromosuccimide, chloramine T and chloramine B.

Among these oxidizing agents, preferred in the present invention are inorganic oxidizing agents such as ozone, hydrogen peroxide and adducts thereof, halogen element and thiosulfonate, and organic oxidizing agents such as quinones. In a preferred embodiment, the above-described reduction sensitization is used in combination with the oxidizing agent for silver. The method therefor may be selected from a method of using the oxidizing agent and then performing the reduction sensitization, a method reversed thereto and a method of allowing both to be present at the same time. The method may be selected and used at the grain formation or the chemical sensitization.

The photographic emulsion of the present invention may contain various compounds for the purpose of preventing fogging during the preparation, storage or photographic processing of the light-sensitive material or for stabilizing the photographic properties. More specifically, many compounds known as an antifoggant or a stabilizer may be added and examples thereof include thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds such as oxazolinethione, and azaindenes such as triazaindenes, tetraazaindenes (particularly 4-hydroxy-substituted (1,3,3a,7)tetraazaindenes) and pentaazaindenes. For example, those described in U.S. Pat. Nos. 3,954,474 and 3,982,947, and JP-B-52-28660 may be used. Preferred examples of the compounds include the compounds described in JP-A-63-212932. The antifoggant and the stabilizer may be added at various times according to the purpose, such as before, during or after the grain formation, during the water washing, at the dispersion after the water washing, before, during or after the chemical sensitization, and before the coating. These antifoggants and stabilizers each is added during the preparation of the emulsion not only to bring out its original antifogging or stabilizing effect but also for various purposes such as control of the crystal habit of grain, reduction of the grain size, decrease in the solubility of the grain, control of the chemical sensitization and control of the dye arrangement.

The silver halide emulsion prepared by the present invention can be used for either a color photographic light-sensitive material or a black-and-white photographic light-sensitive material. Examples of the color photographic light-sensitive material include color printing paper, film for color photographing, color reversal film and color diffusion transfer film, and examples of the black-and-white photographic light-sensitive material include film for general photographing, X-ray film, film for medical diagnosis, film for printing light-sensitive material and diffusion transfer film.

In the field of film for medical diagnosis and film for printing light-sensitive material, the exposure can be efficiently performed using a laser image setter or a laser imager.

The technique in this field is described in JP-A-7-287337, JP-A-4-335342, JP-A-5-313289, JP-A-8-122954 and JP-A-8-292512.

Also, the emulsion prepared by the present invention may be used for a heat-developable light-sensitive material. For example, a material having a light-sensitive layer comprising a binder matrix having dispersed therein a catalytic amount of photocatalyst (e.g., silver halide), a reducing agent, a reducible silver salt (e.g., organic silver salt) and if desired, a toning agent for controlling the color-tone of silver is known. Examples thereof include those described in U.S. Pat. Nos. 3,152,904, 3,457,075, 2,910,377 and 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and JP-A-2001-281785 (Japanese Patent Application No. 2000-89436).

The silver halide emulsion of the present invention can also be preferably used for a diffusion transfer light-sensitive material. In this regard, the heat-developable diffusion transfer system is described in JP-A-2000-98562 (Japanese Patent Application No. 10-265273) (using a preformed dye) and JP-A-2001-281785 (Japanese Patent Application No. 2000-89436) (using a coupling-formation dye), and the instant photographic system is described in JP-A-2000-284442.

With respect to the preparation method and the like of the photographic emulsion for use in the present invention, those described in JP-A-10-239789, column 63, line 36 to column 65, line 2, may be applied.

Furthermore, with respect to the additives such as color coupler, additives for the photographic light-sensitive material, the kind of light-sensitive material to which the present invention can be applied, and the processing of the light-sensitive material, those described in JP-A-10-239789, column 65, line 3 to column 73, line 13 may be applied.

In the silver halide photographic light-sensitive material of the present invention, various additives described above are used and other than these, various additives may also be used according to the purpose.

These additives are described in more detail in *Research Disclosure*, Item 17643 (December, 1978), ibid., Item 18716 (November, 1979), and ibid., Item 308119 (December, 1989). The pertinent portions are summarized in the table below.

| | Kinds of Additives | RD17643 | RD18716 | RD308119 |
|---|---|---|---|---|
| 1. | Chemical sensitizer | page 23 | page 648, right column | page 996 |
| 2. | Sensitivity increasing agent | | page 648, right column | |
| 3. | Spectral sensitizer, supersensitizer | pages 23 to 24 | page 648, right column to page 649, right column | page 996, right to page 998, right |
| 4. | Brightening agent | page 24 | | page 998, right |
| 5. | Antifoggant, stabilizer | pages 24 to 25 | page 649, right column | page 998, right to page 1000, right |
| 6. | Light absorbent, filter dye, UV absorbent | pages 25 to 26 | page 649, right column to page 650, left column | page 1003, left to page 1003, right |
| 7. | Stain inhibitor | page 25, right column | page 650, left to right columns | page 1002, right |

-continued

| | Kinds of Additives | RD17643 | RD18716 | RD308119 |
|---|---|---|---|---|
| 8. | Dye image stabilizer | page 25 | | page 1002, right |
| 9. | Hardening agent | page 26 | page 651, left column | page 1004, right to page 1005, left |
| 10. | Binder | page 26 | page 651, left column | page 1003, right to page 1004, right |
| 11. | Plasticizer, lubricant | page 27 | page 650, right column | page 1006, left to page 1006, right |
| 12. | Coating aid, surfactant | pages 26 to 27 | page 650, right column | page 1005, left to page 1006, left |
| 13. | Antistatic agent | page 27 | page 650, right column | page 1006, right to page 1007, left |
| 14. | Matting agent | | | page 1008, left to page 1009, left |

The technique such as layer arrangement, the silver halide emulsion, the dye forming coupler, the functional coupler such as DIR coupler, various additives and the development processing, which can be used in the emulsion of the present invention and in the photographic light-sensitive material using the emulsion, are described in EP-A-0565096 (published on Oct. 13, 1993) and patents cited therein. Respective items and corresponding portions are listed below.

| | | |
|---|---|---|
| 1. | Layer structure: | page 61, lines 23 to 35, page 61, line 41 to page 62 line 14 |
| 2. | Interlayer: | page 61, lines 36 to 40 |
| 3. | Inter layer effect-imparting layer: | page 62, lines 15 to 18 |
| 4. | Silver halide halogen composition: | page 62, lines 21 to 25 |
| 5. | Crystal habit of silver halide grain: | page 62, lines 26 to 30 |
| 6. | Silver halide grain size: | page 62, lines 31 to 34 |
| 7. | Emulsion production method: | page 62, lines 35 to 40 |
| 8. | Silver halide grain size distribution: | page 62, lines 41 to 42 |
| 9. | Tabular grain: | page 62, lines 43 to 46 |
| 10. | Internal structure of grain: | page 62, lines 47 to 53 |
| 11. | Latent image forming-type emulsion: | page 62, line 54 to page 63, line 5 |
| 12. | Physical ripening and chemical ripening of emulsion: | page 63, lines 6 to 9 |
| 13. | Use of emulsion mixture: | page 63, lines 10 to 13 |
| 14. | Fogged emulsion: | page 63, lines 14 to 31 |
| 15. | Light-insensitive emulsion: | page 63, lines 32 to 43 |
| 16. | Coated silver amount: | page 63, lines 49 to 50 |
| 17. | Formaldehyde scavenger: | page 64, lines 54 to 57 |
| 18. | Mercapto-based antifoggant: | page 65, lines 1 to 2 |
| 19. | Agent for releasing fogging agent, etc.: | page 65, lines 3 to 7 |
| 20. | Dye: | page 65, lines 7 to 10 |
| 21. | Color coupler in general: | page 65, lines 11 to 13 |
| 22. | Yellow, magenta and cyan couplers: | page 65, lines 14 to 25 |
| 23. | Polymer coupler: | page 65, lines 26 to 28 |
| 24. | Diffusible dye-forming coupler: | page 65, lines 29 to 31 |
| 25. | Colored coupler: | page 65, lines 32 to 38 |
| 26. | Functional coupler in general: | page 65, lines 39 to 44 |

-continued

| | | |
|---|---|---|
| 27. | Bleaching accelerator-releasing coupler: | page 65, lines 45 to 48 |
| 28. | Development accelerator-releasing coupler: | page 65, lines 49 to 53 |
| 29. | Other DIR couplers: | page 65, line 54 to page 66, line 4, |
| 30. | Coupler dispersion method: | page 66, lines 5 to 28 |
| 31. | Antiseptic and antifungal: | page 66, lines 29 to 33 |
| 32. | Kind of light-sensitive material: | page 66, lines 34 to 36 |
| 33. | Thickness and swelling rate of light-sensitive layer: | page 66, line 40 to page 67, line 1 |
| 34. | Back layer: | page 67, lines 3 to 8 |
| 35. | Development processing in general: | page 67, lines 9 to 11 |
| 36. | Developer and developing agent: | page 67, lines 12 to 30 |
| 37. | Additive for developer: | page 67, lines 31 to 44 |
| 38. | Reversal processing: | page 67, lines 45 to 56 |
| 39. | Opening ratio of processing solution: | page 67, line 57 to page 68, line 12 |
| 40. | Development time: | page 68, lines 13 to 15 |
| 41. | Bleach-fixing, bleaching and fixing: | page 68, line 16 to page 69, line 31 |
| 42. | Automatic developing machine: | page 69, lines 32 to 40 |
| 43. | Water washing, rinsing and stabilization: | page 69, line 41 to page 70, line 18 |
| 44. | Replenishment and re-use of processing solution: | page 70, lines 19 to 23 |
| 45. | Light-sensitive material intercalating developing agent: | page 70, lines 24 to 33 |
| 46. | Development processing temperature: | page 70, lines 34 to 38 |
| 47. | Use for film with lens: | page 70, lines 39 to 41 |

The method for exposing the silver halide photographic light-sensitive material of the present invention is described below.

Exposure for obtaining a photographic image may be performed using a normal method. More specifically, any of various known light sources can be used, such as natural light (sunlight), tungsten lamp, fluorescent lamp, mercury lamp, xenon arc lamp, carbon arc lamp, xenon flash lamp, laser, LED and CRT. Also, the light-sensitive photographic material may be exposed with light emitted from a phosphor excited by an electron beam, an X ray, a γ (gamma) ray or an α (alpha) ray.

In the present invention, a laser light source is sometimes preferably used. Examples of the laser ray include those using a helium-neon gas, an argon gas, a krypton gas or a carbon dioxide gas as the laser oscillation medium, those using a solid such as ruby or cadmium as the oscillation medium, a liquid laser and a semiconductor laser. Unlike light usually used for illumination and the like, these laser rays are coherent light having sharp directivity with uniform phase and single frequency and therefore, the silver halide photographic light-sensitive material exposed using such a laser ray as a light source must have spectral properties coincided with the emission wavelength of the laser used.

Among the above-described lasers, use of a semiconductor laser is preferred.

The compound of the present invention can be used not only as a sensitizing dye but also as a filter dye, an anti-irradiation dye or an antihalation dye for various purposes, such as improvement of sharpness and color resolution.

This compound can be incorporated into a coating solution for a silver halide photographic light-sensitive material layer, a filter layer and/or an antihalation layer by a method commonly used. The amount of the dye used may be sufficient if it is large enough to color the photographic material, and one skilled in the art can easily select this appropriate amount according to the use end. In general, the compound is preferably used to give an optical density of 0.05 to 3.0. The timing of adding the compound may be any step before the coating.

Also, a polymer having an electric charge opposite the dye ion may be used as a mordant and allowed to be present together in a layer so as to cause interaction with the dye molecule and thereby localize the dye in a specific layer.

Examples of the polymer mordant include those described in U.S. Pat. Nos. 2,548,564, 4,124,386, 3,625,694, 3,958, 995, 4,168,976 and 3,445,231.

The dye used as a sensitizing dye of the present invention can be added to a desired layer in addition to the light-sensitive emulsion layer, such as interlayer, protective layer and back layer.

Also, the dye used as a sensitizing dye of the present invention can be used as a photosensitizer (photo-charge separating agent) in various non-silver salt system photo-image forming methods or may be used for photocatalyst, photo-hydrogen generating agent and the like.

EXAMPLE

The present invention is described in greater detail below by referring to Examples, however, the present invention should not be construed as being limited thereto.

Example I-1

(Production Process of Em-A)

42.2 L of an aqueous solution containing 31.7 g of low molecular weight gelatin having a molecular weight of 15,000 and phthalated to a phthalation ratio of 97% and 31.7 g of KBr was kept at 35° C. and vigorously stirred. Thereto, 1,583 mL of an aqueous solution containing 316.7 g of $AgNO_3$ and 1,583 mL of an aqueous solution containing 221.5 g of KBr and 52.7 g of low molecular weight gelatin having a molecular weight of 15,000 were added by a double jet method over 1 minute. After the completion of addition, 52.8 g of KBr was immediately added and then, 2,485 mL of an aqueous solution containing 398.2 g of $AgNO_3$ and 2,581 mL of an aqueous solution containing 291.1 g of KBr were added by a double jet method over 2 minutes. After the completion of addition, 47.8 g of KBr was immediately added. Thereafter, the temperature was elevated to 40° C. and thorough ripening was performed. After the completion of ripening, 923 g of gelatin having a molecular weight of 100,000 and phthalated to a phthalation ratio of 97% and 79.2 g of KBr were added and then, 15,947 mL of an aqueous solution containing 5,103 g of $AgNO_3$ and an aqueous KBr solution were added by a double jet method over 12 minutes while accelerating the flow rate such that the final flow rate became 1.4 times the initial flow rate. At this time, the silver potential was kept at −60 mV to the saturated calomel electrode. The emulsion was washed with water and then adjusted by adding gelatin such that the pH was 5.7, the pAg was 8.8, the mass in terms of silver per kg of emulsion was 131.8 g and the mass of gelatin was 64.1 g. This emulsion was used as a seed emulsion. Thereafter, 1,211 mL of an aqueous solution containing 46 g of phthalated gelatin having a phthalation ratio of 97% and 1.7 g of KBr was kept at 75° C. and vigorously stirred. Thereto, 9.9 g of the seed emulsion prepared above was added and then 0.3 g of modified silicone oil (L7602, a product of Nippon Unicar) was added. After adjusting the pH to 5.5 by adding $H_2SO_4$, 67.6 mL of an aqueous solution containing 7.0 g of $AgNO_3$ and an aqueous KBr solution were added by a double jet method over 6 minutes while accelerating the flow rate such that the final flow rate became 5.1 times the initial flow rate. At this time, the silver potential was kept at −20 mV to the saturated calomel electrode.

After adding 2 mg of sodium benzenethiosulfonate and 2 mg of thiourea dioxide, 328 mL of an aqueous solution containing 134.4 g of $AgNO_3$ and an aqueous KBr solution were added by a double jet method over 56 minutes while accelerating the flow rate such that the final flow rate became 3.7 times the initial flow rate. At this time, an AgI fine grain emulsion having a grain size of 0.037 μm was simultaneously added to have a silver iodide content of 3 mol % while accelerating the flow rate and at the same time, keeping the silver potential at −30 mV to the saturated calomel electrode. Then, 121.3 mL of an aqueous solution containing 45.6 g of $AgNO_3$ and an aqueous KBr solution were added by a double jet method over 22 minutes. At this time, the silver potential was kept at −20 mV to the saturated calomel electrode. The temperature was elevated to 82° C. and the silver potential was adjusted to −80 mV by adding KBr. Thereafter, the AgI fine grain emulsion having a grain size of 0.037 μm was added in an amount of 6.33 g in terms of the mass of KI. After the completion of addition, 206.2 mL of an aqueous solution containing 66.4 g of $AgNO_3$ was immediately added over 16 minutes. For 5 minutes at the initial stage of addition, the silver potential was kept at −80 mV by an aqueous KBr solution. The obtained emulsion was washed with water washing and then gelatin was added to adjust the pH to 5.8 and the pAg to 8.7 at 40° C. The silver halide grains had an average equivalent-sphere diameter of 1.7 μm, an average equivalent-circle diameter of 3.2 μm, an average thickness of 0.3 μm, an average aspect ratio of 11 and an average iodide content of 4.0 mol %.

(Production Process of Em-A1 to A6)

Compounds 11 and 12 were added to Em-A and then, the temperature was elevated to 60° C. In the case where the pH of emulsion was 7.5, the pH was adjusted to a pH shown in Table I-2 by adding an aqueous KOH solution (when the pH of emulsion was 5.8, the aqueous KOH solution was not added). Subsequently, the sensitizing dye of the present invention or the comparative sensitizing dye shown in Table I-2 was added and stirred for 30 minutes. Then, the pH was adjusted to the original pH of 5.8 by adding an aqueous solution containing $H_2SO_4$ almost equivalent to KOH previously added. Thereafter, potassium thiocyanate, chloroauric acid, sodium thiosulfate and N,N-dimethylselenourea were added, thereby optimally performing the chemical sensitization. At the completion of chemical sensitization, Compounds 13 and 14 were added to prepare Em-A1 to Em-A6. The "optimally performing chemical sensitization" as used herein means that sensitizing dyes and compounds each was added in an amount ranging from $10^{-1}$ to $10^{-8}$ mol per mol of silver halide.

Compound 11

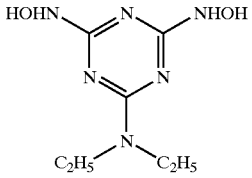

-continued

Compound 12

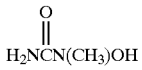

Compound 13

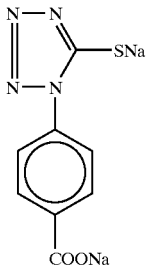

Compound 14

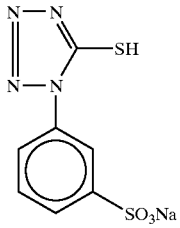

The obtained grains were observed by a transmission electron microscope while cooling the grains with liquid nitrogen, as a result, grains where a dislocation line was not present in the region of 80% or less as a projected area from the center part of the grain occupied about 98% (by number) of all grains. In the grain circumferential part of 20% as a projected area from the outer circumference of grain, 13 dislocation lines on average were observed per one grain.

The light absorption intensity per unit area was measured as follows. The emulsion obtained was coated to a small thickness on a slide glass and the transmission spectrum and reflection spectrum of individual grains were determined using a microspectrophotometer MSP65 manufactured by Karl Zweiss K.K. by the following method to determine the absorption spectrum. The area where grains were not present was used as the reference for the transmission spectrum, and the reference for the reflection spectrum was obtained by measuring silicon carbide of which reflectance is known. The measured part is a circular aperture part having a diameter of 1 μm. After adjusting the position not to allow the aperture part to overlap the contour of a grain, the transmission spectrum and the reflection spectrum were measured in the wave number region from 14,000 $cm^{-1}$ (714 nm) to 28,000 $cm^{-1}$ (357 nm). The absorption spectrum was determined from the absorption factor A which is 1−T (transmittance)−R (reflectance). Using the absorption factor A' obtained by subtracting the absorption of silver halide, −Log(1−A') was integrated to the wave number ($cm^{-1}$) and the value obtained was halved and used as a light absorption intensity per unit area. The integration range was from 14,000 to 28,000 $cm^{-1}$. At this time, the light source used was a tungsten lamp and the light source voltage was 8 V. In order to minimize the damage of the dye by the light irradiation, a monochromator in the primary side was used and the wavelength distance and the slit width were set to 2 nm and 2.5 nm, respectively.

The properties of other silver halide emulsions (Em-B to Em-P) used in this Example are shown in Table I-1.

TABLE I-1

| Emulsion No. | Properties of Emulsion: Equivalent-Sphere Diameter, μm | Projected Area Diameter, μm | Aspect Ratio | Iodide Content, mol % |
|---|---|---|---|---|
| Em-B | 1.0 | 2.0 | 12.2 | 10.0 |
| Em-C | 0.7 | — | 1 | 4.0 |
| Em-D | 0.4 | 0.53 | 3.5 | 4.1 |
| Em-E | 1.1 | 2.63 | 20.6 | 6.7 |
| Em-F | 1.2 | 2.74 | 18 | 6.9 |
| Em-G | 0.9 | 1.98 | 15.9 | 6.1 |
| Em-H | 0.7 | 1.22 | 8 | 6.0 |
| Em-I | 0.4 | 0.63 | 6 | 6.0 |
| Em-J | 1.3 | 3.18 | 22 | 3.5 |
| Em-K | 1.0 | 2.37 | 20 | 4.0 |
| Em-L | 0.8 | 1.86 | 19 | 3.6 |
| Em-M | 0.6 | 1.09 | 8.9 | 2.9 |
| Mm-N | 0.4 | 0.63 | 6 | 2.0 |
| Em-O | 0.3 | 0.38 | 3 | 1.0 |
| Em-P | 1.3 | 3.18 | 22 | 3.5 |

The preparation formulation of the emulsified product used in this Example is briefly described below.

A solution obtained by dissolving a coupler in ethyl acetate, a high boiling point organic solvent and a surfactant were added to a 10% gelatin solution and these were mixed and using a homogenizer (manufactured by Nippon Seiki), emulsified to obtain an emulsified product.

1) Support

The support used in this Example was prepared by the following method.

100 Mass parts of polyethylene-2,6-naphthalate polymer and 2 mass parts of Tinuvin P.326 (produced by Ciba-Geigy) as an ultraviolet absorbent were dried, melted at 300° C., extruded from a T-die, stretched longitudinally to 3.3 times at 140° C., then stretched transversely to 3.3 times at 130° C., and heat fixed at 250° C. for 6 seconds to obtain a PEN (polyethylene naphthalate) film having a thickness of 90 μm. To this PEN film, a blue dye, a magenta dye and a yellow dye (I-1, I-4, I-6, I-24, I-26, I-27 and II-5 described in *JIII Journal of Technical Disclosure*, No. 94-6023) were added each in an appropriate amount. Furthermore, the film was wound around a stainless steel-made core having a diameter of 20 cm and imparted with heat history of 110° C. for 48 hours to obtain a support difficult of having curling habit.

2) Coating of Undercoat Layer

Both surfaces of the support obtained above were subjected to corona discharge treatment, UV discharge treatment and glow discharge treatment. Then, an undercoat solution comprising 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide-epichlorohydrin polycondensate was coated (10 mL/m$^2$, using a bar coater) on each surface to provide an undercoat layer in the side of high temperature at the stretching. The drying was performed at 115° C. for 6 minutes (rollers and conveyance device in the drying zone all were set at 115° C.).

3) Coating of Back Layer

On one surface of the undercoated support, an antistatic layer, a magnetic recording layer and a slipping layer each having the following composition were provided as the back layer.

3-1) Coating of Antistatic Layer

The antistatic layer was provided by coating 0.2 g/m$^2$ of a fine particle powder dispersion of tin oxide-antimony oxide composite having an average particle size of 0.005 μm (secondary aggregate particle size: about 0.08 μm) and a resistivity of 5 Ω·cm together with 0.05 g/m$^2$ of gelatin, 0.02 g/m$^2$ of $(CH_2{=}CHSO_2CH_2CH_2NHCO)_2CH_2$, 0.005 g/m$^2$ of poly(polymerization degree: 10)oxyethylene-p-nonylphenol and resorcin.

3-2) Coating of Magnetic Recording Layer

Using a bar coater, 0.06 g/m$^2$ of cobalt-γ-iron oxide (specific surface area: 43 m$^2$/g, longer axis: 0.14 μm, single axis: 0.03 μm, saturation magnetization: 89 Am$^2$/kg, $Fe^{2+}/Fe^{3+}$=6/94, the surface was treated with aluminum oxide and silicon oxide to 2 mass % based on iron oxide) subjected to a covering treatment with 3-poly(polymerization degree: 15)oxyethylene-propyloxytrimethoxysilane (15 mass %) was coated together with 1.2 g/m$^2$ of diacetyl cellulose (iron oxide was dispersed by an open kneader and a sand mill), 0.3 g/m$^2$ of $C_2H_5C(CH_2OCONH{-}C_6H_3(CH_3)NCO)_3$ as a hardening agent and acetone, methyl ethyl ketone and cyclohexanone as solvents to obtain a magnetic recording layer having a layer thickness of 1.2 μm. Silica particle (0.3 μm) as a matting agent and aluminum oxide (0.15 μm) as an abrasive subjected to a covering treatment with 3-poly(polymerization degree: 15)oxyethylene-propyloxytrimethoxysilane (15 mass %) were added each to 10 mg/m$^2$. The drying was performed at 115° C. for 6 minutes (rollers and conveyance device in the drying zone all were at 115° C.). The increase in the color density of $D_B$ of the magnetic recording layer by X-light (blue filter) was about 0.1, the saturation magnetization moment of the magnetic recording layer was 4.2 Am$^2$/kg, the coercive force was $7.3\times10^4$ A/m and the angular ratio was 65%.

3-3) Preparation of Slipping Layer

Diacetyl cellulose (25 mg/m$^2$) and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 9 mg/m$^2$) were coated. This mixture was prepared by melting the compounds in xylene/propylene monomethyl ether (1/1) at 105° C. and pouring and dispersing the melt in propylene monomethyl ether (10-fold amount) at normal temperature. The resulting mixture was formed into a dispersion (average particle size: 0.01 μm) in acetone and then added. Silica particle (0.3 μm) as a matting agent and alumina oxide (0.15 μm) covered with 3-poly(polymerization degree: 15)oxyethylenepropyloxytrimethoxysilane (15 mass %) as an abrasive were added each to 15 mg/m$^2$. The drying was performed at 115° C. for 6 minutes (rollers and the conveyance device in the drying zone all were at 115° C.). The slipping layer had excellent capabilities such that the coefficient of dynamic friction was 0.06 (stainless steel ball of 5 mmφ; load: 100 g; speed: 6 cm/min), the coefficient of static friction was 0.07 (by clip method) and the coefficient of dynamic friction between the emulsion surface described later and the slipping layer was 0.12.

4) Coating of Light-Sensitive Layer

Layers each having the following composition were coated one on another in the side opposite the back layer provided above to prepare a color negative light-sensitive material sample. The sample was prepared by using the following emulsions, emulsified products and compounds.

(Composition of Light-Sensitive Layer)

The main materials used in each layer are classified as follows.

ExC: cyan coupler

ExM: magenta coupler

ExY: yellow coupler

UV: ultraviolet absorbent

HBS: high-boiling point organic solvent

H: gelatin hardening agent (Specific compounds are noted by the numeral affixed to the symbol and chemical formulae are shown later.)

Numerals corresponding to respective components each shows a coated amount expressed by the unit of $g/m^2$. In the case of silver halide, the coated amount is shown in terms of silver.

| First Layer: (First Antihalation Layer) | |
|---|---|
| Black colloidal silver | as silver 0.155 |
| Surface fogged AgBrI (2) of 0.07 μm | as silver 0.01 |
| Gelatin | 0.87 |
| ExC-1 | 0.002 |
| ExC-3 | 0.002 |
| Cpd-2 | 0.001 |
| HBS-1 | 0.004 |
| HBS-2 | 0.002 |
| **Second Layer: (Second Antihalation Layer)** | |
| Black colloidal silver | as silver 0.066 |
| Gelatin | 0.407 |
| ExM-1 | 0.050 |
| ExF-1 | $2.0 \times 10^{-3}$ |
| HBS-1 | 0.074 |
| Solid Disperse Dye ExF-2 | 0.015 |
| Solid Disperse Dye ExF-3 | 0.020 |
| **Third Layer: (Interlayer)** | |
| AgBrI (2) of 0.07 μm | as silver 0.020 |
| ExC-2 | 0.022 |
| Polyethyl acrylate latex | 0.085 |
| Gelatin | 0.294 |
| **Fourth Layer: (Low-speed Red-Sensitive Emulsion Layer)** | |
| Silver Iodobromide Emulsion M | as silver 0.065 |
| Silver Iodobromide Emulsion N | as silver 0.100 |
| Silver Iodobromide Emulsion O | as silver 0.158 |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.80 |
| **Fifth Layer: (Medium-Speed Red-Sensitive Emulsion Layer)** | |
| Silver Iodobromide Emulsion K | as silver 0.21 |
| Silver Iodobromide Emulsion L | as silver 0.62 |
| ExC-1 | 0.14 |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| Gelatin | 1.18 |
| **Sixth Layer: (High-Speed Red-Sensitive Emulsion Layer)** | |
| Silver Iodobromide Emulsion P | as silver 1.67 |
| ExC-1 | 0.18 |
| ExC-3 | 0.07 |
| ExC-6 | 0.047 |
| Cpd-2 | 0.046 |
| Cpd-4 | 0.077 |

-continued

| | |
|---|---|
| HBS-1 | 0.25 |
| HBS-2 | 0.12 |
| Gelatin | 2.12 |
| **Seventh Layer: (Interlayer)** | |
| Cpd-1 | 0.089 |
| Solid Disperse Dye ExF-4 | 0.030 |
| HBS-1 | 0.050 |
| Polyethyl acrylate latex | 0.83 |
| Gelatin | 0.84 |

Eighth Layer: (Interlayer Effect Donor Layer: Layer for Imparting Interlayer Effect to Red-Sensitive Layer))

| | |
|---|---|
| Silver Iodobromide Emulsion E | as silver 0.560 |
| Cpd-4 | 0.030 |
| ExM-2 | 0.096 |
| ExM-3 | 0.028 |
| ExY-1 | 0.031 |
| ExG-1 | 0.006 |
| HBS-1 | 0.085 |
| HBS-3 | 0.003 |
| Gelatin | 0.58 |
| **Ninth Layer: (Low-Speed Green-Sensitive Emulsion Layer):** | |
| Silver Iodobromide Emulsion G | as silver 0.39 |
| Silver Iodobromide Emulsion H | as silver 0.28 |
| Silver Iodobromide Emulsion I | as silver 0.35 |
| ExM-2 | 0.36 |
| ExM-3 | 0.045 |
| ExG-1 | 0.005 |
| HBS-1 | 0.28 |
| HBS-3 | 0.01 |
| HBS-4 | 0.27 |
| Gelatin | 1.39 |
| **Tenth Layer: (Medium-Speed Green-Sensitive Emulsion Layer):** | |
| Silver Iodobromide Emulsion F | as silver 0.20 |
| Silver Iodobromide Emulsion G | as silver 0.25 |
| ExC-6 | 0.009 |
| ExM-2 | 0.031 |
| ExM-3 | 0.029 |
| ExY-1 | 0.006 |
| ExM-4 | 0.028 |
| ExG-1 | 0.005 |
| HBS-1 | 0.064 |
| HBS-3 | $2.1 \times 10^{-3}$ |
| Gelatin | 0.44 |
| **Eleventh Layer: (High-Speed Green-Sensitive Emulsion Layer)** | |
| Silver Iodobromide Emulsion J | as silver 1.200 |
| ExC-6 | 0.004 |
| ExM-1 | 0.016 |
| ExM-3 | 0.036 |
| ExM-4 | 0.020 |
| ExM-5 | 0.004 |
| ExY-5 | 0.008 |
| ExM-2 | 0.013 |
| Cpd-4 | 0.007 |
| HBS-1 | 0.18 |
| Polyethyl acrylate latex | 0.099 |
| Gelatin | 1.11 |
| **Twelfth Layer: (Yellow Filter Layer)** | |
| Yellow colloidal silver | as silver 0.047 |
| Cpd-1 | 0.16 |
| ExF-5 | 0.010 |
| Solid Disperse Dye ExF-6 | 0.010 |
| HBS-1 | 0.082 |
| Gelatin | 1.057 |
| **Thirteenth Layer: (Low-Speed Blue-Sensitive Emulsion Layer)** | |
| Silver Iodobromide Emulsion B | as silver 0.18 |
| Silver Iodobromide Emulsion C | as silver 0.20 |
| Silver Iodobromide Emulsion D | as silver 0.07 |

-continued

| | |
|---|---|
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |
| Fourteenth Layer: (High-Speed Blue-Sensitive Emulsion Layer) | |
| Emulsion shown in TABLE I-2 (Em-A1 to Em-A6) | as silver 0.75 |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |
| Fifteenth Layer: (First Protective Layer) | |
| AgBrI (2) of 0.07 μm | as silver 0.30 |
| UV-1 | 0.21 |
| UV-2 | 0.13 |
| UV-3 | 0.20 |
| UV-4 | 0.025 |
| F-18 | 0.009 |
| F-19 | 0.005 |
| F-20 | 0.005 |
| HBS-1 | 0.12 |
| HBS-4 | $5.0 \times 10^{-2}$ |
| Gelatin | 2.3 |
| Sixteenth Layer: (Second Protective Layer) | |
| H-1 | 0.40 |
| B-1 (Diameter: 1.7 μm) | $5.0 \times 10^{-2}$ |
| B-2 (Diameter: 1.7 μm) | 0.15 |
| B-3 | 0.05 |
| S-1 | 0.20 |
| Gelatin | 0.75 |

Furthermore, in order to improve storability, processability, pressure resistance, antifungal and microbicidal property, B-4 to B-6, F-1 to F-18, iron salt, lead salt, gold salt, platinum salt, palladium salt, iridium salt, ruthenium salt and rhodium salt were appropriately added to each layer. Also, in the preparation of the sample, calcium in the form of an aqueous calcium nitrate solution was added in an amount of $8.5\times10^{-3}$ g to the coating solution for the eighth layer and in an amount of $7.9\times10^{-3}$ g to the coating solution for the eleventh layer, per mol of silver halide. Still further, in order to attain good antistatic property, at least one of W-1, W-6, W-7 and W-8 was added and in order to attain good coatability, at least one of W-2 and W-5 was added.

Preparation of Dispersion of Organic Solid Disperse Dye:

ExF-3 was dispersed by the following method. That is, 21.7 ml (hereinafter sometimes denoted as "mL") of water, 3 mL of a 5% aqueous solution of sodium p-octylphenoxyethoxyethoxyethanesulfonate and 0.5 g of a 5% aqueous solution of p-octylphenoxypolyoxyethylene ether (polymerization degree: 10) were charged into a 700-mL pot mill and thereto 5.0 g of Dye ExF-3 and 500 ml of zirconium oxide beads (diameter: 1 mm) were added. The contents were dispersed for 2 hours using a BO-Type vibration ball mill manufactured by Chuo Koki K.K. After the dispersion, the contents were taken out and added to 8 g of an aqueous 12.5% gelatin solution and thereafter, beads were removed by filtration to obtain a gelatin dispersion of the dye. The thus-obtained fine dye particles had an average particle diameter of 0.44 μm.

The solid dispersion of ExF-4 was obtained in the same manner. The fine dye particles obtained had an average particle diameter of 0.45 μm. ExF-2 was dispersed by the microprecipitation dispersing method described in Example 1 of EP-A-549489. The average particle diameter was 0.06 μm.

The solid dispersion of ExF-6 was dispersed by the following method.

To 2,800 g of a wet cake of ExF-6 containing 18% or water, 4,000 g of water and 376 g of a 3% solution of W-2 were added and stirred to obtain a slurry of ExF-6 having a concentration of 32%. Then, 1,700 mL of zirconia beads having an average particle size of 0.5 mm were filled in Ultraviscomill (UVM-2) manufactured by Imex and the slurry was passed therethrough and pulverized at a peripheral speed of about 10 m/sec and a discharge amount of 0.5 L/min for 8 hours.

The compounds used for forming each layer are shown below.

ExC-1

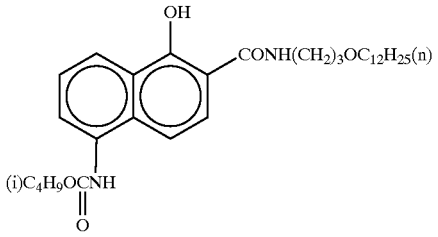

ExC-2

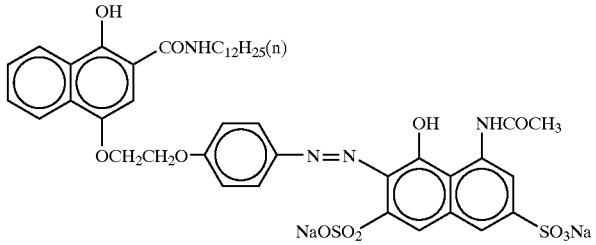

ExC-3

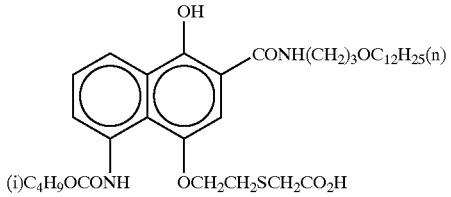

ExC-4

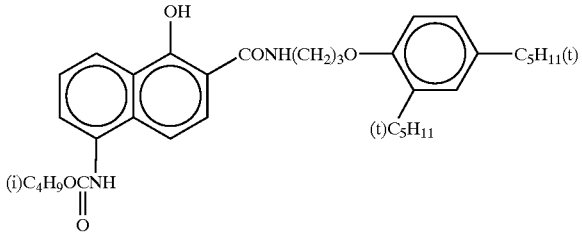

-continued
ExC-5
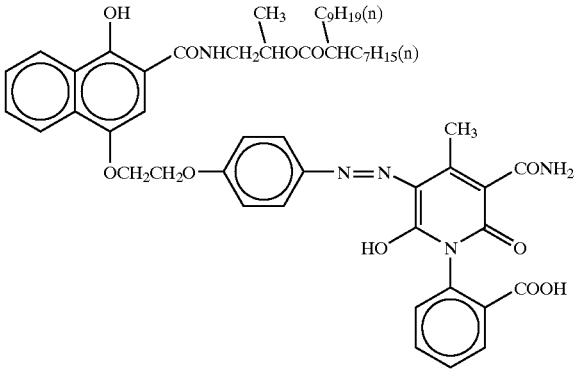
ExC-6
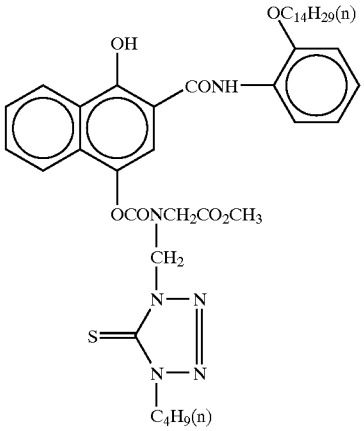
ExC-8
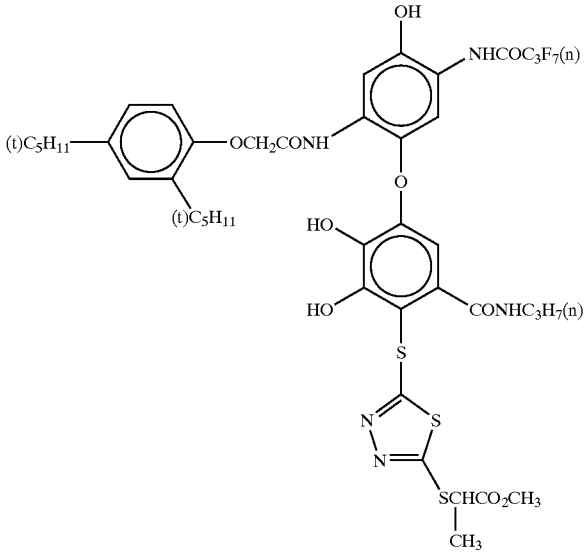
ExM-1
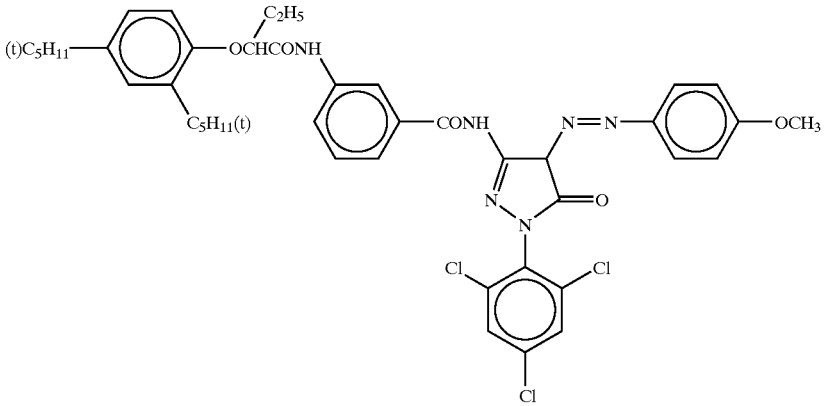

-continued
ExM-2
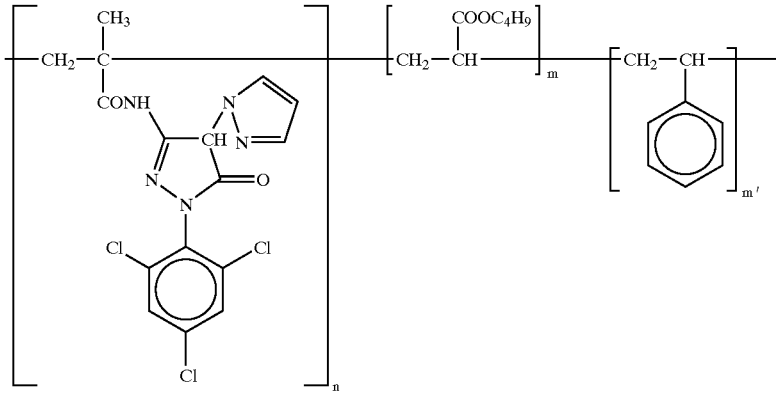
n = 50
m = 25
m′ = 25
mol. wt. about 20,000
ExM-3
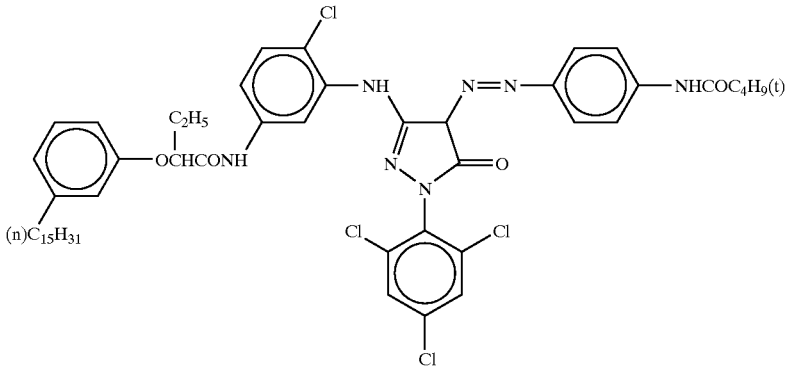
ExM-4
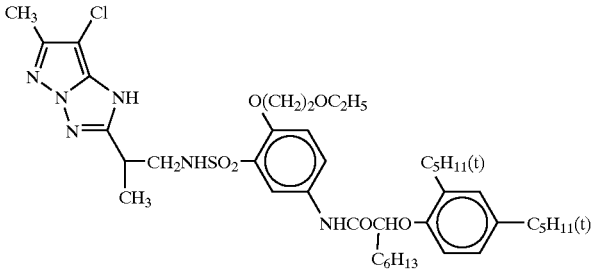
ExM-5
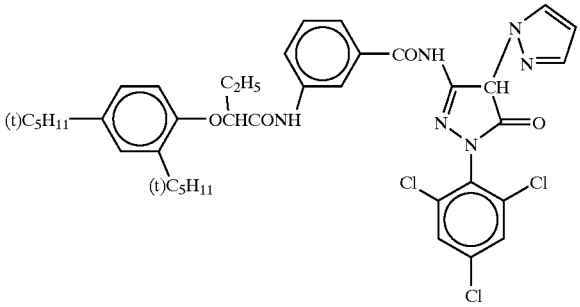
ExY-1
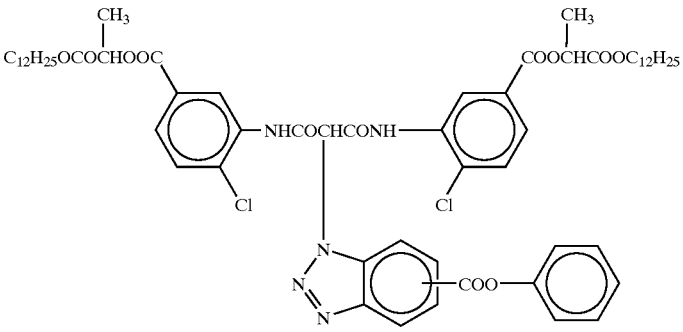

-continued
ExY-2
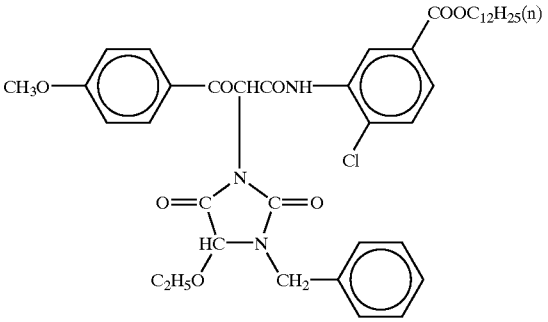
ExY-3
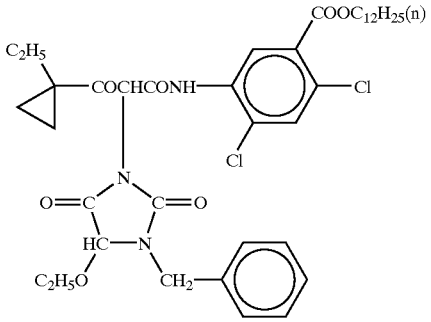
ExY-4
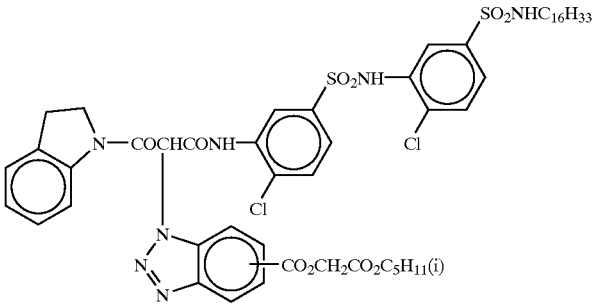
ExY-5
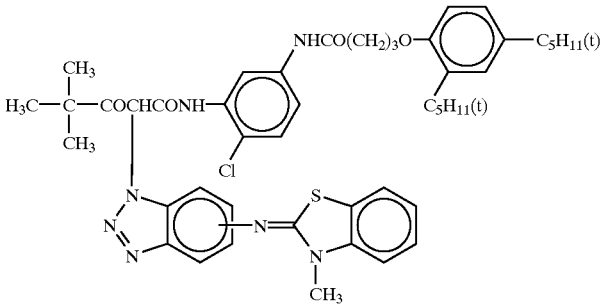
ExG-1
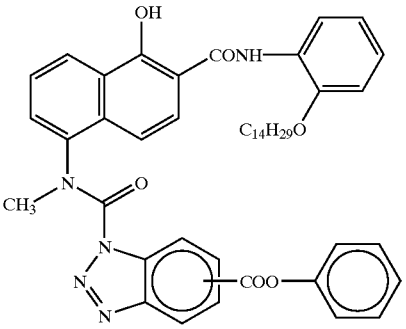
ExY-6
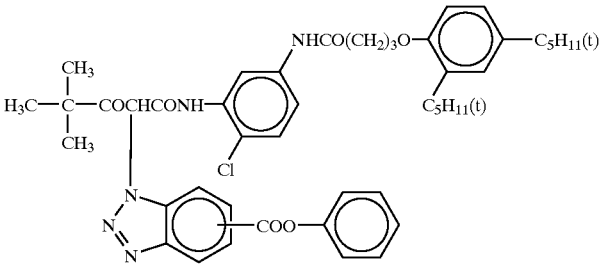
ExF-1
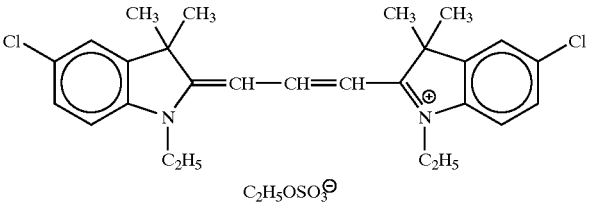
ExF-2
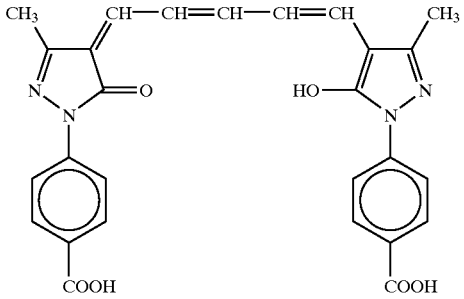
ExF-3
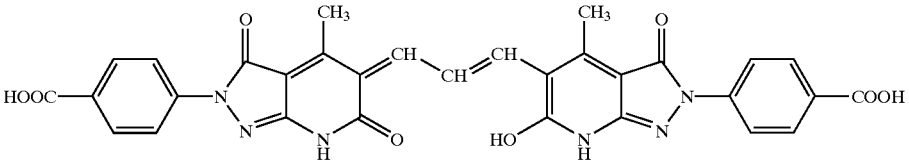

-continued
ExF-4
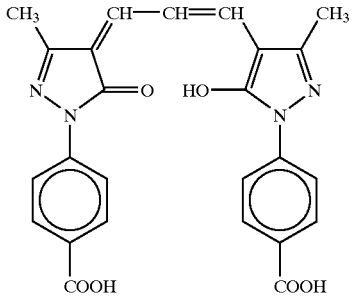
ExF-5
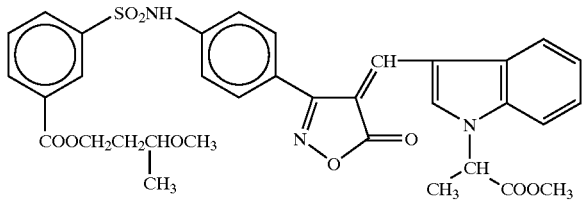
ExF-6
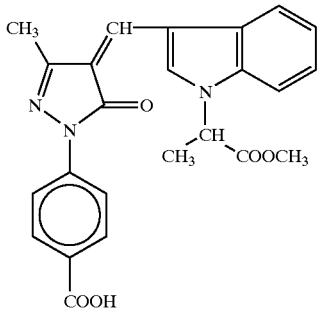
Cpd-1
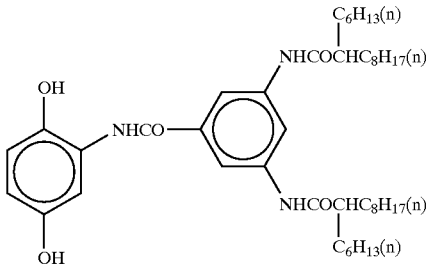
Cpd-2
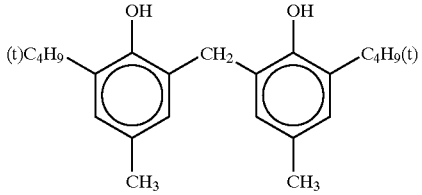
Cpd-3
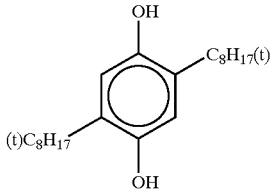
Cpd-4
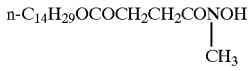
UV-1
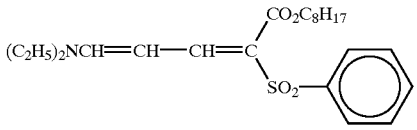
UV-2
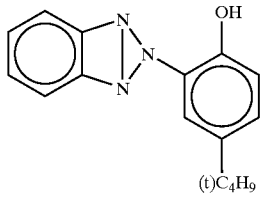
UV-3
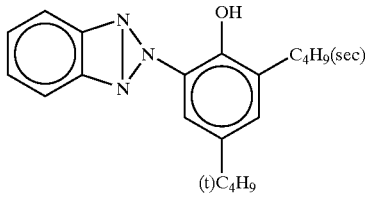
UV-4
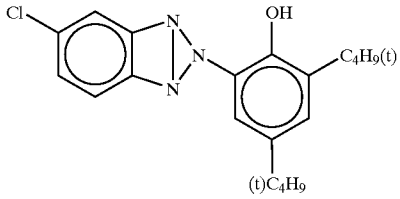

HBS-1 Tricresyl phosphate
HBS-2 Di-n-Butyl phthalate
HBS-3
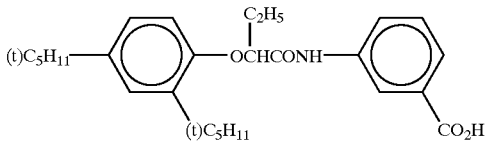
HBS-4 Tri(2ethylhexyl) phosphate
H-1
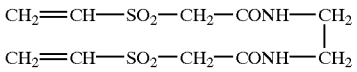
S-1
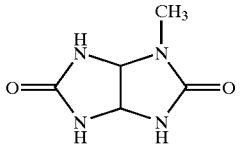
B-1
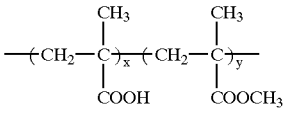
x/y = 10/90 (by mass)
average molecular weight:
about 35,000
B-2
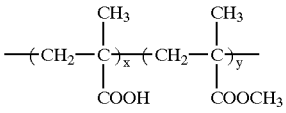
x/y = 40/60 (by mass)
average molecular weight:
about 20,000
B-3
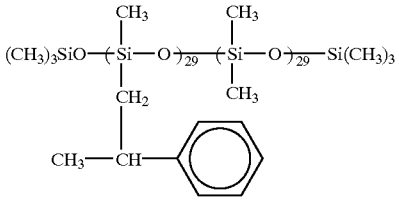
(by mol)
average molecular weight:
about 8,000
B-4
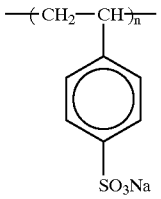
average molecular weight:
about 750,000
-continued
B-5
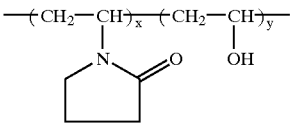
x/y = 70/30 (bymass)
average molecular weight:
about 17,000
B-6
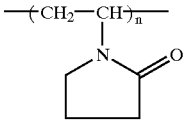
average molecular weight:
about 10,000
W-1
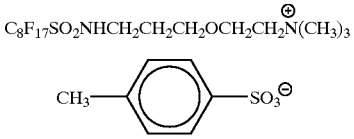
W-2
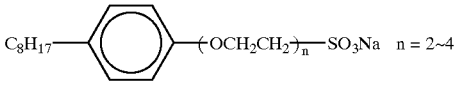
W-4
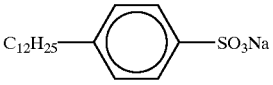
W-5
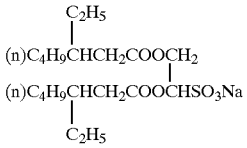
W-6
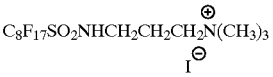
W-7
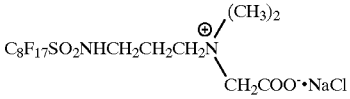
W-8
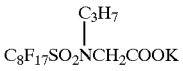
F-1
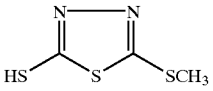
F-2
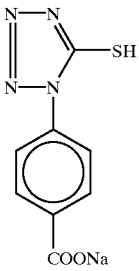

-continued

F-3

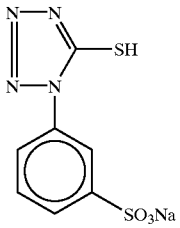

F-4

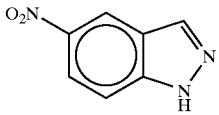

F-5

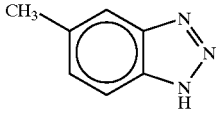

F-6

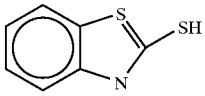

F-7

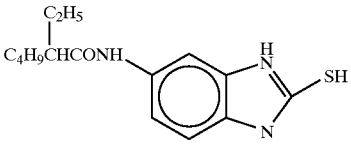

F-8

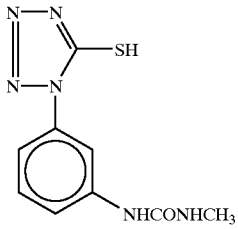

F-9

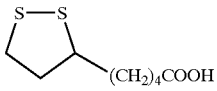

F-10

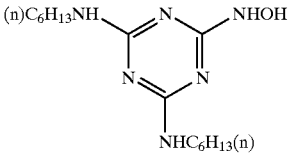

F-11

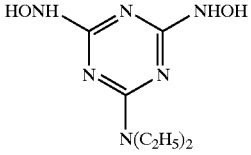

F-12

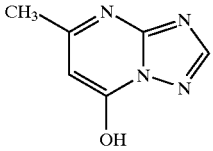

-continued

F-13

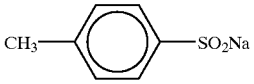

F-14

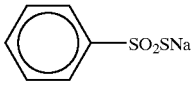

F-15

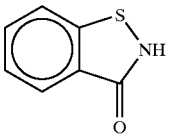

F-16

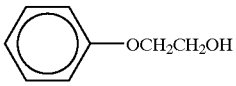

F-17

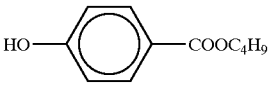

F-18

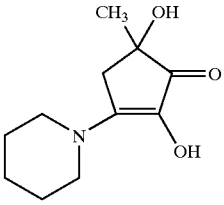

F-19

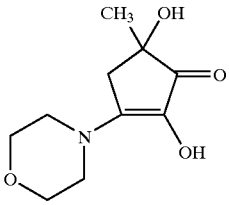

F-20

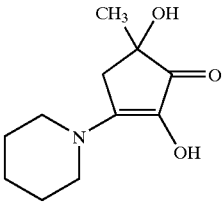

The samples were evaluated by the following methods. Each sample was exposed for 1/100 second through Gelatin Filter SC-39 (a long wavelength light transmitting filter with a cut-off wavelength of 390 nm) produced by Fuji Photo Film Co., Ltd. or an interference filter of 370 nm produced by SHOT and a continuous wedge. The development was performed as follows using an automatic developing machine FP-360B manufactured by Fuji Photo Film Co., Ltd. which was modified not to flow the overflow solution of the bleaching bath to the post bath but to discharge all to the waste solution tank. In this FP-360B, an evaporation correcting means described in *JIII Journal of Technical Disclosure*, No. 94-4992 was mounted.

The processing steps and the composition of each processing solution are shown below.

(Processing Step)

| Step | Processing Time | Processing Temperature (° C.) | Replenishing Amount* (mL) | Tank Volume (L) |
|---|---|---|---|---|
| Color development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Water washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60.0 | | |

*Replenishing amount was per 1.1 m of 35 mm-width light-sensitive material (corresponding to 1 roll of 24 Ex.).

The stabilizing solution and the fixing solution each was in a countercurrent system of from (2) to (1) and the overflow solution of washing water was all introduced into the fixing bath (2). The amount of developer carried over into the bleaching step, the amount of bleaching solution carried over into the fixing step and the amount of fixing solution carried over into the water washing step were 2.5 mL, 2.0 mL and 2.0 mL, respectively, per 1.1 m of 35 mm-width light-sensitive material. The cross-over time was 6 seconds in each interval and this time is included in the processing time of the previous step.

The open area of the above-described processing machine was 100 $cm^2$ for the color developer, 120 $cm^2$ for the bleaching solution and about 100 $cm^2$ for other processing solutions.

The composition of each processing solution is shown below.

(Color Developer)

| | Tank Solution (g) | Replenisher (g) |
|---|---|---|
| Diethylenetriaminepentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium N,N-bis(2-sulfonato-ethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxy-ethyl)amino]aniline sulfate | 4.5 | 6.5 |
| Water to make | 1.0 L | 1.0 L |
| pH (adjusted by potassium hydroxide and sulfuric acid) | 10.05 | 10.18 |

(Bleaching Solution)

| | Tank Solution (g) | Replenisher (g) |
|---|---|---|
| Ammonium 1,3-diaminopropane-tetraacetato ferrate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH [adjusted by aqueous ammonia] | 4.6 | 4.0 |

(Fixing Solution (1): Tank Solution)

A 5:95 (by volume) mixed solution of the bleaching tank solution above and the fixing tank solution shown below (pH: 6.8).

(Fixing Solution (2))

| | Tank Solution (g) | Replenisher (g) |
|---|---|---|
| Aqueous ammonium thiosulfate solution (750 g/L) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 L | 1.0 L |
| pH [adjusted by aqueous ammonia and acetic acid] | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/L or less and then thereto 20 mg/L of sodium isocyanurate dichloride and 150 mg/L of sodium sulfate were added. The resulting solution had a pH of 6.5 to 7.5.

(Stabilizing Solution)
Tank solution and replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Sodium 1,2-benzoisothiazolin-3-one | 0.10 |
| Disodium ethylenediaminetetra-acetate | 0.05 |
| 1,2,4-Triazole | 1.3 |
| 1,4-Bis(1,2,4-triazol-1-yl-methyl)piperazine | 0.75 |
| Water to make | 1.0 L |
| pH | 8.5 |

Samples 101 to 106 were subjected to the above-described processing and the photographic performance of each processed sample was evaluated by measuring the density with a blue filter. The results are shown in Table I-2. In Table I-2, Sample 106 of the present invention was increased in the light absorption intensity, but at the same time, it was confirmed that the adsorption amount was also increased.

TABLE I-2

Sensitivity of High-Sensitivity Blue-Sensitive Emulsion Em-A

| Sample No. | Emulsion | Sensitizing Dye | pH of Emulsion: Before Addition of Sensitizing Dye | pH of Emulsion: After Addition of Sensitizing Dye | Light Absorption Intensity per Unit Area | Sensitivity | Remarks |
|---|---|---|---|---|---|---|---|
| 101 | Em-A1 | S-1 | 5.8 | 5.8 | 42 | 100 | Comparison |
| 102 | Em-A2 | S-1 | 7.5 | 5.8 | 41 | 99 | " |
| 103 | Em-A3 | S-2 | 5.8 | 5.8 | 45 | 101 | " |
| 104 | Em-A4 | S-2 | 7.5 | 5.8 | 46 | 101 | " |
| 105 | Em-A5 | No. 2 | 5.8 | 5.8 | 62 | 119 | " |
| 106 | Em-A6 | No. 2 | 7.5 | 5.8 | 73 | 138 | Invention |

Sensitizing Dyes S-1 and S-2 in Table I-2 are shown below.

S-1:

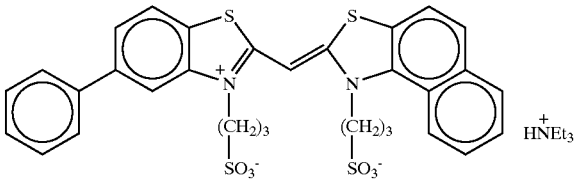

S-3:

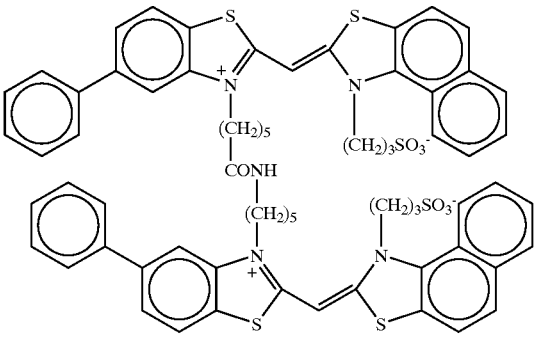

It is seen from the results above that a silver halide photographic light-sensitive material having high sensitivity can be obtained by performing the process of the present invention. In Sample 106, not only the first layer dye of the connection dye but also the second layer dye adsorbed to silver halide by forming a J-aggregate and a sharp absorption spectrum was exhibited as compared with Sample 105.

Example I-2

An emulsion obtained by not adding thiourea dioxide in the production process of Em-A was designated as Emulsion Q.

(Production Process of Em-Q1 to Em-Q6)

Compounds 11 and 12 were added to Em-Q and then, the temperature was elevated to 60° C. In the case where the pH of emulsion was 3.0, the pH was adjusted to a pH shown in Table I-2 by adding an aqueous $H_2SO_4$ solution (when the pH of emulsion was 5.8, the aqueous $H_2SO_4$ solution was not added). Subsequently, the sensitizing dye of the present invention or the comparative sensitizing dye shown in Table I-3 was added and stirred for 30 minutes. Then, the pH was adjusted to the original pH of 5.8 by slowly adding an aqueous solution containing KOH almost equivalent [←mol amount] to $H_2SO_4$ previously added. The "slowly adding" as used herein means to continuously adding the aqueous KOH solution and gradually change the pH. The rate thereof was pH 0.1 unit/min. Thereafter, potassium thiocyanate, chloroauric acid, sodium thiosulfate and N,N-dimethylselenourea were added, thereby optimally performing the chemical sensitization. At the completion of chemical sensitization, Compounds 13 and 14 were added to prepare Em-Q1 to Em-Q6. The "optimally performing chemical sensitization" as used herein means that sensitizing dyes and compounds each was added in an amount ranging from $10^{-1}$ to $10^{-8}$ mol per mol of silver halide.

Samples 201 to 206 were prepared by coating the coating solutions one on another in the same manner as in Example I-1 except for changing the composition of the coating solution for the eleventh layer as follows.

Eleventh Layer (High-Sensitivity Green-Sensitive Emulsion Layer):

| | |
|---|---|
| Emulsion shown in Table I-3 (Em-Q1 to Em-Q6) | as silver 1.200 |
| ExC-6 | 0.004 |
| ExM-1 | 0.016 |
| ExM-3 | 0.036 |
| ExM-4 | 0.020 |
| ExM-5 | 0.004 |
| ExY-5 | 0.008 |
| ExM-2 | 0.013 |
| Cpd-4 | 0.007 |
| HBS-1 | 0.18 |
| Gelatin | 1.11 |

The samples were evaluated in the same manner as in Example I-1 except that each processed sample was measured on the density with a green filter. The results are shown in Table I-3. In Table I-3, Sample 206 of the present invention was increased in the light absorption intensity, but at the same time, it was confirmed that the adsorption amount was also increased.

TABLE I-3

Sensitivity of High-Sensitivity Green-Sensitive Emulsion Em-Q

| Sample No. | Emulsion | Sensitizing Dye | pH of Emulsion: Before Addition of Sensitizing Dye | pH of Emulsion: After Addition of Sensitizing Dye | Light Absorption Intensity per Unit Area | Sensitivity | Remarks |
|---|---|---|---|---|---|---|---|
| 201 | Em-Q1 | S-3 | 5.8 | 5.8 | 70 | 100 | Comparison |
| 202 | Em-Q2 | S-3 | 3.0 | 5.8 | 72 | 101 | " |
| 203 | Em-Q3 | S-4 | 5.8 | 5.8 | 68 | 98 | " |
| 204 | Em-Q4 | S-4 | 3.0 | 5.8 | 67 | 97 | " |
| 205 | Em-Q5 | No. 7 | 5.8 | 5.8 | 75 | 102 | " |
| 206 | Em-Q6 | No. 7 | 3.0 | 5.8 | 135 | 164 | Invention |

It is seen from the results above that a silver halide photographic light-sensitive material having high sensitivity can be obtained by performing the process of the present invention.

Sensitizing Dyes S-3 and S-4 in Table I-3 are shown below.

S-3:

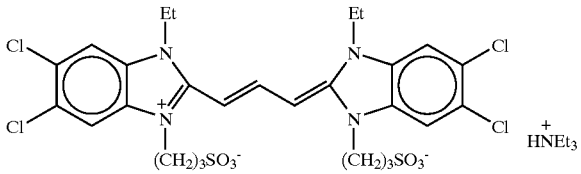

S-4:

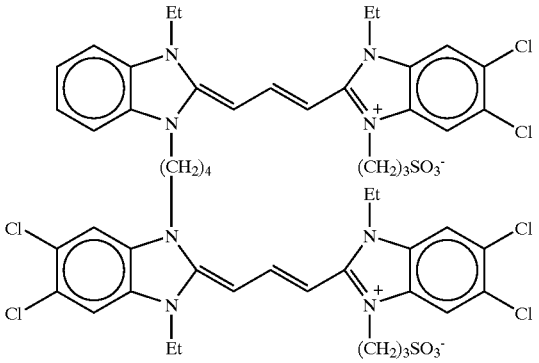

Example I-3

The same comparison as in Example I-2 was performed using the color negative light-sensitive system described in Example 5 of JP-A-8-29904. As a result, assuming that the sensitivity of the blue-sensitive layer of the light-sensitive material in Comparative Example using S-1 was 100 (control), the light-sensitive material using No. 2 of the present invention exhibited high sensitivity of 160. Also, the same comparison was performed using the instant light-sensitive system described in Example 1 of JP-A-2000-28442 (Japanese Patent Application No. 11-89801), as a result, assuming that the sensitivity of the blue-sensitive layer of the light-sensitive material in Comparative Example using S-1 was 100 (control), the light-sensitive material using No. 1 of the present invention exhibited high sensitivity of 159. Furthermore, in the color reversal light-sensitive system described in Example 1 of JP-A-7-92601 and JP-A-11-160828, the color paper system described in Example 1 of JP-A-6-347944, the X-ray light-sensitive material described in Example 1 of JP-A-8-122954, the heat-developable light-sensitive system described in Example 1 of Japanese Patent Application No. 2000-89436, and the printing light-sensitive material system described in Example 1 of JP-A-8-292512, the light-sensitive material using the compound of the present invention was also found to exhibit high sensitivity as compared with those using the comparative compound. In addition, in any of these systems, high light absorption intensity and a large number of chromophore adsorbed layers were attained, revealing that the present invention is useful also in these systems.

From these results, it is verified that a silver halide photographic light-sensitive material having high sensitivity can be obtained by performing the process of the present invention.

Example II-1

Silver Halide Emulsion Em-A was prepared by the following production process.

(Production Process of Em-A)

Em-A was prepared in the same manner as Silver Halide Emulsion Em-A of Example I-1.

(Production Process of Em-A1 to Em-A8)

Compounds 11 and 12 shown in Example I-1 were added to Em-A and then, the temperature was elevated to 60° C. The pH was adjusted to a pH shown in Table II-2 by adding an aqueous KOH solution. Subsequently, the sensitizing dye of the present invention or the comparative sensitizing dye shown in Table II-2 was added and stirred for 30 minutes. Then, the pH was adjusted to the original pH of 5.8 by adding an aqueous solution containing $H_2SO_4$ in an almost equal molar amount to KOH previously added. Thereafter, potassium thiocyanate, chloroauric acid, sodium thiosulfate and N,N-dimethylselenourea were added, thereby optimally performing the chemical sensitization. At the completion of chemical sensitization, Compounds 13 and 14 shown in Example I-1 were added to prepare Em-A1 to Em-A8. The "optimally performing chemical sensitization" as used herein means that sensitizing dyes and compounds each was added in an amount ranging from $10^{-1}$ to $10^{-8}$ mol per mol of silver halide.

The obtained grains were observed by a transmission electron microscope while cooling the grains with liquid nitrogen, as a result, grains where a dislocation line was not present in the region of 80% or less as a projected area from the center part of the grain occupied about 98% (by number) of all grains. In the grain circumferential part of 20% as a projected area from the outer circumference of grain, 13 dislocation lines on average were observed per one grain.

The dye adsorption amount was determined as follows. The liquid emulsion obtained was precipitated by centrifugation at 10,000 rpm for 10 minutes and after freeze-drying the precipitate, 0.05 g of the precipitate was added to 25 ml of an aqueous 25% sodium thiosulfate solution and methanol was added to make 50 ml. The resulting solution was analyzed by high performance liquid chromatography and the dye concentration was determined.

The light absorption intensity per unit area was measured as follows. The emulsion obtained was coated to a small thickness on a slide glass and the transmission spectrum and reflection spectrum of individual grains were determined using a microspectrophotometer MSP65 manufactured by Karl Zweiss K.K. by the following method to determine the absorption spectrum. The area where grains were not present was used as the reference for the transmission spectrum, and the reference for the reflection spectrum was obtained by measuring silicon carbide of which reflectance is known. The measured part is a circular aperture part having a diameter of 1 μm. After adjusting the position not to allow the aperture part to overlap the contour of a grain, the transmission spectrum and the reflection spectrum were measured in the wave number region from 14,000 $cm^{-1}$ (714 nm) to 28,000 $cm^{-1}$ (357 nm). The absorption spectrum was determined from the absorption factor A which is 1−T (transmittance)−R (reflectance). Using the absorption factor A' obtained by subtracting the absorption of silver halide, −Log(1−A') was integrated to the wave number ($cm^{-1}$) and the value obtained was halved and used as a light absorption intensity per unit area. The integration range was from 14,000 to 28,000 $cm^{-1}$. At this time, the light source used was a tungsten lamp and the light source voltage was 8 V. In order to minimize the damage of the dye by the light irradiation, a monochromator in the primary side was used and the wavelength distance and the slit width were set to 2 nm and 2.5 nm, respectively.

The properties of other silver halide emulsions (Em-B to Em-P) used in this Example are shown in Table II-1.

TABLE II-1

| Emulsion No. | Properties of Emulsion: Equivalent-Sphere Diameter, μm | Projected Area Diameter, μm | Aspect Ratio | Iodide Content, mol % |
|---|---|---|---|---|
| Em-B | 1.0 | 2.0 | 12.2 | 10.0 |
| Em-C | 0.7 | — | 1 | 4.0 |
| Em-D | 0.4 | 0.53 | 3.5 | 4.1 |
| Em-E | 1.1 | 2.63 | 20.6 | 6.7 |
| Em-F | 1.2 | 2.74 | 18 | 6.9 |
| Em-G | 0.9 | 1.98 | 15.9 | 6.1 |
| Em-H | 0.7 | 1.22 | 8 | 6.0 |
| Em-I | 0.4 | 0.63 | 6 | 6.0 |

TABLE II-1-continued

| Emulsion No. | Properties of Emulsion: Equivalent-Sphere Diameter, μm | Projected Area Diameter, μm | Aspect Ratio | Iodide Content, mol % |
|---|---|---|---|---|
| Em-J | 1.3 | 3.18 | 22 | 3.5 |
| Em-K | 1.0 | 2.37 | 20 | 4.0 |
| Em-L | 0.8 | 1.86 | 19 | 3.6 |
| Em-M | 0.6 | 1.09 | 8.9 | 2.9 |
| Mm-N | 0.4 | 0.63 | 6 | 2.0 |
| Em-O | 0.3 | 0.38 | 3 | 1.0 |
| Em-P | 1.3 | 3.18 | 22 | 3.5 |

The preparation formulation of the emulsified product used in this Example is briefly described below.

A solution obtained by dissolving a coupler in ethyl acetate, a high boiling point organic solvent and a surfactant were added to a 10% gelatin solution and these were mixed and using a homogenizer (manufactured by Nippon Seiki), emulsified to obtain an emulsified product.

The support used in this Example was prepared in the same manner as in Example I-1.

Furthermore, an undercoat layer, a back layer, a magnetic recording layer and a slipping layer were also provided in the same manner as in Example I-1.

The light-sensitive layers were coated one on another in the same manner as in Example I-1 except for changing the composition of the fourteenth layer as shown below.

Fourteenth Layer (High-Sensitivity Blue-Sensitive Emulsion Layer):

| | |
|---|---|
| Emulsion shown in Table I-2 (Em-A1 to Em-A8) | as silver 0.75 |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |

Dispersions of organic solid disperse dyes were also prepared in the same manner as in Example I-1.

The thus-obtained samples were processed and evaluated in the same manner as in Example I-1.

Samples 101 to 108 were subjected to the processing described in Example I-1. Each processed sample was evaluated on the photographic performance by measuring the density with a blue filter. The results obtained are shown in Table II-2.

TABLE II-2

Sensitivity of High-Sensitivity Blue-Sensitive Emulsion Em-A

| Sample No. | Emulsion | Sensitizing Dye (amount added: $\times 10^{-5}$ mol/Ag-mol) | pH of Emulsion: Before Addition of Sensitizing Dye | After Addition of Sensitizing Dye | Number of Adsorbed Layers | Light Absorption Intensity | Sensitivity | Remarks |
|---|---|---|---|---|---|---|---|---|
| 101 | Em-A1 | S-1 (3.2) | 5.8 | 5.8 | 0.92 | 42 | 100 | Comparison |
| 102 | Em-A2 | S-1 (3.2) | 7.5 | 5.8 | 0.91 | 41 | 99 | " |

TABLE II-2-continued

Sensitivity of High-Sensitivity Blue-Sensitive Emulsion Em-A

| Sample No. | Emulsion | Sensitizing Dye (amount added: $\times 10^{-5}$ mol/Ag-mol) | pH of Emulsion: Before Addition of Sensitizing Dye | pH of Emulsion: After Addition of Sensitizing Dye | Number of Adsorbed Layers | Light Absorption Intensity | Sensitivity | Remarks |
|---|---|---|---|---|---|---|---|---|
| 103 | Em-A3 | No. 11 (1.6) + No. 11 (0.8) + No. 21 (0.8) | 5.8 | 5.8 | 1.69 | 51 | 153 | " |
| 104 | Em-A4 | No. 11 (1.6) + No. 11 (0.8) + No. 21 (0.8) | 7.5 | 5.8 | 1.78 | 61 | 161 | Invention |
| 105 | Em-A5 | No. 11 (1.6) + No. 8 (1.6) | 5.8 | 5.8 | 1.45 | 51 | 134 | Comparison |
| 106 | Em-A6 | No. 11 (1.6) + No. 8 (1.6) | 7.5 | 5.8 | 2.21 | 71 | 188 | Invention |
| 107 | Em-A7 | No. 11 (1.6) + No. 3 (1.6) | 5.8 | 5.8 | 1.61 | 55 | 141 | Comparison |
| 108 | Em-A8 | No. 11 (1.6) + No. 3 (1.6) | 7.5 | 5.8 | 2.04 | 70 | 179 | Invention |

Sensitizing Dye S-1 in Table II-2 is shown below.

S-1:

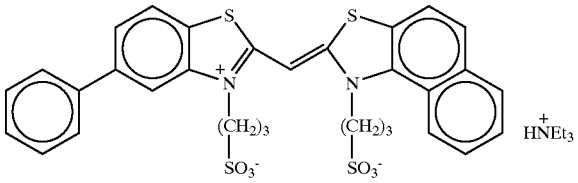

It is seen from the results above, a silver halide photographic light-sensitive material having high sensitivity can be obtained by performing the process of the present invention.

According to the constitution of the present invention, a process for producing a spectrally sensitized silver halide emulsion having high sensitivity can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide photographic emulsion comprising as a sensitizing dye at least one connection dye having two or more chromophores connected through a covalent bond, said process comprising:

(i) adjusting pH before adding said connection dye to a silver halide photographic emulsion;

(ii) adding said connection dye to a silver halide photographic emulsion; and (iii) after (ii), changing the adjusted pH in (i) to allow at least one chromophore out of a plurality of chromophores in the molecule of said connection dye to increase in adsorption strength to a silver halide grain.

2. The process for producing a silver halide photographic emulsion as claimed in claim 1, wherein said increase in the adsorption strength to a silver halide grain is brought about by the addition or dissociation of a proton.

3. The process for producing a silver halide photographic emulsion as claimed in claim 1, wherein said connection dye is represented by the following formula (1):

$$(D_1)_{r2}[(\text{—La—})_{qa}(D_2)_{q1}]_{r1}CI_y \quad (1)$$

wherein La represents a linking group, $D_1$ and $D_2$ each represents a chromophore, $q_1$, $r_1$ and $r_2$ each represents an integer of 1 to 100, qa represents an integer of 1 to 4, CI represents an ion for neutralizing the electric charge, and y represents a number necessary for neutralizing the electric charge, provided that at least one dissociative group or protonatable group is contained within the molecule.

4. A silver halide photographic light-sensitive material comprising at least one or more silver halide photographic emulsion produced by the production process claimed in claim 1.

5. The silver halide photographic light-sensitive material as claimed in claim 4, wherein a sensitizing dye containing a connection dye is adsorbed in multiple layers in said silver halide photographic emulsion layer.

6. A process for producing a silver halide photographic emulsion comprising a silver halide grain having adsorbed on the surface thereof at least one sensitizing dye in multiple layers, said process comprising:

(i) adjusting pH before adding one or a plurality of sensitizing dye(s) to a silver halide photographic emulsion;

(ii) adding said one or plurality of sensitizing dye(s) to a silver halide photographic emulsion; and (iii) after (ii), changing the adjusted pH in (i) to allow at least one sensitizing dye out of said added one or plurality of sensitizing dye(s) to increase in adsorption strength to a silver halide grain.

7. The process for producing a silver halide photographic emulsion as claimed in claim 6, wherein the adsorption amount of the sensitizing dye change by the increase in the adsorption strength.

8. The process for producing a silver halide photographic emulsion as claimed in claim 6, wherein said increase in the adsorption strength is brought about by the addition or dissociation of a proton.

9. The process for producing a silver halide photographic emulsion as claimed in claim 6, wherein the sensitizing dye is a combination of at least two methine dyes.

10. The process for producing a silver halide photographic emulsion as claimed in claim 1, wherein the at least one chromophore has a proton-dissociated group, and the change of pH is a decrease in pH.

11. The process for producing a silver halide photographic emulsion as claimed in claim 6, wherein the at least one chromophore has a proton-dissociated group, and the change of pH is a decrease in pH.

12. The process for producing a silver halide photographic emulsion as claimed in claim 1, wherein the at least one chromophore has a proton-added group having a positive charge, and the change of pH is an increase in pH.

13. The process for producing a silver halide photographic emulsion as claimed in claim 6, wherein the at least one sensitizing dye has a proton-added group having a positive charge, and the change of pH is an increase in pH.

* * * * *